US008771909B2

(12) United States Patent
Koizuka et al.

(10) Patent No.: US 8,771,909 B2
(45) **Date of Patent: *Jul. 8, 2014**

(54) ELECTROPHOTOGRAPHIC PHOTOCONDUCTOR, IMAGE FORMING APPARATUS, AND PROCESS CARTRIDGE

(71) Applicants: Yuusuke Koizuka, Shizuoka (JP); Yuuji Tanaka, Shizuoka (JP); Kazukiyo Nagai, Shizuoka (JP); Tetsuro Suzuki, Shizuoka (JP)

(72) Inventors: Yuusuke Koizuka, Shizuoka (JP); Yuuji Tanaka, Shizuoka (JP); Kazukiyo Nagai, Shizuoka (JP); Tetsuro Suzuki, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/670,022

(22) Filed: Nov. 6, 2012

(65) Prior Publication Data

US 2013/0122409 A1 May 16, 2013

(30) Foreign Application Priority Data

Nov. 15, 2011 (JP) ..... 2011-249879

(51) Int. Cl.
*G03G 5/00* (2006.01)

(52) U.S. Cl.
USPC ..... 430/66; 430/58.6; 430/56; 399/159

(58) Field of Classification Search
USPC ..... 430/66, 58.7, 56; 399/159
See application file for complete search history.

(56) References Cited

U.S. PATENT DOCUMENTS

2009/0238602 A1 9/2009 Iwasaki et al.

FOREIGN PATENT DOCUMENTS

| | | | |
|---|---|---|---|
| JP | 2000-066425 | | 3/2000 |
| JP | 2000-330313 | | 11/2000 |
| JP | 2004-233756 | | 8/2004 |
| JP | 2005-099688 | | 4/2005 |
| JP | 2006-084711 | | 3/2006 |
| JP | 3802787 | | 5/2006 |
| JP | 2007-233425 | | 9/2007 |
| JP | 2009-229549 | | 10/2009 |
| JP | 2012-150400 | A | 8/2012 |
| JP | 2012-150401 | A | 8/2012 |
| JP | 2012-150402 | | 8/2012 |
| JP | 2012-150403 | | 8/2012 |
| WO | WO2012/099181 | A1 | 7/2012 |
| WO | WO2012/099182 | A1 | 7/2012 |

*Primary Examiner* — Mark A Chapman
(74) *Attorney, Agent, or Firm* — Oblon, Spivak, McClelland, Maier & Neustadt, L.L.P.

(57) ABSTRACT

An electrophotographic photoconductor including: an electrically conductive substrate; and at least a photoconductive layer on the electrically conductive substrate, wherein the electrophotographic photoconductor includes an uppermost surface layer, and the uppermost surface layer includes an inorganic filler, an acidic disperser and a three-dimensionally crosslinked polymer, wherein the three-dimensionally crosslinked polymer is formed through polymerization among compounds each containing a charge transporting compound and three or more [(tetrahydro-2H-pyran-2-yl)oxy]methyl groups where the charge transporting compound has one or more aromatic rings and the [(tetrahydro-2H-pyran-2-yl)oxy]methyl groups are bound to the aromatic rings of the charge transporting compound, and wherein the polymerization proceeds after some of the [(tetrahydro-2H-pyran-2-yl)oxy]methyl groups have been partially cleaved and eliminated with an acid catalyst.

9 Claims, 12 Drawing Sheets

ELECTROPHOTOGRAPHIC PHOTOCONDUCTOR, IMAGE FORMING APPARATUS, AND PROCESS CARTRIDGE

BACKGROUND OF THE INVENTION

1. Field of the Invention

The present invention relates to an electrophotographic photoconductor used in, for example, electrophotographic copiers, printers, facsimiles and complex machines thereof, an image forming apparatus; and a process cartridge.

2. Description of the Related Art

By virtue of their various advantageous properties, organic photoconductors (OPCs) have recently been used in a lot of copiers, facsimiles, laser printers and complex machines thereof, in place of inorganic photoconductors. The reason for this includes: optical characteristics such as wide light absorption wavelength range and large light absorption amount; electrical characteristics such as high sensitivity and stable chargeability; a wide range of materials usable; easiness in production; low cost; and non-toxicity.

However, organic photoconductors have a charge transport layer mainly containing, for example, a low-molecular-weight charge transporting compound and an inert polymer. Such organic photoconductors are generally soft and receive mechanical load derived from a developing system or a cleaning system after repetitively used for a long period of time in an electrophotogaphic process, causing a problem that they are degraded in mechanical durability such as abrasion resistance and scratch resistance. Several proposals to form a surface layer containing a three-dimensionally crosslinked polymer on organic photoconductors have been made in order to solve the problem about mechanical durability in organic photoconductors (see, for example, Japanese Patent Application Laid-Open (JP-A) Nos. 2000-066425, 2009-229549 and 2006-084711).

A first proposal is to form a surface layer containing a three-dimensionally crosslinked polymer formed through radical polymerization by applying UV rays or electron beams to a hole transporting compound containing two or more chain-polymerizable functional groups in the same molecule thereof (see, for example, JP-A No. 2000-066425). However, this proposal requires a large, complicated apparatus for applying UV rays or electron beams, which is problematic in productivity. With this proposal including applying UV rays or electron beams, the charge transporting compound is degraded, so that the photoconductor is problematically degraded in electrical characteristics.

A second proposal is to form a surface layer containing a three-dimensionally crosslinked polymer formed by curing a charge transporting compound having a reactive group such as a hydroxyl group (see, for example, JP-A No. 2009-229549). In this proposal, the reactive group such as a hydroxyl group contained in the charge transporting compound remains in the three-dimensionally crosslinked polymer as a highly polar component, causing degradation in chargeability and hence degradation in electrical characteristics of the photoconductor. In a high-temperature, high-humidity environment, the image density tends to decrease due to exposure to NOx gas generated from a charging device, indicating that the photocondutor is poor in environmental stability and stability to gas.

A third proposal is to form a surface layer containing a three-dimensionally crosslinked polymer formed by curing a reaction active species such as melamine and a charge transporting compound having a reactive group (e.g., a hydroxyl group) blocked with a protective group (see, for example, JP-A No. 2006-084711). This proposal can prevent the reactive group such as a hydroxyl group from remaining, but reactivity is poor between the reaction active species and the reactive group (e.g., a hydroxyl group) blocked with a protective group, so that the formed photoconductor is poor in mechanical durability.

As described above, provision of a surface layer containing a three-dimensionally crosslinked polymer on an organic photoconductor can improve the mechanical durability of the electrophotographic photoconductor to some extent, but the electrophotographic photoconductor does not satisfy the required properties. Then, several proposals to form a surface layer containing a three-dimensionally crosslinked polymer and a filler on organic photoconductors have been made in order to further improve mechanical durability (see, for example, JP-A Nos. 2005-099688 and 2000-330313).

A fourth proposal is to disperse a filler in a crosslinked resin layer containing a three-dimensionally crosslinked polymer formed by curing a tri- or more functional radical polymerizable monomer having not having a charge transportable structure and a radical polymerizable monomer having a charge transportable structure (see, for example, JP-A No. 2005-099688). However, this proposal includes applying UV rays or electron beams as in JP-A No. 2000-066425 and is problematic in productivity and electrical characteristics.

A fifth proposal is to incorporate, into a surface layer of a photoconductor, fine particles and a binder resin crosslinked with a blocked isocyanate formed by block-polymerizing a hydroxyl or carboxyl group-containing charge transporting compound (see, for example, JP-A No. 2000-330313). However, in this proposal, unreacted highly polar groups problematically degrade chargeability. In a high-temperature, high-humidity environment, the image density tends to decrease, indicating that the photocondutor is poor in environmental stability. In addition, the stability to gas is problematically degraded due to exposure to NOx gas generated from a charging device.

The third proposal describes that a filler is incorporated for improving mechanical durability. The three-dimensionally crosslinked polymer is degraded in mechanical strength and hence degraded in ability to retain the filler, resulting in that the obtained photoconductor does not satisfy satisfactory mechanical durability (abrasion resistance). The filler incorporated into the surface layer becomes a charge trap, potentially causing an increase in residual potential. Several proposals to reduce adverse effects caused by incorporating the filler into the surface layer have been made (see, for example, Japanese Patent (JP-B) No. 3802787 and JP-A Nos. 2004-233756 and 2007-233425).

A sixth proposal is to add an organic compound having an acid value of 30 mgKOH/g to 400 mgKOH/g to a protective layer formed of a thermoplastic resin and a filler, in order to prevent an increase in residual potential caused by the filler (see, for example, JP-B No. 3802787). However, in this proposal, an acid compound is easily attached to the protective layer in the presence of NOx or ozone gas due to the structure of the organic compound having a specific acid value. The obtained photoconductor generates image blur and may be degraded in stability to gas. Addition of an antioxidant can prevent the image blur. However, the antioxidant added allows the photoconductor be increased in residual potential and hence degraded in electrical characteristics.

A seventh proposal is a method using a polycarbonate resin having a specific structure in a protective layer of a photoconductor in order to reduce image blur caused by an organic compound having a specific acid value (see, for example, JP-A No. 2004-233756). However, the required abrasion resistance is difficult to obtain with the polycarbonate resin used in this proposal and the obtained photoconductor is problematically degraded in mechanical durability.

An eighth proposal is to add an amino compound having a specific structure to the uppermost surface layer of a photoconductor in order to reduce image blur caused by an organic compound having a specific acid value (see, for example, JP-A No. 2007-233425). However, in this proposal, the amino compound used not only degrades the mechanical durability of a photoconductor but also causes phase separation, resulting in that the obtained photoconductor is degraded in electrical characteristics. These techniques are suitable for a protective layer containing a filler in a thermoplastic resin and are not simply applied to a protective layer containing a filler in a cured binder. Moreover, a thermoplastic resin allows the photoconductor not to have satisfactory mechanical durability.

Therefore, even these proposals have not yet provided an electrophotographic photoconductor being excellent in mechanical durability, electrical characteristics, environmental stability and stability to gas and providing truly long service life and stable image quality. At present, there is a strong need to develop such an electrophotographic photoconductor

SUMMARY OF THE INVENTION

The present invention has been made under such circumstances, and aims to solve the above existing problems and achieve the following objects. Specifically, the present invention aims to provide an electrophotographic photoconductor being excellent in mechanical durability, electrical characteristics, environmental stability and stability to gas and providing truly long service life and stable image quality.

The present inventors conducted extensive studies to achieve the above objects and have found that an electrophotographic photoconductor being excellent in mechanical durability, electrical characteristics, environmental stability and stability to gas and providing truly long service life and stable image quality can be produced by forming an uppermost surface layer on an electrophotographic photoconductor containing an electrically conductive substrate and at least a photoconductive layer on the electrically conductive substrate, the uppermost surface layer containing an inorganic filler, an acidic disperser and a three-dimensionally crosslinked polymer which is formed through polymerization among compounds each containing a charge transporting compound and three or more [(tetrahydro-2H-pyran-2-yl)oxy]methyl groups where the charge transporting compound has one or more aromatic rings and the [(tetrahydro-2H-pyran-2-yl)oxy]methyl groups are bound to the aromatic rings of the charge transporting compound, the polymerization occurring after some of the [(tetrahydro-2H-pyran-2-yl)oxy]methyl groups have been partially cleaved and eliminated. The present invention has been completed on the basis of this finding.

The present invention is based on the above finding obtained by the present inventors. Means for solving the above problems are as follows. That is, an electrophotographic photoconductor including:

an electrically conductive substrate; and at least a photoconductive layer on the electrically conductive substrate, wherein the electrophotographic photoconductor includes an uppermost surface layer, and the uppermost surface layer contains an inorganic filler, an acidic disperser and a three-dimensionally crosslinked polymer, wherein the three-dimensionally crosslinked polymer is formed through polymerization among compounds each containing a charge transporting compound and three or more [(tetrahydro-2H-pyran-2-yl)oxy]methyl groups where the charge transporting compound has one or more aromatic rings and the [(tetrahydro-2H-pyran-2-yl)oxy]methyl groups are bound to the aromatic rings of the charge transporting compound, and wherein the polymerization proceeds after some of the [(tetrahydro-2H-pyran-2-yl)oxy]methyl groups have been partially cleaved and eliminated with an acid catalyst.

ADVANTAGEOUS EFFECTS OF INVENTION

The present invention can provide an electrophotographic photoconductor being excellent in mechanical durability, electrical characteristics, environmental stability and stability to gas and providing truly long service life and stable image quality. This can solve the above existing problems.

Since the material for the three-dimensionally crosslinked polymer is a compound containing a charge transporting compound and three or more [(tetrahydro-2H-pyran-2-yl)oxy]methyl groups where the charge transporting compound has one or more aromatic rings and the [(tetrahydro-2H-pyran-2-yl)oxy]methyl groups are bound to the aromatic rings of the charge transporting compound (also referred to as a compound containing a charge transporting compound and three or more [(tetrahydro-2H-pyran-2-yl)oxy]methyl groups bound to one or more aromatic rings thereof), the obtained electrophotographic photoconductor becomes excellent in mechanical durability and electrical characteristics. Also, since the hydroxyl group of an unreacted residue of the above compound is protected, it is possible to prevent degradation in chargeability and image density due to exposure to oxidative gas (NOx) generated from a charging device in a high-temperature, high-humidity environment and as a result the obtained electrophotographic photoconductor becomes excellent in environmental stability and stability to gas.

Use of the acid catalyst allows the curing reaction of the three-dimensionally crosslinked polymer to proceed sufficiently and thus the obtained electrophotographic photoconductor becomes excellent in mechanical durability and stability to gas.

Use of the inorganic filler makes an electrophotographic photoconductor excellent in mechanical durability.

Use of the acidic disperser can increase the dispersibility of the inorganic filler and the obtained electrophotographic photoconductor becomes remarkably excellent in mechanical durability and electrical characteristics.

Use of the acidic disperser can prevent an increase in residual potential caused by the addition of the inorganic filler and the obtained electrophotographic photoconductor becomes excellent in electrical characteristics.

Since the material for the three-dimensionally crosslinked polymer is a compound containing a charge transporting compound and three or more [(tetrahydro-2H-pyran-2-yl)oxy]methyl groups where the charge transporting compound has one or more aromatic rings and the [(tetrahydro-2H-pyran-2-yl)oxy]methyl groups are bound to the aromatic rings of the charge transporting compound, extra acidic disperser that is not adsorbed on the inorganic filler is used in the curing reaction, to thereby prevent image blur due to the chemical structure of the acidic disperser

Figure 1:
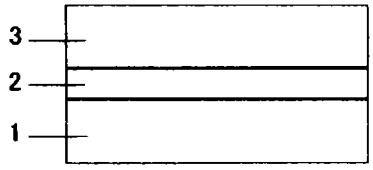
FIG. 1 is a schematic view of a layer structure of an electrophotographic photoconductor according to a first embodiment of the present invention.

DETAILED DESCRIPTION OF THE INVENTION (Electrophotographic Photoconductor)

An electrophotographic photoconductor of the present invention includes: an electrically conductive substrate; and at least a photoconductive layer on the electrically conductive substrate; and, if necessary, further includes other components.

<Electrically Conductive Substrate>

The electrically conductive substrate is not particularly limited, so long as it has an electrical conductivity of a volume resistivity of $10^{10}$ Ω·cm or less, and may be appropriately selected depending on the intended purpose. Also, an endless belt (e.g., an endless nickel belt or an endless stainless-steel belt) described in JP-A No. 52-36016 may be used as the electrically conductive substrate.

The method for forming the electrically conductive substrate is not particularly limited and may be appropriately selected depending on the intended purpose. Examples thereof include: a method of coating a support (e.g., film-form or cylindrical plastic or paper) with a metal (e.g, aluminum, nickel, chromium, nichrome, copper, gold, silver or platinum) or a metal oxide (e.g., tin oxide or indium oxide) through vapor deposition or sputtering; and a method including extruding and pultruding a plate of metal (e.g., aluminum plate, aluminum alloy, nickel plate or stainless steel) to form a raw tube and subjecting the raw tube to surface treatments (e.g., cutting, superfinishing and polishing).

An electrically conductive layer may be formed on the electrically conductive substrate.

The method for forming the electrically conductive layer is not particularly limited and may be appropriately selected depending on the intended purpose. Examples thereof include: a method of coating the above electrically conductive substrate with a coating liquid prepared by optionally dispersing or dissolving electrically conductive powder and a binder resin in a solvent; and a method of providing above electrically conductive substrate with a heat-shrinkable tubing containing conductive powder in a material such as polyvinyl chloride, polypropylene, polyester, polystyrene, polyvinylidene chloride, polyethylene, chlorinated rubber or TEFLON (registered trademark).

The electrically conductive powder is not particularly limited and may be appropriately selected depending on the intended purpose. Examples thereof include carbon black, acethylene black; powder of a metal such as aluminum, nickel, iron, nichrome, copper, zinc or silver; and powder of a metal oxide such as electrically conductive tin oxide or ITO.

The binder resin used in the electrically conductive layer is not particularly limited and may be appropriately selected depending on the intended purpose. Examples thereof include polystyrene resins, styrene-acrylonitrile copolymers, styrene-butadiene copolymers, styrene-maleic anhydride copolymers, polyester resins, polyvinyl chloride resins, vinyl chloride-vinyl acetate copolymers, polyvinyl acetate resins, polyvinylidene chloride resins, polyarylate resins, phenoxy resins, polycarbonate resins, cellulose acetate resins, ethyl cellulose resins, polyvinyl butyral resins, polyvinyl formal resins, polyvinyl toluene resins, poly-N-vinylcarbazole, acrylic resins, silicone resins, epoxy resins, melamine resins, urethane resins, phenol resins and alkyd resins.

The solvent used in the electrically conductive layer is not particularly limited and may be appropriately selected depending on the intended purpose. Examples thereof include tetrahydrofuran, dichloromethane, methyl ethyl ketone and toluene.

<Photoconductive Layer>

The photoconductive layer is not particularly limited and may be appropriately selected depending on the intended purpose, so long as it contains the uppermost surface layer on the uppermost surface thereof. The photoconductive layer is preferably a photoconductive layer containing a charge generation layer, a charge transport layer and an uppermost surface layer (a crosslinked charge transport layer) in this order; and, if necessary, further contains other layers.

<<Uppermost Surface Layer (Crosslinked Charge Transport Layer)>>

The above uppermost surface layer is the uppermost surface layer of the photoconductive layer and is also referred to as a crosslinked charge transport layer.

The uppermost surface layer contains an inorganic filler, an acidic disperser and a three-dimensionally crosslinked polymer which is formed through polymerization among compounds each containing a charge transporting compound and three or more [(tetrahydro-2H-pyran-2-yl)oxy]methyl groups where the charge transporting compound has one or more aromatic rings and the [(tetrahydro-2H-pyran-2-yl)oxy]methyl groups are bound to the aromatic rings of the charge transporting compound, the polymerization occurring after some of the [(tetrahydro-2H-pyran-2-yl)oxy]methyl groups have been partially cleaved and eliminated.

<<<Three-Dimensionally Crosslinked Polymer>>>

The three-dimensionally crosslinked polymer is a polymer having a three-dimensional network structure.

The three-dimensionally crosslinked polymer is formed through polymerization among compounds each containing a charge transporting compound and three or more [(tetrahydro-2H-pyran-2-yl)oxy]methyl groups where the charge transporting compound has one or more aromatic rings and the [(tetrahydro-2H-pyran-2-yl)oxy]methyl groups are bound to the aromatic rings of the charge transporting compound, and the polymerization proceeds after some of the [(tetrahydro-2H-pyran-2-yl)oxy]methyl groups have been partially cleaved and eliminated with the acid catalyst (curing catalyst). In other words, in the formation of the three-dimensionally crosslinked polymer, the compounds each containing a charge transporting compound and three or more [(tetrahydro-2H-pyran-2-yl)oxy]methyl groups bound to one or more aromatic rings thereof bind with one another after some of the [(tetrahydro-2H-pyran-2-yl)oxy]methyl groups have partially been cleaved and eliminated, to thereby form a macromolecule having a three-dimensional network structure; and some of the [(tetrahydro-2H-pyran-2-yl)oxy]methyl groups remain as is in the three-dimensionally crosslinked polymer. In consideration of the infrared absorption spectra and mass reduction before and after reaction, this reaction was found to be a reaction in which some of the [(tetrahydro-2H-pyran-2-yl)oxy]methyl groups were partially cleaved and eliminated.

The (tetrahydro-2H-pyran-2-yl) group contained in the three-dimensionally crosslinked polymer has conventionally been known as a protective group for a hydroxyl group. For example, this fact is described in JP-A No. 2006-084711. Although there have been studied cured products through reaction between a compound having this protective group and a reactive species such as melamine, no reports have been presented on formation of a crosslinked film by sole use of a compound having the (tetrahydro-2H-pyran-2-yl) group serving as a protective group. The term "protective group" leads generally to a concept where the protective group is removed to allow a target reaction to proceed. Assuming that the reaction proceeds after the [(tetrahydro-2H-pyran-2-yl)oxy]methyl groups have been changed to methylol groups, the obtained three-dimensionally crosslinked film is the same as a crosslinked film of a methylol compound. As a result of studies by the present inventors, however, it has been found in the present invention that the compounds each containing a charge transporting compound and three or more [(tetrahydro-2H-pyran-2-yl)oxy]methyl groups bound to one or more aromatic rings thereof react together without the [(tetrahydro-2H-pyran-2-yl)oxy]methyl groups being changed to methylol groups.

Thus, the [(tetrahydro-2H-pyran-2-yl)oxy]methyl groups remain as is in unreacted sites of the three-dimensionally crosslinked polymer. As such, the [(tetrahydro-2H-pyran-2-yl)oxy]methyl groups remaining in the crosslinked polymer influence film properties of the obtained uppermost surface layer. That is, the three-dimensionally crosslinked polymer obtained from the compounds each containing a charge transporting compound and three or more [(tetrahydro-2H-pyran-2-yl)oxy]methyl groups bound to one or more aromatic rings thereof has an advantage that it is smaller than a crosslinked cured product of a methylol compound in terms of gas permeability affecting stability to gas.

The above three-dimensionally crosslinked polymer is a polymer formed through polymerization reaction among the compounds each containing a charge transporting compound and three or more [(tetrahydro-2H-pyran-2-yl)oxy]methyl groups bound to one or more aromatic rings thereof and is used in the uppermost surface layer of the electrophotographic photoconductor. Thus, the obtained electrophotographic photoconductor is excellent in mechanical durability (abrasion resistance) and electrical characteristics (e.g., charging stability).

The three-dimensionally crosslinked polymer exhibits good charge transporting property. In addition, it appropriately contains such electrically inactive sites that do not directly contribute to charge transportation as the [(tetrahydro-2H-pyran-2-yl)oxy]methyl groups, and thus is excellent in charging stability. Furthermore, it does not contain any polar group such as a hydroxyl group and thus is excellent in environmental stability.

The three-dimensionally crosslinked polymer is not particularly limited and may be appropriately selected depending on the intended purpose. It is preferably a polymer insoluble to a solvent in terms of being excellent in mechanical durability, more preferably a polymer insoluble to tetrahydrofuran as a solvent.

The compound containing a charge transporting compound and three or more [(tetrahydro-2H-pyran-2-yl)oxy]methyl groups bound to one or more aromatic rings thereof, which is a material for the above three-dimensionally crosslinked polymer, dissolves well in tetrahydrofuran. Once these compounds react and bond with one another to form a three-dimensionally network structure, the resultant obtained three-dimensionally crosslinked polymer no longer dissolves in tetrahydrofuran or any other solvents. Thus, the fact that the three-dimensionally crosslinked polymer is insoluble to tetrahydrofuran means that a macromolecule has been formed on and united with the surface of the electrophotographic photoconductor, and the obtained electrophotographic photoconductor exhibits excellent mechanical properties. Here, the "being insoluble" means a state where the three-dimensionally crosslinked polymer does not disappear even when immersed in tetrahydrofuran. Preferably, this state is a state where even when the three-dimensionally crosslinked polymer is rubbed with a swab soaked in tetrahydrofuran, there is no trace left in the three-dimensionally crosslinked polymer. When the three-dimensionally crosslinked polymer is allowed to be insoluble to a solvent, foreign matter can be prevented from adhering to the electrophotographic photoconductor, and also the electrophotographic photoconductor surface can be prevented from being scratched due to adhesion of the foreign matter.

—Compound Containing a Charge Transporting Compound and Three or More [(tetrahydro-2H-pyran-2-yl)oxy]methyl Groups Bound to One or More Aromatic Rings Thereof—

The compounds containing a charge transporting compound and three or more [(tetrahydro-2H-pyran-2-yl)oxy]methyl groups bound to one or more aromatic rings thereof form a three-dimensionally crosslinked polymer through polymerization reaction occurring after some of the [(tetrahydro-2H-pyran-2-yl)oxy]methyl groups have been eliminated.

The charge transporting compound used in the compound containing a charge transporting compound and three or more [(tetrahydro-2H-pyran-2-yl)oxy]methyl groups bound to one or more aromatic rings thereof is not particularly limited and may be appropriately selected depending on the intended purpose. Examples thereof include compound each having a triarylamine structure, an aminobiphenyl structure, a benzidine structure, an aminostilbene structure, a naphthalenetetracarboxylic acid diimide structure and a benzylhydrazine structure.

—Compound Represented by General Formula (1)—

The compound containing a charge transporting compound and three or more [(tetrahydro-2H-pyran-2-yl)oxy]methyl groups bound to one or more aromatic rings thereof is not particularly limited and may be appropriately selected depending on the intended purpose. It is preferably a compound represented by the following General Formula (1). Compounds represented by General Formula (1) may be used alone or in combination.

General Formula (1)

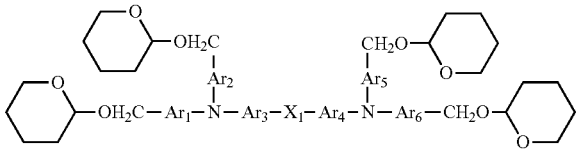

In General Formula (1), $X_1$ is a C1-C4 alkylene group, a C2-C6 alkylidene group, a divalent group formed of two C2-C6 alkylidene groups bonded together via a phenylene group, or an oxygen atom, and $Ar_1$, $Ar_2$, $Ar_3$, $Ar_4$, $Ar_5$ and $Ar_6$ each are a C6-C18 divalent aromatic hydrocarbon group which may have an alkyl group as a substituent.

Through polymerization reaction, the compound represented by General Formula (1) can easily form a three-dimensionally crosslinked polymer in which some of the [(tetrahydro-2H-pyran-2-yl)oxy]methyl groups remain as is. The formed three-dimensionally crosslinked polymer achieves a favorable balance between hardness and elasticity, making it possible to form a stiff surface protective layer excellent in both scratch resistance and abrasion resistance.

The compound represented by General Formula (1) contains a charge transporting compound and four [(tetrahydro-2H-pyran-2-yl)oxy]methyl groups bound to aromatic rings thereof and contains a nonconjugated linking group denoted by $X_1$ and thus has an appropriate molecular mobility.

Furthermore, by virtue of the structure of $X_1$, the compound represented by General Formula (1) has a relatively high oxidation potential not to be easily oxidized. Thus, this is relatively stable when exposed to oxidative gas such as ozone gas or NOx gas, making it possible to provide a photoconductor having excellent stability to gas.

Examples of the C1-C4 alkylene group denoted by $X_1$ in General Formula (1) include linear or branched alkylene groups such as methylene, ethylene, propylene and butylene.

Examples of the C2-C6 alkylidene group denoted by $X_1$ in General Formula (1) include 1,1-ethylidene, 1,1-propylidene, 2,2-propylidene, 1,1-butylidene, 2,2-butylidene, 3,3-pentanylidene and 3,3-hexanylidene.

Examples of the divalent group $X_1$ formed of two C2-C6 alkylidene groups bonded together via a phenylene group in General Formula (1) include the following groups:

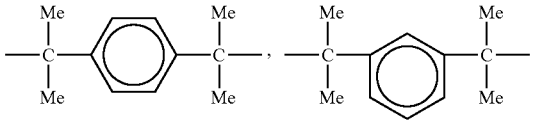

where Me is a methyl group.

The compound represented by General Formula (1) is not particularly limited and may be appropriately selected depending on the intended purpose; but is preferably a compound represented by the following General Formula (1-1) since it is suitable to crosslinking reaction and polymerization reaction.

General Formula (1-1)

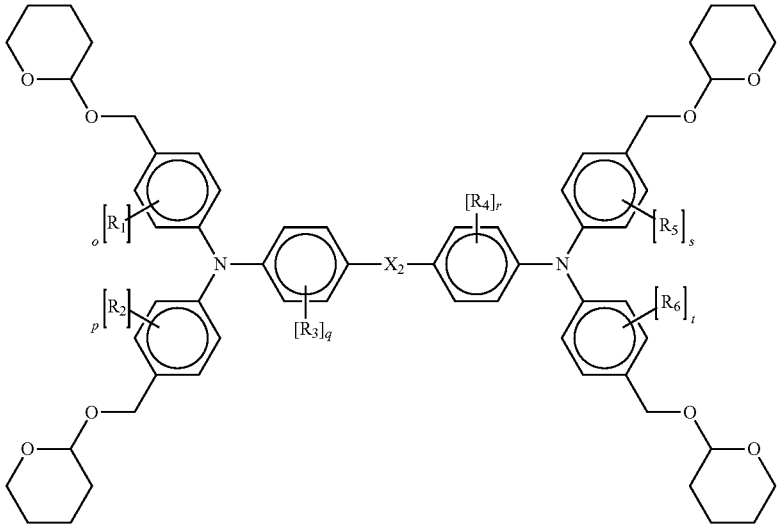

In General Formula (1-1), $X_2$ is —$CH_2$—, —$CH_2CH_2$—, —$C(CH_3)_2$-Ph-$C(CH_3)_2$—, —$C(CH_2)_5$— or —O—, where Ph is a phenylene group; $R_1$, $R_2$, $R_3$, $R_4$, $R_5$ and $R_6$, which may be the same or different, each are a hydrogen atom, a methyl group or an ethyl group; and o, p, q, r, s and t each are an integer of 1 to 4.

The compound represented by General Formula (1-1) has the same features as those of the compound represented by General Formula (1), making it possible to form a crosslinked protective layer achieving a favorable balance between hardness and elasticity, being excellent in stability to gas and having a high crosslink density.

The compound represented by General Formula (1) is not particularly limited and may be appropriately selected depending on the intended purpose. Specific examples thereof include compounds expressed by the following Structural Formulas (1-1) to (1-21). The compounds expressed by the following Structural Formulas (1-1) to (1-10), (1-12), (1-13) and (1-16) to (1-21) are also specific examples of the compound represented by General Formula (1-1).

Structural Formula (1-1)

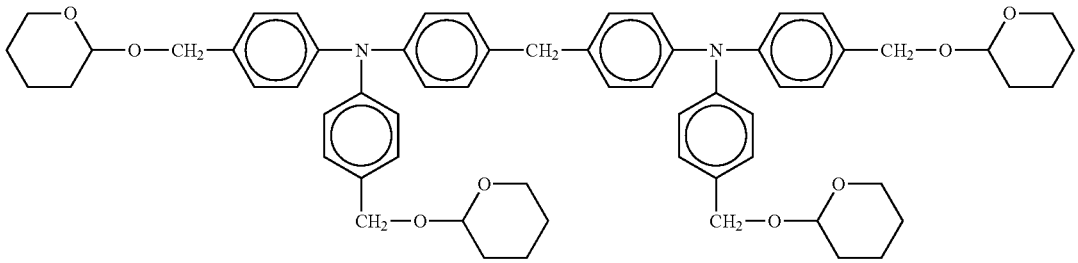

Structural Formula (1-2)

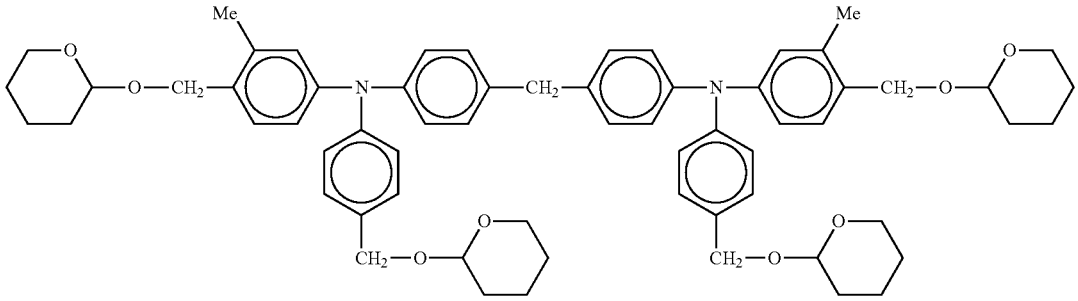

-continued
Structural Formula (1-3)
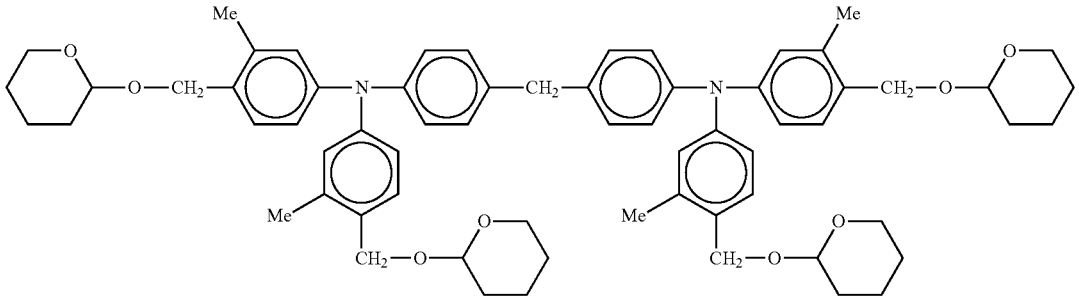
Structural Formula (1-4)
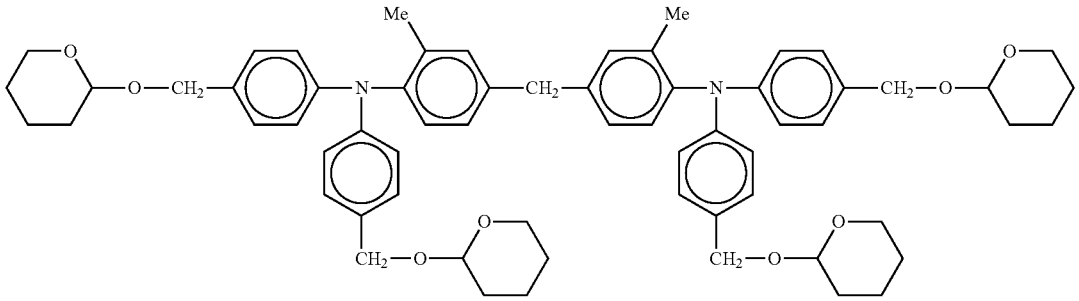
Structural Formula (1-5)
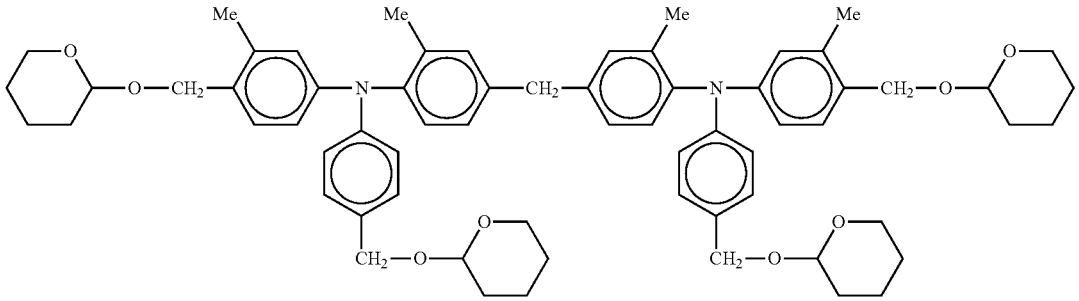
Structural Formula (1-6)
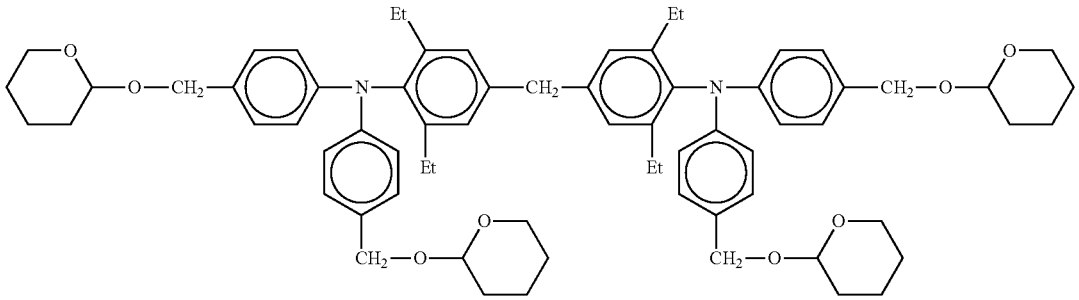
Structural Formula (1-7)
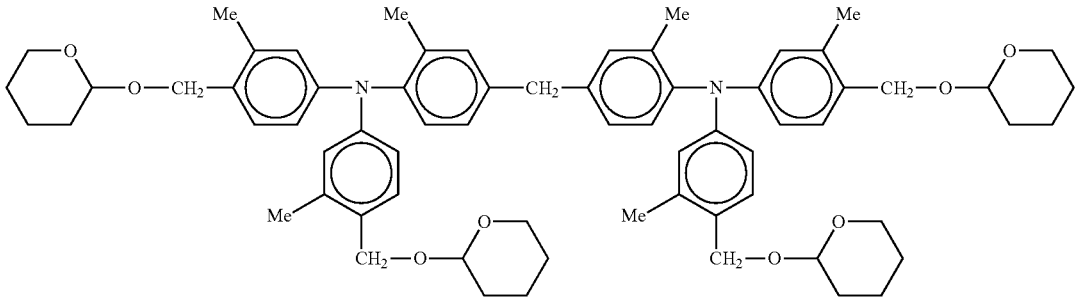

-continued
Structural Formula (1-8)
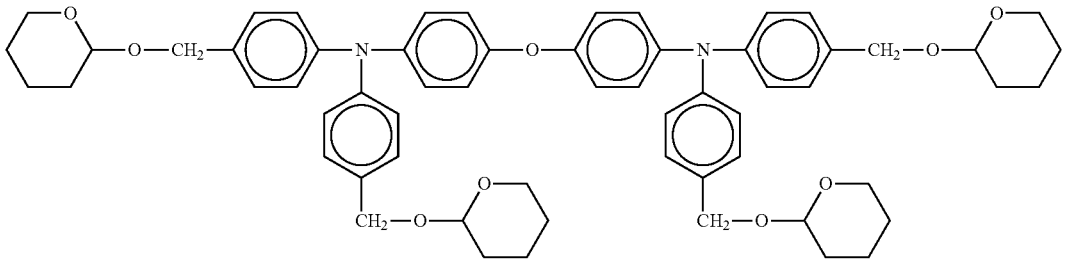
Structural Formula (1-9)
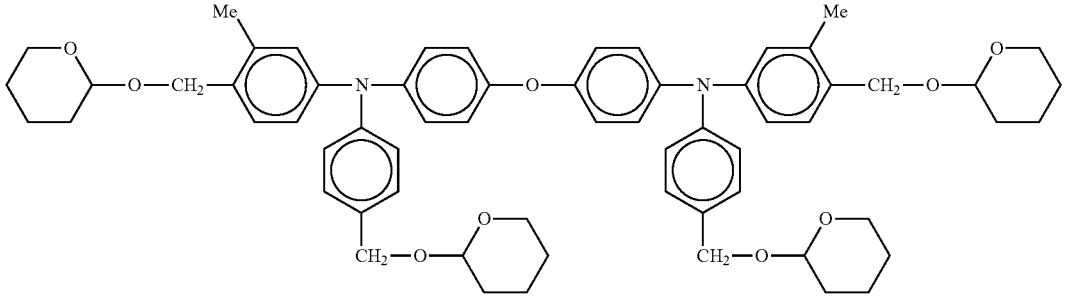
Structural Formula (1-10)
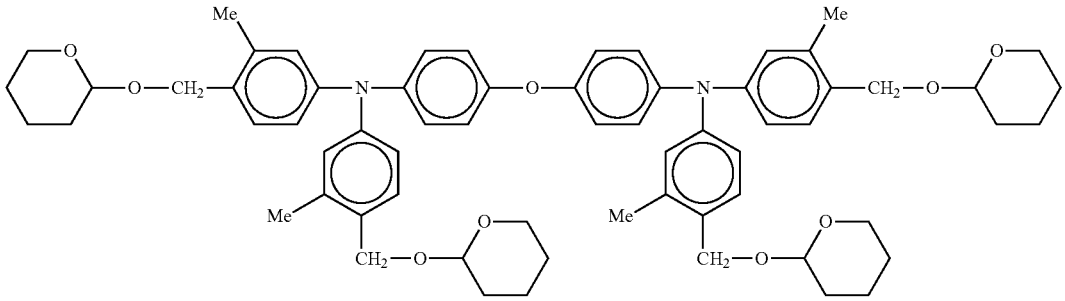
Structural Formula (1-11)
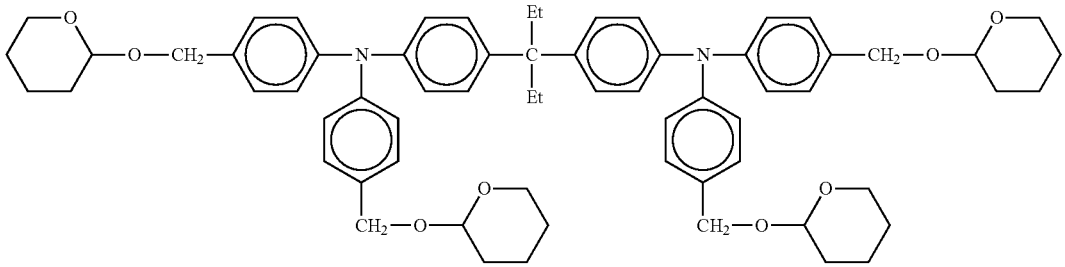
Structural Formula (1-12)
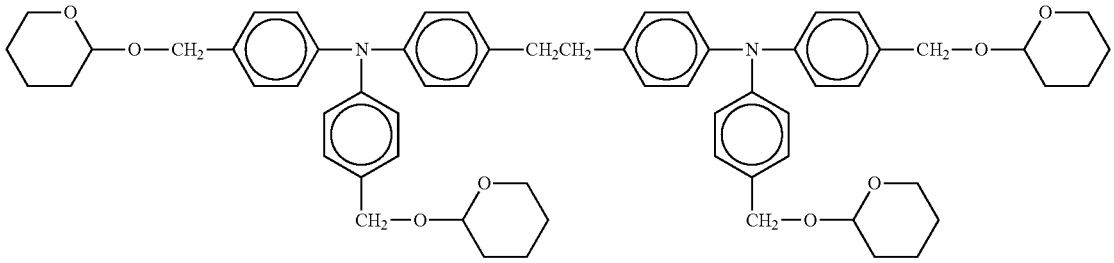

-continued
Structural Formula (1-13)
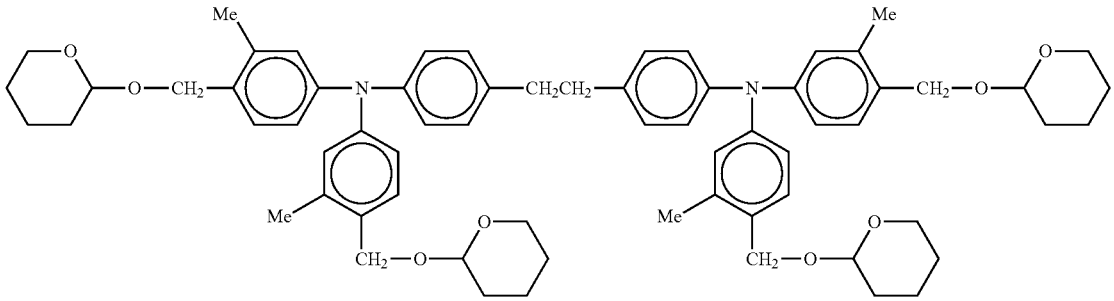
Structural Formula (1-14)
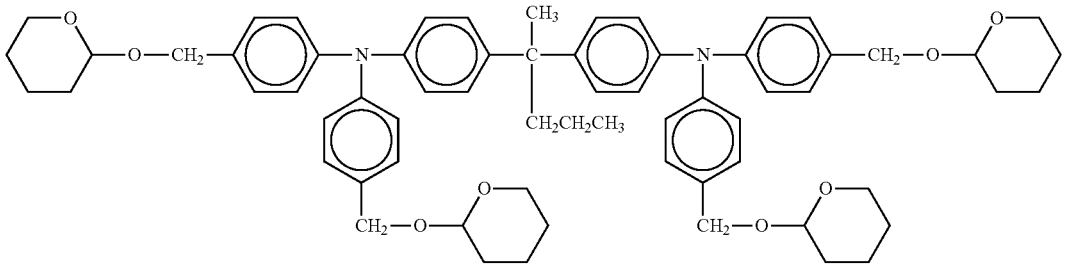
Structural Formula (1-15)
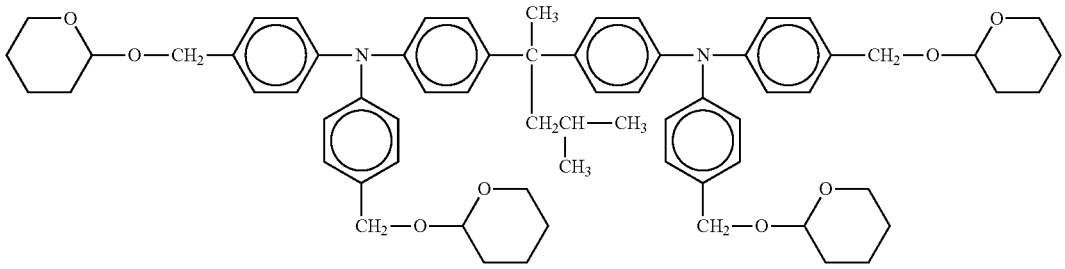
Structural Formula (1-16)
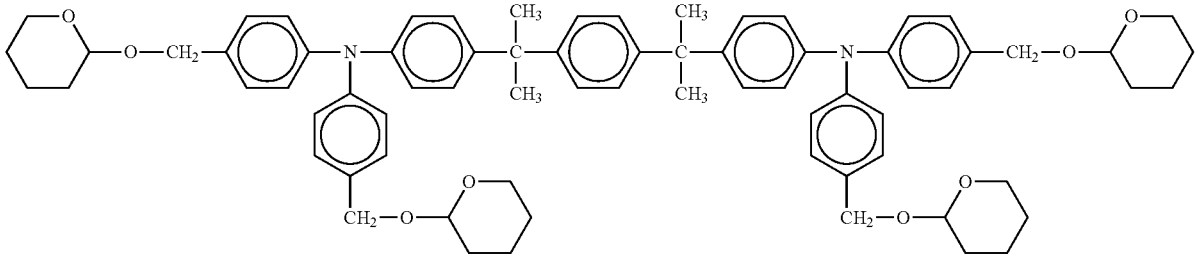
Structural Formula (1-17)
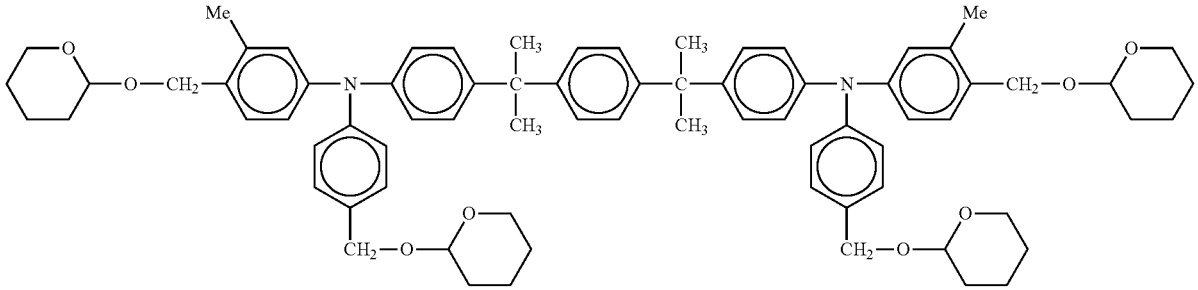

-continued

Structural Formula (1-18)

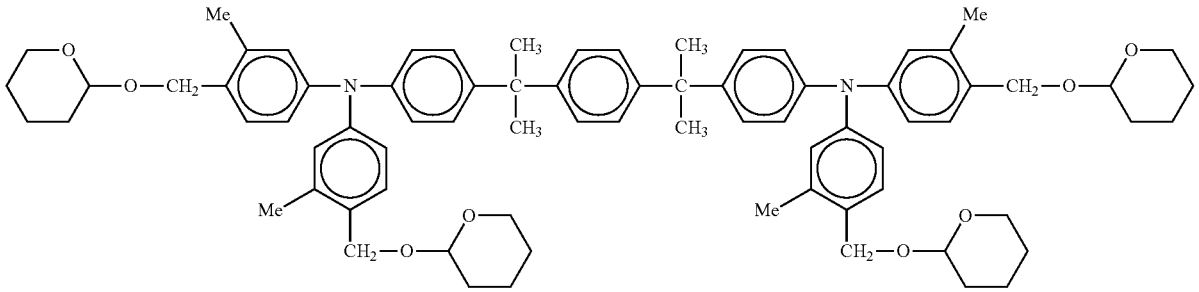

Structural Formula (1-19)

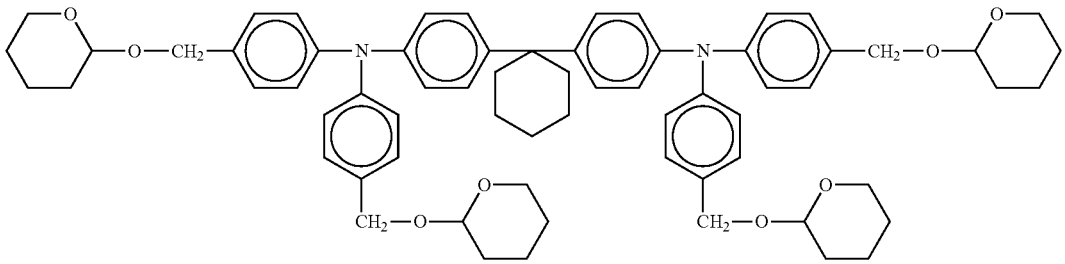

Structural Formula (1-20)

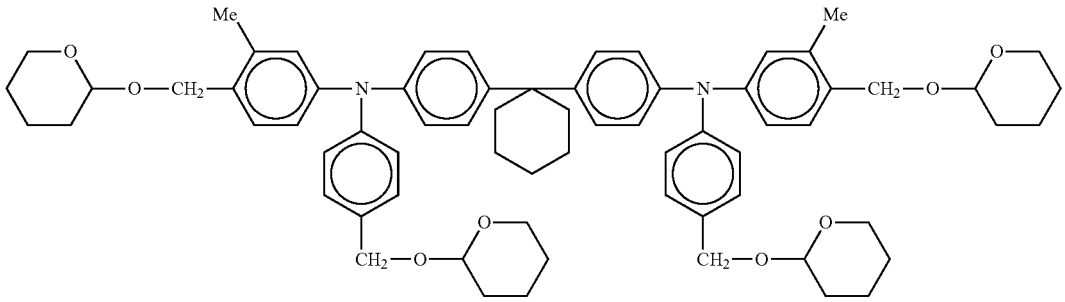

Structural Formula (1-21)

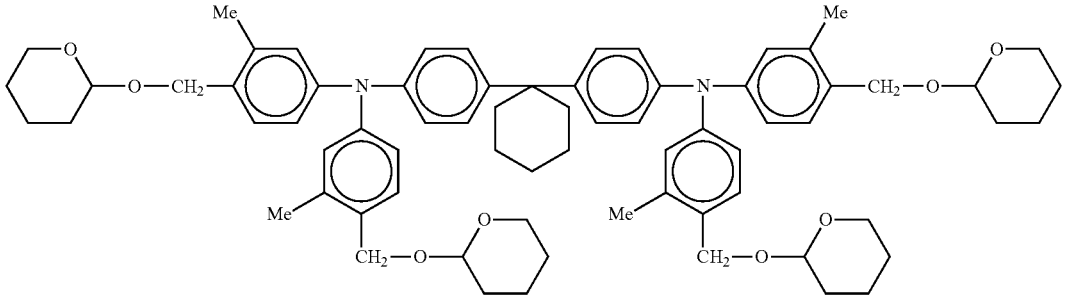

In the above Structural Formulas, Me is a methyl group and Et is an ethyl group.

—Synthesis Method for the Compound Containing a Charge Transporting Compound and Three or More [(tetrahydro-2H-pyran-2-yl)oxy]methyl Groups Bound to One or More Aromatic Rings Thereof—

The compound containing a charge transporting compound and three or more [(tetrahydro-2H-pyran-2-yl)oxy]methyl groups bound to one or more aromatic rings thereof is a novel compound and can be produced by, for example, the following first or second synthesis method.

—First Synthesis Method—

The first synthesis method includes: (1) synthesizing an aldehyde compound of the above charge transporting compound; (2) reacting the obtained aldehyde compound of the charge transporting compound with a reducing agent to synthesize a methylol compound (a methylol compound of the charge transporting compound); and (3) reacting the obtained methylol compound with 3,4-dihydro-2H-pyran to synthesize the compound containing three or more [(tetrahydro-2H-pyran-2-yl)oxy]methyl groups.

The synthesis method for the aldehyde compound of the charge transporting compound obtained in (1) above is not particularly limited and may be appropriately selected depending on the intended purpose. For example, as shown in the following reaction formula, a charge transporting compound, serving as a starting material, can be formylated by a conventionally known method (e.g., Vilsmeier reaction) to synthesize an aldehyde compound. This formylation is described in detail in the formylation described in JP-B No. 3943522 and the formylation methods described therein can also be used.

The method for formylating three or more aromatic rings of the charge transporting compound is not particularly limited and may be appropriately selected depending on the intended purpose. Examples thereof include a method using, for example, zinc chloride, phosphorus oxychloride or dimethylformaldehyde.

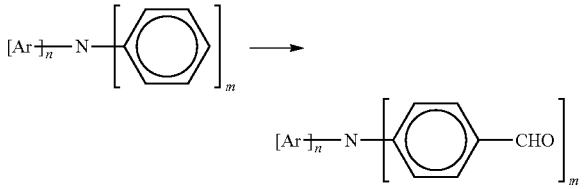

In this reaction formula, n is an integer of 0 to 2, m is an integer shown by 3-n, and Ar is an aromatic ring of a charge transporting compound used in the present invention.

The synthesis method for the methylol compound obtained in (2) above (the methylol compound of the charge transporting compound) is not particularly limited and may be appropriately selected depending on the intended purpose. For example, as shown in the following reaction formula, an aldehyde compound (an aldehyde compound of the charge transporting compound), serving as an intermediate compound, can be reduced by a conventionally known reduction method to synthesize a methylol compound.

The reduction method for synthesizing the methylol compound of the charge transporting compound is not particularly limited and may be appropriately selected depending on the intended purpose. It is preferably a reduction method using sodium borohydride.

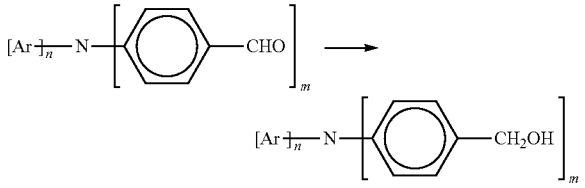

In this reaction formula, n is an integer of 0 to 2, m is an integer shown by 3-n, and Ar is an aromatic ring of a charge transporting compound used in the present invention.

The synthesis method for the compound containing three or more [(tetrahydro-2H-pyran-2-yl)oxy]methyl groups obtained in (3) above is not particularly limited and may be appropriately selected depending on the intended purpose. For example, as shown in the following reaction formula, 3,4-dihydro-2H-pyran can be added to a methylol compound serving as an intermediate compound in the presence of an acid catalyst to synthesize a compound containing three or more [(tetrahydro-2H-pyran-2-yl)oxy]methyl groups.

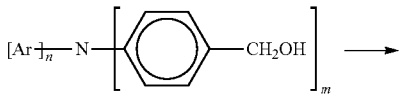

-continued

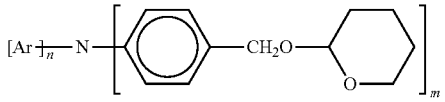

In this reaction formula, n is an integer of 0 to 2, m is an integer shown by 3-n, and Ar is an aromatic ring of a charge transporting compound used in the present invention.

—Second Synthesis Method—

The second synthesis method includes: (1) synthesizing an intermediate compound containing a [(tetrahydro-2H-pyran-2-yl)oxy]methyl group; and (2) coupling the intermediate compound with an amine compound to synthesize a charge transporting compound.

The synthesis method for the intermediate compound containing a [(tetrahydro-2H-pyran-2-yl)oxy]methyl group obtained in (1) above is, for example, a method where a compound having a halogen and a methylol group on an aromatic ring is used as a starting material and the methylol group thereof is reacted with 3,4-dihydro-2H-pyran in the presence of an acid catalyst to synthesize an intermediate compound having a halogen and a [(tetrahydro-2H-pyran-2-yl)oxy]methyl group.

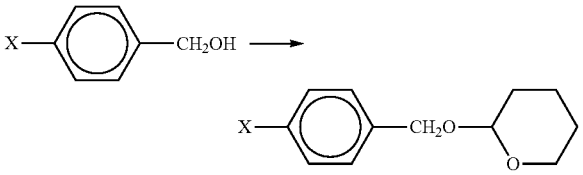

In this reaction formula, X is a halogen.

The synthesis method for the compound containing a charge transporting compound and three or more [(tetrahydro-2H-pyran-2-yl)oxy]methyl groups bound to one or more aromatic rings thereof obtained in (2) above is, for example, a method where the intermediate compound having a [(tetrahydro-2H-pyran-2-yl)oxy]methyl group is coupled with an amine compound to synthesize a charge transporting compound.

Depending on the number of the amine compound or on whether the amine compound is primary, secondary or tertiary, it is possible to introduce many [(tetrahydro-2H-pyran-2-yl)oxy]methyl groups at one time. When the halogen is iodine, the amine compound can be coupled therewith through Ullmann reaction. When the halogen is chlorine or bromine, the amine compound can be coupled therewith through, for example, Suzuki-Miyaura reaction using a palladium catalyst.

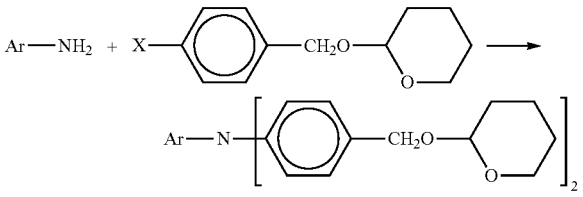

In this reaction formula, Ar is an aromatic ring of a charge transporting compound used in the present invention.

—Polymerization Method—

The polymerization reaction will next be described.

The compounds each containing a charge transporting compound and three or more [(tetrahydro-2H-pyran-2-yl)oxy]methyl groups bound to one or more aromatic rings thereof bind with one another after some of the [(tetrahydro-2H-pyran-2-yl)oxy]methyl groups have partially been cleaved and eliminated with the acid catalyst under heating, to thereby form a macromolecule having a three-dimensional network structure. Here, some of the [(tetrahydro-2H-pyran-2-yl)oxy]methyl groups remain as is in the three-dimensionally crosslinked polymer. Although there has not been elucidated the reaction in which some of the [(tetrahydro-2H-pyran-2-yl)oxy]methyl groups are partially cleaved and eliminated, this reaction is not a single reaction but a reaction in which a plurality of reactions as shown below competitively proceed to link the compounds together.

—Reaction Mode—

The reaction modes will next be described.

The compounds each containing a charge transporting compound and three or more [(tetrahydro-2H-pyran-2-yl)oxy]methyl groups bound to one or more aromatic rings thereof are presumably polymerized to have various bonds through a combination of the following Reaction modes 1 to 3, to thereby form a macromolecule having a three-dimensional network structure.

All of these reactions are reactions where some of the [(tetrahydro-2H-pyran-2-yl)oxy]methyl groups are partially cleaved and eliminated, accompanying reduction in mass. Thus, when the compositions are heated with the acid catalyst by means of a TG-DTA thermogravimetric apparatus, reduction in mass is observed. Also, when the gas generated during the heating reaction is analyzed with a gas chromatograph mass spectrometer (GC-MS), there are detected eliminated products such as 3,4-dihydro-2H-pyran and 5-hydroxypentanal which indicate that the (tetrahydro-2H-pyran-2-yl)oxy group is partially cleaved.

[Reaction Mode 1]

In Reaction mode 1, the tetrahydro-2H-pyran-2-yl group of one [(tetrahydro-2H-pyran-2-yl)oxy]methyl group is cleaved and eliminated; and then, while the (tetrahydro-2H-pyran-2-yl)oxy group of the other [(tetrahydro-2H-pyran-2-yl)oxy]methyl group is being cleaved and eliminated, a dimethylene ether bond is formed therebetween.

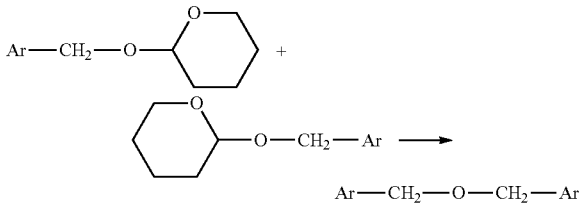

In this reaction formula, Ar is an aromatic ring of a charge transporting compound used in the present invention.

[Reaction Mode 2]

In Reaction mode 2, while the (tetrahydro-2H-pyran-2-yl)oxy groups of both the [(tetrahydro-2H-pyran-2-yl)oxy]methyl groups are being cleaved and eliminated, an ethylene bond is formed therebetween.

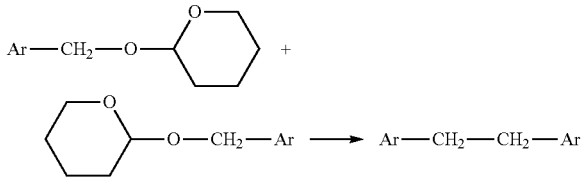

In this reaction formula, Ar is an aromatic ring of a charge transporting compound used in the present invention.

[Reaction Mode 3]

In Reaction mode 3, while the (tetrahydro-2H-pyran-2-yl)oxy group of one [(tetrahydro-2H-pyran-2-yl)oxy]methyl group is being cleaved and eliminated, the one [(tetrahydro-2H-pyran-2-yl)oxy]methyl group binds with the aromatic ring of the other [(tetrahydro-2H-pyran-2-yl)oxy]methyl group to form a methylene bond therebetween.

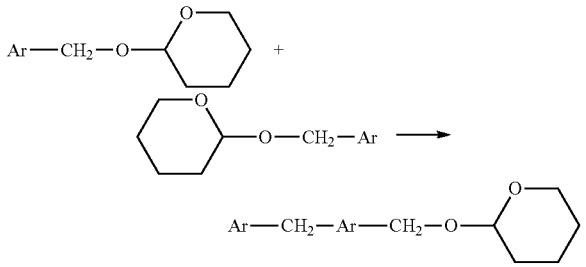

In this reaction formula, Ar is an aromatic ring of a charge transporting compound used in the present invention.

The (tetrahydro-2H-pyran-2-yl)oxy group is generally known as a protective group of a hydroxyl group. In the cured film of the present invention, the [(tetrahydro-2H-pyran-2-yl)oxy]methyl groups remain. Thus, presumably, deprotection reaction does not occur. In other words, the [(tetrahydro-2H-pyran-2-yl)oxy]methyl group is not hydrolyzed to change into a methylol group. In addition, the (tetrahydro-2H-pyran-2-yl)oxy group has a low polarity and thus, the unreacted, remaining (tetrahydro-2H-pyran-2-yl)oxy group does not adversely affect electrical characteristics or image quality. Although the polymerization reaction tends to form a film having severe distortion, relatively bulky [(tetrahydro-2H-pyran-2-yl)oxy]methyl groups remaining have an effect of reducing such distortion, and also can be expected to compensate molecular spaces formed through distortion, making it possible to form a film having low gas permeability and higher stiffness; i.e., lower brittleness.

It is possible to desirably change the amount of the [(tetrahydro-2H-pyran-2-yl)oxy]methyl groups reacted or unreacted (remaining) in the molecule, in order to adjust the structure of the charge transporting compound and obtain the desired film properties. However, when the amount of the [(tetrahydro-2H-pyran-2-yl)oxy]methyl groups remaining is too small, the formed film involves severe distortion and brittleness, and is not suitable to a long-service-life photoconductor. Meanwhile, it is necessary to increase the reaction temperature, in order to increase the amount of the [(tetrahydro-2H-pyran-2-yl)oxy]methyl groups reacted. In this case, the heat degrades photoconductivity of the formed photoconductor, leading to problems such as decrease in sensitivity and increase in residual potential. When the amount of the [(tetrahydro-2H-pyran-2-yl)oxy]methyl groups remaining is too large, the formed film decreases in crosslink density and in some cases, dissolves in an organic solvent; i.e., poorly crosslinked state. As a result, it does not exhibit excellent mechanical properties attributed to the three-dimensionally crosslinked film, and also does degrade in an ability to retain an inorganic filler. Thus, it is preferred to select such curing conditions as to give a film having both favorable mechanical durability and favorable environmental stability (electrostatic properties).

—Forming Method for Three-Dimensionally Crosslinked Polymer—

The formation of the three-dimensionally crosslinked polymer may be performed simultaneously with the formation of the uppermost surface layer.

The forming method for the three-dimensionally crosslinked polymer is not particularly limited and may be appropriately selected depending on the intended purpose. For example, a coating liquid containing: at least the compound containing a charge transporting compound and three or more [(tetrahydro-2H-pyran-2-yl)oxy]methyl groups bound to one or more aromatic rings thereof; the acid catalyst; the acidic disperser; the inorganic filler; and optionally used other ingredients is prepared and optionally diluted with a solvent. Then, the obtained coating liquid is coated on the electrophotographic photoconductor surface and heated and dried to perform polymerization. Here, the three-dimensionally crosslinked polymer is formed in the form of film to thereby the uppermost surface layer.

The heating temperature for forming the three-dimensionally crosslinked polymer may be selected as desired depending on the formulation of the coating liquid since the reaction rate varies with the type or amount of the catalyst used. It is preferably 80° C. to 160° C., more preferably 100° C. to 150° C., particularly preferably 135° C. to 150° C. When the heating temperature is lower than 80° C., the reaction rate is low and as a result a sufficient crosslink density cannot be achieved even when performing the reaction for a long period of time. When the heating temperature is higher than 160° C., the reaction rate becomes high and as a result an extreme increase in crosslink density leads to a decrease in charge transporting property whereby the formed photoconductor is increased in exposed-area potential and decreased in sensitivity. In addition, the other layers of the electrophotographic photoconductor are increasingly affected due to the heating, potentially degrading the formed electrophotographic photoconductor.

The period for which the heating is performed for forming the three-dimensionally crosslinked polymer is preferably 20 min to 60 min when the heating and drying are performed at 135° C. to 150° C.

<<<Inorganic Filler>>>

Use of the inorganic filler makes the electrophotographic photoconductor remarkably excellent in mechanical durability. The inorganic filler is not particularly limited and may be appropriately selected depending on the intended purpose. Examples thereof include: metal oxides such as titanium oxide, zirconia, alumina, silica, tin oxide, zinc oxide, indium oxide, antimony oxide, bismuth oxide, calcium oxide, tin oxide doped with antimony, and indium oxide doped with tin; powder of metals such as copper, tin, aluminum and indium; metal fluorides such as tin fluoride, calcium fluoride and aluminum fluoride; and potassium titanate and boron nitride. Among them, metal oxides are preferred from the viewpoints of hardness and light transmittance.

The metal oxide is not particularly limited and may be appropriately selected depending on the intended purpose. It is preferably a highly electrically-insulating inorganic filler and a basic inorganic filler from the viewpoint of suppressing image blur. Examples of the metal oxides having both of these properties include titanium oxide and alumina, which are particularly preferably used. Next will be described a reason why the inorganic filler having these properties is effective to suppression of image blur.

The inorganic filler is not particularly limited and may be appropriately selected depending on the intended purpose. From the viewpoint of suppressing image blur, it is more preferably a highly electrically-insulating inorganic filler having a specific resistance of $10^{10}$ Ω·cm or higher, including alumina, zirconia, titanium oxide and silica. Meanwhile, incorporating an electrically conductive filler having a specific resistance of lower than $10^{10}$ Ω·cm into the uppermost surface of the photoconductor reduces the resistance of the surface and as a result charges move laterally to easily cause image blur in some cases. The electrically conductive filler is not particularly limited and may be appropriately selected depending on the intended purpose. Examples of such inorganic filler include tin oxide, indium oxide, antimony oxide, tin oxide doped with antimony, and indium oxide doped with tin. In the present invention, however, these inorganic fillers are not preferable since image blur is easier to occur. Since even inorganic fillers formed of the same material may be different in specific resistance, inorganic fillers are completely classified on the basis of their materials. Thus, it is important to select an inorganic filler on the basis of its specific resistance.

The method for measuring the specific resistance of the inorganic filler is not particularly limited and may be appropriately selected depending on the intended purpose. The specific resistance of the inorganic filler can be measured using, for example, a resistance meter for powder. Specifically, powder of a metal oxide is added to a cell, which is then sandwiched by electrodes. A load is applied to adjust the amount of the metal oxide powder so that the thickness of the metal oxide powder becomes about 2 mm. Thereafter, a voltage is applied to between the electrodes to thereby measure current, with which the specific resistance is calculated.

The inorganic filler is not particularly limited and may be appropriately selected depending on the intended purpose. It is preferably a basic inorganic filler from the viewpoint of suppressing image blur. In the constitution of the present invention, it has been found that the inorganic filler is preferably an inorganic filler having a pH of 5 or higher at the isoelectric point.

The method for measuring the pH of the inorganic filler (i.e., the method for measuring the zeta potential) is not particularly limited and may be appropriately selected depending on the intended purpose. For example, the pH of the inorganic filler can be measured using, for example, a laser zeta potential meter (product of OTSUKA ELECTRONICS CO., LTD.).

In the present invention, curing is performed using an acid catalyst. Hence, the acid catalyst left after curing remains as a highly polar component, potentially causing image blur. In order to solve this problem, use of the basic inorganic filler can effectively neutralize the acid catalyst left, making it possible to form a film further resistant to image blur. Also, the basic inorganic filler electrically neutralizes oxidative gas adsorbed onto the photoconductor surface. As a result, the photoconductor surface is hard to be decreased in resistance, making it difficult to cause image blur.

The average primary particle diameter of the inorganic filler is not particularly limited and may be appropriately selected depending on the intended purpose. It is preferably 0.05 μm to 0.9 μm, more preferably 0.1 μm to 0.6 μm, since the inorganic filler having an average primary particle diameter falling within the above preferable range is excellent in light transmittance, abrasion resistance and dispersiblity. When the average primary particle diameter thereof is less than 0.05 μm, the inorganic filler aggregates to lead to a drop in abrasion resistance. When it is higher than 0.9 μm, the inorganic filler tends to sediment to potentially cause image failures or form abnormal images.

The amount of the inorganic filler is not particularly limited and may be appropriately selected depending on the intended purpose. It is preferably 0.1% by mass to 50% by mass, more preferably 3% by mass to 30% by mass, relative to the total solid content of the layer containing the filler. When the amount of the inorganic filler is less than 0.1% by mass, the abrasion resistance may become insufficient. When it is higher than 50% by mass, adverse effects on image quality may become increased such as increase in residual potential, occurrence of image blur, and degradation in resolution.

The method for dispersing the inorganic filler is not particularly limited and may be appropriately selected depending on the intended purpose. The inorganic filler can be dispersed with at least an organic solvent and an optionally used disperser by a conventional method using a ball mill, an attritor, a sand mill or an ultrasonic device.

When the inorganic filler is dispersed in a favorable state, the movement of electrical charges is not prevented, so that they can reach straight the photoconductor surface. When the inorganic filler is aggregated, electrical charges, which have been injected from a charge transport layer into a protective layer, tend to be prevented by the inorganic filler from the movement to the surface. As a result, dots each formed of toner are scattered, so that the resolution may greatly degrade. Also, when the crosslinked charge transport layer (protective layer) is provided where the inorganic filler is aggregated, writing light is scattered by the aggregated inorganic filler, so that the light transmittance decreases to give considerable adverse effects to the resolution. The dispersibility of the inorganic filler relates closely to light transmittance.

The inorganic filler may be surface-treated with a surface treating agent.

The inorganic filler surface-treated may be improved in its dispersibility. Incorporation of the surface-treated inorganic filler improves the abrasion resistance but may increase the residual potential.

This is due to that the filler surface contains trap sites of charges. In particular, the residual potential tends to be increased when a hydrophilic, high-resistant metal oxide is incorporated.

<<<Acidic Disperser>>>

The acidic disperser refers to a disperser containing an organic compound having an acid value. The acidic disperser may be a disperser formed of 100% nonvolatile components or may be a disperser previously dissolved in an organic solvent. Use of the acidic disperser can increase dispersibility of the inorganic filler, making it possible to obtain an electrophotographic photoconductor remarkably excellent in mechanical durability and electrical characteristics. Use of the acidic disperser can suppress an increase in residual potential caused by the addition of the inorganic filler and the obtained electrophotographic photoconductor becomes excellent in electrical characteristics.

The acidic disperser is not particularly limited and may be appropriately selected depending on the intended purpose. Examples thereof include: saturated or unsaturated fatty acids such as lauric acid, stearic acid, arachidic acid, behenic acid, adipic acid, oleic acid, maleic acid, maleic anhydride, salicylic acid, phthalic acid, isophthalic acid, terephthalic acid and pyromellitic acid; and carboxylic acids such as aromatic carboxylic acids, with polycarboxylic acids being preferred. These may be used alone or in combination. These acidic dispersers can have an effect of reducing the residual potential, but are insufficient in dispersion stability, so that image blur may be easier to occur.

The acidic disperser is not particularly limited and may be appropriately selected depending on the intended purpose, but is preferably a polycarboxylic acid for the following reasons. Specifically, a polycarboxylic acid has high wettability to the inorganic filler since it has a surfactant-like structure having both a hydrophilic group and a hydrophobic group in one molecule (where the hydrophilic group adsorbs onto a polar group (i.e., trap sites of charges on the surface of the inorganic filler) and the hydrophobic group adsorbs onto the binder resin or other components to maintain affinity). In addition, the polycarboxylic acid adsorbed onto the inorganic filler prevents contact between the inorganic fillers through electrical repulsion or steric hindrance, to thereby stabilize the dispersion of the inorganic filler. From the viewpoints of suppressing an increase in residual potential as well as improving the dispersion of the inorganic filler, more preferred are saturated polyesters, unsaturated polyesters or carboxylic acid-terminated unsaturated polyesters; or polymers, oligomers or copolymers each having a saturated or unsaturated hydrocarbon as a basic skeleton and at least on carboxylic acid bonded thereto, including acrylic acid, methacrylic acid, acrylic acid esters, methacrylic acid esters, styrene-acrylic acid copolymers, styrene-acrylic acid-acrylic acid ester copolymers, styrene-methacrylic acid copolymers, styrene-methacrylic acid-acrylic acid ester copolymers, styrene-maleic acid copolymers and styrene-maleic anhydride. These may be used alone or in combination.

The acid value of the acidic disperser refers to an amount of KOH in milligram necessary for neutralizing a carboxyl group contained in 1 g of a sample.

The acid value of the acidic disperser is not particularly limited and may be appropriately selected depending on the intended purpose, but is preferably 10 mgKOH/g or more but less than 400 mgKOH/g, more preferably 150 mgKOH/g or more but less than 400 mgKOH/g from the viewpoint of reducing the residual potential. When the acid value is less than 10 mgKOH/g, the amount of the acid value added has to be increased and also the effect of reducing the residual potential may be insufficient. When it is more than 400 mgKOH/g, the resistance becomes excessively decreased to potentially cause image blur to a larger extent.

The amount of the acidic disperser is not particularly limited and may be appropriately selected depending on the intended purpose, but preferably satisfies the following expression (I):

$$6 \leq (\text{amount of acidic disperser} \times \text{acid value}/\text{amount of inorganic filler}) \leq 40 \quad \text{(I)}$$

When the amount of the acidic disperser falls below the numerical range define in the above expression (I), there may be a case where the effect of reducing the residual potential or a case where the dispersion stability is degraded. When the amount of the acidic disperser exceeds the numerical range define in the above expression (I), image blur may occur.

The acidic disperser is not particularly limited and may be an appropriately synthesized one or may be a commercially available one. Examples of the commercially available one include those described in, for example, JP-A No. 2004-233756. Among them, BYK-P104 (product of BYK-Chemie GmbH) is a particularly sutable material for obtaining the effects of the present invention.

The usage form of the acidic disperser is not particularly limited and may be appropriately selected depending on the intended purpose. The acidic disperser is preferably used in combination with the inorganic filler and the organic solvent in a coating liquid for forming the uppermost surface layer, since the aggregation or sedimentation of the inorganic filler is prevented to remarkably improve the dispersibility of the inorganic filler.

<<<Acid Catalyst>>>

Use of the acid catalyst allows the curing reaction of the three-dimensionally crosslinked polymer to proceed sufficiently to attain a high density, making it possible to form an electrophotographic photoconductor excellent in mechanical durability and stability to gas.

The acid catalyst is not particularly limited and may be appropriately selected depending on the intended purpose. Examples thereof include: organic sulfonic acids such as paratoluene sulfonic acid, naphthalene sulfonic acid and dodecylbenzenesulfonic acid; organic sulfonic acid derivatives; organic sulfonic acid salts; and thermally latent compounds (compounds that develop acidity at a certain temperature or higher).

Among them, organic sulfonic acids and organic sulfonic acid derivatives are preferred.

The acid catalyst is not particularly limited and may be an appropriately synthesized one or may be a commercially available one. Examples of the commercially available one include: thermally latent proton acid catalysts blocked by an amine such as NACURE2500, NACURE5225, NACURE5543 and NACURE5925 (these products are of King Industries Inc.); SI-60 (product of SANSHIN CHEMICAL INDUSTRY CO., LTD.); and ADEKA OPTOMER C-66 and ADEKA OPTOMER C-77 (these products are of ADEKA CORPORATION).

The amount of the acid catalyst is not particularly limited and may be appropriately selected depending on the intended purpose, but is preferably 0.02% by mass to 5% by mass relative to the solid content concentration of the coating liquid.

The amount of the acid catalyst containing an acid alone such as paratoluene sulfonic acid is preferably 0.02% by mass to 0.2% by mass relative to the solid content concentration of the coating liquid.

When the above amount is more than 0.2% by mass, the acidity of the coating liquid is increased to potentially cause corrosion of the coating apparatus.

The amount of the thermally latent compound is not particularly limited and may be appropriately selected depending on the intended purpose. Since the thermally latent compound contains a less amount of an acid than in the acid alone when they are the same amount, the amount thereof is preferably 0.2% by mass to 2% by mass relative to the solid content concentration of the coating liquid. The coating liquid containing the thermally latent compound does not cause corrosion and thus the amount of the thermally latent compound can be increased. When the amount thereof is more than 2% by mass, the amine compound serving as the blocking agent may remain to adversely affect the properties of the photoconductor such as residual potential.

The usage form of the acid catalyst is not particularly limited and may be appropriately selected depending on the intended purpose. The acid catalyst that has not yet been dispsered may be used together with the compound containing a charge transporting compound and three or more [(tetrahydro-2H-pyran-2-yl)oxy]methyl groups bound to one or more aromatic rings thereof. In this case, there may be a case where the dispersibility of the inorganic filler slightly decreases. Therefore, in a preferable manner, the acid catalyst is dissolved or dispersed in an organic solvent and the resultant solution or dispersion liquid is used together with the compound containing a charge transporting compound and three or more [(tetrahydro-2H-pyran-2-yl)oxy]methyl groups bound to one or more aromatic rings thereof.

<<<Other Ingredients>>>

The other ingredients are not particularly limited and may be appropriately selected depending on the intended purpose. Examples thereof include a solvent, a leveling agent, an organic filler, a surface treating agent and an antioxidant.

—Solvent—

The solvent is not particularly limited and may be appropriately selected depending on the intended purpose. Examples thereof include alcohols such as methanol, ethanol, propanol and butanol; ketons such as acetone, methyl ethyl ketone, methyl isobutyl ketone and cyclohexanone; esters such as ethyl acetate and butyl acetate; ethers such as tetrahydrofuran, methyltetrahydrofuran, dioxane, propylether, diethylene glycol dimethyl ether and propylene glycol-1-monomethyl ether-2-acetate; halogen-containing compounds such as dichloromethane, dichloroethane, trichloroethane and chlorobenzene; aromatic compounds such as benzene, toluene and xylene; and cellosolves such as methyl cellosolve, ethyl cellosolve and cellosolve acetate. These may be used alone or in combination.

The dilution rate by the solvent may be appropriately determined depending on the dissolvability of the composition, the intended thickness and/or the employed coating method which is, for example, a dip coating method, a spray coating method, a bead coating method or a ring coating method.

—Leveling Agent—

The leveling agent is not particularly limited and may be appropriately selected depending on the intended purpose. Examples thereof include silicone oils such as dimethylsilicone oil and methylphenylsilicone oil; and polymers and oligomers each having a perfluoroalkyl group in the side chain thereof.

The amount of the leveling agent is not particularly limited and may be appropriately selected depending on the intended purpose, but is preferably 1% by mass or less relative to the total solid content of the coating liquid.

—Organic Filler—

The organic filler is not particularly limited and may be appropriately selected depending on the intended purpose. Examples thereof include fluorine resin powder such as polytetrafluoroethylene, silicone resin powder and α-carbon powder.

—Surface Treating Agent—

The surface treating agent is not particularly limited and may be appropriately selected depending on the intended purpose, but preferably used is a surface treating agent able to maintain the insulating property of the filler. From the viewpoints of improving filler dispersibility and preventing image blur, such surface treating agent is more preferably a titanate coupling agent, an aluminum coupling agent, a zircoaluminate coupling agent, a higher fatty acid, mixtures containing these agents or acids and a silane coupling agent; $Al_2O_3$, $TiO_2$, $ZrO_2$, silicone, aluminum stearate and mixtures thereof. A treatment with a silane coupling agent alone causes a considerable degree of image blur, while a treatment with the mixture containing the above surface treating agent and a silane coupling agent may suppress such disadvantageous effect caused by the silane coupling agent.

Although the amount of the surface treating agent varies with the average primary particle diameter of the filler, it is not particularly limited and may be appropriately selected depending on the intended purpose. The amount thereof is preferably 3% by mass to 30% by mass, more preferably 5% by mass to 20% by mass. When the surface treating agent is less than 3% by mass, it cannot exhibit an effect of dispersing the filler. Whereas when the surface treating agent is more than 30% by mass, it causes a considerable increase in residual potential.

—Antioxidant—

The antioxidant may be incorporated for preventing reduction of sensitivity and increase in residual potential of the electrophotographic photoconductor during repetitive use.

The antioxidant may be incorporated into the layers such as the crosslinked charge transport layer, the charge transport layer, the charge generation layer and/or the other layers.

The antioxidant is not particularly limited and may be appropriately selected depending on the intended purpose. Examples thereof include phenol compounds, paraphenylenediamines, hydroquinones, organic sulfur-containing compounds and organic phosphorus-containing compounds. These may be used alone or in combination.

The phenol compounds are not particularly limited and may be appropriately selected depending on the intended purpose. Examples thereof include 2,6-di-t-butyl-p-cresol, butylated hydroxyanisole, 2,6-di-t-butyl-4-ethylphenol, stearyl-β-(3,5-di-t-butyl-4-hydroxyphenyl)propionate, 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl)butylic acid]glycol ester and tocopherols.

The paraphenylenediamines are not particularly limited and may be appropriately selected depending on the intended purpose. Examples thereof include N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine and N,N'-dimethyl-N,N'-di-t-butyl-p-phenylenediamine.

The hydroquinones are not particularly limited and may be appropriately selected depending on the intended purpose. Examples thereof include 2,5-di-t-octylhydroquinone, 2,6-didodecylhydroquinone, 2-dodecylhydroquinone, 2-dodecyl-5-chlorohydroquinone, 2-t-octyl-5-methylhydroquinone and 2-(2-octadecenyl)-5-methylhydroquinone.

The organic sulfur-containing compounds are not particularly limited and may be appropriately selected depending on the intended purpose. Examples thereof include dilauryl-3,3'-thiodipropionate, distearyl-3,3'-thiodipropionate and ditetradecyl-3,3'-thiodipropionate.

The organic phosphorus-containing compounds are not particularly limited and may be appropriately selected depending on the intended purpose. Examples thereof include triphenyl phosphine, tri(nonylphenyl)phosphine, tri(dinonylphenyl)phosphine, tricresylphosphine and tri(2,4-dibutylphenoxy)phosphine.

The above antioxidant is not particularly limited and may be an appropriately synthesized one or a commercially available product known as an antioxidant for rubber, plastic and fats and oils.

The amount of the antioxidant incorporated is not particularly limited and may be appropriately selected depending on the intended purpose. It is preferably 0.01% by mass to 10% by mass, more preferably 1% by mass or less, relative to the total mass of the layer formed from the above coating liquid (uppermost surface layer).

<<<Forming Method for Uppermost Surface Layer (Crosslinked Charge Transport Layer)>>>

The forming method for the uppermost surface layer (crosslinked charge transport layer) is not particularly limited and may be appropriately selected depending on the intended purpose. For example, a coating liquid containing: at least the compound containing a charge transporting compound and three or more [(tetrahydro-2H-pyran-2-yl)oxy]methyl groups bound to one or more aromatic rings thereof (the material for the three-dimensionally crosslinked polymer); the acid catalyst; the inorganic filler; the acidic disperser; and the optionally used other ingredients is prepared and optionally diluted with the organic solvent. Then, the obtained coating liquid is coated on the electrophotographic photoconductor surface (on the charge transport layer) and heated and dried to perform curing.

The coating method is not particularly limited and may be appropriately selected depending on the intended purpose. Examples thereof include a dip coating method, a spray coating method, a bead coating method and a ring coating method.

The heating temperature is not particularly limited and may be appropriately selected depending on the formulation of the coating liquid since the reaction rate varies with the type or amount of the acid catalyst used. It is preferably 80° C. to 180° C., more preferably 100° C. to 160° C. When the heating temperature is higher than 180° C., the reaction rate becomes high and as a result an extreme increase in crosslink density leads to a decrease in charge transporting property whereby the formed photoconductor is increased in exposed-area potential and decreased in sensitivity. In addition, the materials of the other layers of the electrophotographic photoconductor are increasingly affected due to the heating, potentially degrading properties of the formed electrophotographic photoconductor due to the adversely affected other layers. When the heating temperature is lower than 80° C., the reaction rate is low and as a result a sufficient crosslink density cannot be achieved even when performing the reaction for a long period of time.

The three-dimensionally crosslinked polymer which is formed by polymerizing, using the acid catalyst, the compound containing a charge transporting compound and three or more [(tetrahydro-2H-pyran-2-yl)oxy]methyl groups bound to one or more aromatic rings thereof (the material for the three-dimensionally crosslinked polymer) and which contains the inorganic filler and the acidic disperser is a film superior in charge transporting property to other crosslinked films. Applicability of this three-dimensionally crosslinked polymer to a charge transport layer is high, but the obtained charge transport layer is poorer in charge transporting property than the conventional molecule-dispersed charge transport layer. Thus, it is preferably used in the form of a relatively thin film. The three-dimensionally crosslinked polymer used in this form provides a photoconductor having most excellent properties.

The thickness of the uppermost surface layer (crosslinked charge transport layer) is not particularly limited and may be appropriately selected depending on the intended purpose, but is preferably 1 μm to 10 μm, more preferably 3 μm to 8 μm. When the thickness thereof is smaller than 1 μm, the formed photoconductor cannot have a sufficiently long service life. When it is larger than 10 μm, the formed photoconductor tends to decrease in sensitivity and increase in exposed-area potential, making it hard to stably form images.

<<Charge Generation Layer>>

The charge generation layer contains a charge generating compound; preferably contains a binder resin; and, if necessary, further contains other ingredients such as the above-listed antioxidants.

The charge generating compound is not particularly limited and may be appropriately selected depending on the intended purpose.

Examples thereof include inorganic materials and organic materials.

—Inorganic Material—

The inorganic material is not particularly limited and may be appropriately selected depending on the intended purpose. Examples thereof include crystalline selenium, amorphous selenium, selenium-tellurium, selenium-tellurium-halogen, selenium-arsenic compounds and amorphous silicone. As the amorphous silicone, preferably used is amorphous silicone in which the dangling bonds are terminated with hydrogen atoms or halogen atoms or amorphous silicone which is doped with a boron atom or a phosphorus atom.

—Organic Material—

The organic material is not particularly limited and may be appropriately selected depending on the intended purpose. Examples thereof include phthalocyanine pigments such as metal phthalocyanines and metal-free phthalocyanines; azulenium salt pigments, methine squarate pigments, azo pigments having a carbazole skeleton, azo pigments having a triphenylamine skeleton, azo pigments having a diphenylamine skeleton, azo pigments having a dibenzothiophene skeleton, azo pigments having a fluorenone skeleton, azo pigments having an oxadiazole skeleton, azo pigments having a bis-stilbene skeleton, azo pigments having a distilyloxadiazole skeleton, azo pigments having a distilylcarbazole skeleton, perylene pigments, anthraquinone or multicyclic quinone pigments, quinoneimine pigments, diphenylmethane and triphenylmethane pigments, benzoquinone and naphthoquinone pigments, cyanine and azomethine pigments, indigoido pigments and bis-benzimidazole pigments. These may be used alone or in combination.

—Binder Resin—

The binder resin is not particularly limited and may be appropriately selected depending on the intended purpose. Examples thereof include polyamide resins, polyurethane resins, epoxy resins, polyketone resins, polycarbonate resins, silicone resins, acrylic resins, polyvinylbutylal resins, polyvinylformal resins, polyvinyl ketone resins, polystyrene resins, poly-N-vinylcarbazol resins and polyacrylamide resins. These may be used alone or in combination.

In addition to the above-listed binder resins, further examples of the binder resin include charge transportable polymers having a charge transporting function, such as (1) polymer materials including polycarbonate resins, polyester resins, polyurethane resins, polyether resins, polysiloxane resins and acrylic resins which each have an arylamine skeleton, a benzidine skeleton, a hydrazone skeleton, a carbazol skeleton, a stilbene skeleton and/or a pyrrazoline skeleton; and (2) polymer materials each having a polysilane skeleton.

Specific examples of the polymer materials described in (1) above include charge transportable polymer materials described in, for example, JP-A Nos. 01-001728, 01-009964, 01-013061, 01-019049, 01-241559, 04-011627, 04-175337, 04-183719, 04-225014, 04-230767, 04-320420, 05-232727, 05-310904, 06-234836, 06-234837, 06-234838, 06-234839, 06-234840, 06-234841, 06-239049, 06-236050, 06-236051, 06-295077, 07-056374, 08-176293, 08-208820, 08-211640, 08-253568, 08-269183, 09-062019, 09-043883, 09-71642, 09-87376, 09-104746, 09-110974, 09-110976, 09-157378, 09-221544, 09-227669, 09-235367, 09-241369, 09-268226, 09-272735, 09-302084, 09-302085 and 09-328539.

Specific examples of the polymer materials described in (2) above include polysilylene polymers described in, for example, JP-A Nos. 63-285552, 05-19497, 05-70595 and 10-73944.

—Other Ingredients—

The other ingredients are not particularly limited and may be appropriately selected depending on the intended purpose. Examples thereof include low-molecular-weight charge transporting compounds, solvents, leveling agents and the above-listed antioxidants.

—Low-Molecular-Weight Charge Transporting Compound—

The low-molecular-weight charge transporting compound is not particularly limited and may be appropriately selected depending on the intended purpose. Examples thereof include electron transporting compounds and hole transporting compounds.

The electron transporting compound is not particularly limited and may be appropriately selected depending on the intended purpose. Examples thereof include chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophen-4-one, 1,3,7-trinitrodibenzothiophene-5,5-dioxide and diphenoquinone derivatives. These may be used alone or in combination.

The hole transporting compound is not particularly limited and may be appropriately selected depending on the intended purpose. Examples thereof include oxazole derivatives, oxadiazole derivatives, imidazole derivatives, monoarylamine derivatives, diarylamine derivatives, triarylamine derivatives, stilbene derivatives, α-phenylstilbene derivatives, benzidine derivatives, diarylmethane derivatives, triarylmethane derivatives, 9-styrylanthracene derivatives, pyrazoline derivatives, divinylbenzene derivatives, hydrazone derivatives, indene derivatives, butadiene derivatives, pyrene derivatives, bis-stilbene derivatives and enamine derivatives. These may be used alone or in combination.

—Solvent—

The solvent is not particularly limited and may be appropriately selected depending on the intended purpose. Examples thereof include tetrahydrofuran, dioxane, dioxolan, toluene, dichloromethane, monochlorobenzene, dichloroethane, cyclohexanone, cyclopentanone, anisole, xylene, methyl ethyl ketone, acetone, ethyl acetate and butyl acetate. These may be used alone or in combination.

—Leveling Agent—

The leveling agent is not particularly limited and may be appropriately selected depending on the intended purpose. Examples thereof include silicone oil such as dimethyl silicone oil and methylphenyl silicone oil. These may be used alone or in combination.

—Forming Method for the Charge Generation Layer—

The forming method for the charge generation layer is not particularly limited and may be appropriately selected depending on the intended purpose. Examples thereof include a method where a coating liquid, which has been prepared by dissolving or dispersing the above charge generating compound and the above binder resin in the above other ingredients such as the above solvent, is coated on the above electrically conductive substrate, followed by drying. The coating liquid can be coated with the above-described casting method.

The thickness of the charge generation layer is not particularly limited and may be appropriately selected depending on the intended purpose, but is preferably 0.01 μm to 5 μm, more preferably 0.05 μm to 2 μm.

<<Charge Transport Layer>>

The charge transport layer is a layer provided for the purposes of retaining charges and transferring charges generated from the charge generation layer through exposure to combine them together. In order to satisfactorily retain charges, the charge transport layer is required to have high electrical resistance. Meanwhile, in order to obtain high surface potential due to the retained charges, the charge transport layer is required to have low dielectric constant and good charge transferability.

The charge transport layer contains a charge transporting compound; preferably contains a binder resin; and, if necessary, further contains other ingredients.

—Charge Transporting Compound—

The charge transporting compound is not particularly limited and may be appropriately selected depending on the intended purpose. Examples thereof include electron transporting compounds, hole transporting compounds and charge transporting polymers.

—Electron Transporting Compound—

The electron transporting compound (electron accepting compound) is not particularly limited and may be appropriately selected depending on the intended purpose. Examples thereof include chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophen-4-one and 1,3,7-trinitrodibenzothiophene-5,5-dioxide. These may be used alone or in combination.

—Hole Transporting Compound—

The hole transporting compound (electron donating compound) is not particularly limited and may be appropriately selected depending on the intended purpose. Examples thereof include oxazole derivatives, oxadiazole derivatives, imidazole derivatives, triphenylamine derivatives, 9-(p-diethyleaminostyrylanthracene), 1,1-bis-(4-dibenzylaminophenyl)propane, styrylanthracene, styrylpyrazoline, phenylhydrazons, α-phenylstilbene derivatives, thiazole derivatives, triazole derivatives, phenazine derivatives, acridine derivatives, benzofuran derivatives, benzimidazole derivatives and thiophene derivatives. These may be used alone or in combination.

—Charge Transporting Polymer—

The charge transporting polymer is not particularly limited and may be appropriately selected depending on the intended purpose. Examples thereof include: polymers having a carbazole ring; polymers having a hydrazon structure; polysilylene polymers; polymers having a triarylamine structure; polymers having an electron donating group; and other polymers.

The polymers having a carbazole ring are not particularly limited and may be appropriately selected depending on the intended purpose. Examples thereof include poly-N-vinylcarbazole and the compounds described in, for example, JP-A Nos. 50-82056, 54-9632, 54-11737, 04-175337, 04-183719 and 06-234841.

The polymers having a hydrazon structure are not particularly limited and may be appropriately selected depending on the intended purpose. Examples thereof include compounds described in, for example, JP-A Nos. 57-78402, 61-20953, 61-296358, 01-134456, 01-179164, 03-180851, 03-180852, 03-50555, 05-310904 and 06-234840.

The polysilylene polymers are not particularly limited and may be appropriately selected depending on the intended purpose. Examples thereof include the compounds described in, for example, JP-A Nos. 63-285552, 01-88461, 04-264130, 04-264131, 04-264132, 04-264133 and 04-289867.

The polymers having a triarylamine structure are not particularly limited and may be appropriately selected depending on the intended purpose. Examples thereof include N,N-bis(4-methylphenyl)-4-aminopolystyrene and the compounds described in, for example, JP-A Nos. 01-134457, 02-282264, 02-304456, 04-133065, 04-133066, 05-40350 and 05-202135.

The polymers having an electron donating group are not particularly limited and may be appropriately selected depending on the intended purpose. Examples thereof include copolymers, block polymers, graft polymers and star polymers, each being formed of known monomers, as well as crosslinked polymers having an electron donating group as described in JP-A No. 03-109406.

The other polymers are not particularly limited and may be appropriately selected depending on the intended purpose. Examples thereof include nitropyrene-formaldehyde polycondensates and the compounds described in, for example, JP-A Nos. 51-73888, 56-150749, 06-234836 and 06-234837.

In addition to the above-listed compounds, further examples of the charge transporting polymer include polycarbonate resins having a triarylamine structure, polyurethane resins having a triarylamine structure, polyester resins having a triarylamine structure, and polyether resins having a triarylamine structure. Further examples of the charge transporting polymers include the compounds described in, for example, JP-A Nos. 64-1728, 64-13061, 64-19049, 04-11627, 04-225014, 04-230767, 04-320420, 05-232727, 07-56374, 09-127713, 09-222740, 09-265197, 09-211877 and 09-304956.

—Binder Resin—

The binder resin is not particularly limited and may be appropriately selected depending on the intended purpose. Examples thereof include polycarbonate resins, polyester resins, methacryl resins, acryl resins, polyethylene resins, polyvinyl chloride resins, polyvinyl acetate resins, polystyrene resins, phenol resins, epoxy resins, polyurethane resins, polyvinylidene chloride resins, alkyd resins, silicone resins, polyvinylcarbazole resins, polyvinylbutyral resins, polyvinylformal resins, polyacrylate resins, polyacrylamide resins and phenoxy resins. These may be used alone or in combination.

Notably, the charge transport layer may contain a copolymer of a crosslinkable binder resin and a crosslinkable charge transporting compound.

—Other Ingredients—

The other ingredients are not particularly limited and may be appropriately selected depending on the intended purpose. Examples thereof include solvents, plasticizers, leveling agents and the above-listed antioxidants.

—Solvent—

The solvent is not particularly limited and may be appropriately selected depending on the intended purpose. It may be the same as used for the coating of the charge generation layer. Suitably used are solvents that dissolve the charge transporting compound and the binder resin in sufficient amounts. These may be used alone or in combination.

—Plasticizer—

The plasticizer is not particularly limited and may be appropriately selected depending on the intended purpose. Examples thereof include plasticizers for common resins, such as dibutylphthalate and dioctyphthalate.

The amount of the plasticizer used is not particularly limited and may be appropriately selected depending on the intended purpose, but is preferably 0 parts by mass to 30 parts by mass per 100 parts by mass of the binder resin.

—Leveling Agent—

The leveling agent is not particularly limited and may be appropriately selected depending on the intended purpose. Examples thereof include silicone oils such as dimethylsilicone oil and methylphenylsilicone oil; and polymers and oligomers each having a perfluoroalkyl group in the side chain thereof.

The amount of the leveling agent used is not particularly limited and may be appropriately selected depending on the intended purpose, but is preferably 0 parts by mass to 1 part by mass per 100 parts by mass of the binder resin.

—Forming Method for the Charge Transport Layer—

The forming method for charge transport layer is not particularly limited and may be appropriately selected depending on the intended purpose. Examples thereof include a method where a coating liquid, which has been prepared by dissolving or dispersing the above charge transporting compound and the above binder resin in the above other ingredients such as the above solvent, is coated on the above charge generation layer, followed by drying. The coating liquid can be coated with the above-described casting method.

The thickness of the charge transport layer is not particularly limited and may be appropriately selected depending on the intended purpose, but is preferably 5 μm to 40 μm, more preferably 10 μm to 30 μm.

<<Other Layers>>

The other layers are not particularly limited and may be appropriately selected depending on the intended purpose. Examples thereof include an under layer and an intermediate layer.

—Under Layer—

The under layer may be provided between the electrically conductive substrate and the photoconductive layer.

The under layer contains a resin and, if necessary, further contains other ingredients such as the above-listed antioxidants, fine pigment particles and a coupling agent.

The resin contained in the under layer not particularly limited and may be appropriately selected depending on the intended purpose. Examples thereof include water-soluble resins (e.g., polyvinyl alcohol, casein and sodium polyacrylate); alcohol-soluble resins (e.g, nylon copolymers and methoxymethylated nylon); and curable resins forming a three-dimensional network structure (e.g., polyurethane, melamine resins, phenol resins, alkyd-melamine resins and epoxy resins).

Among them, preferably, the resin is highly resistant to a commonly used organic solvent, in consideration of subsequent formation of the photoconductive layer on the resin using the solvent.

The fine pigment particles contained in the under layer are not particularly limited and may be appropriately selected depending on the intended purpose, so long as they can prevent moire generation and reducing residual potential. Examples thereof include metal oxides such as titanium oxide, silica, alumina, zirconia, tin oxide and indium oxide.

The coupling agent contained in the under layer is not particularly limited and may be appropriately selected depending on the intended purpose. Examples thereof include a silane coupling agent, a titanium coupling agent and a chromium coupling agent.

The under layer is not particularly limited and may be appropriately selected depending on the intended purpose. The under layer may be a single layer or in the form of a laminated layer of two or more different layers made of the different materials listed above.

The forming method for the under layer is not particularly limited and may be appropriately selected depending on the intended purpose.

Examples thereof include a method using the appropriate solvent and the coating method used for the above-described formation of the photoconductive layer; a method of subjecting $Al_2O_3$ to anodic oxidation; and a method of treating an organic material (e.g., polyparaxylene (parylene)) or an inorganic material (e.g., $SiO_2$, $SnO_2$, $TiO_2$, ITO or $CeO_2$) by a vacuum thin film forming method.

The thickness of the under layer is not particularly limited and may be appropriately selected depending on the intended purpose, but is preferably 1 μm to 5 μm.

—Intermediate Layer—

The intermediate layer may be provided between the charge transport layer and the crosslinked charge transport layer, for the purpose of preventing charge transport layer's components from being included in the crosslinked charge transport layer or improving adhesiveness between the layers.

The intermediate layer is suitably made of a material insoluble or poorly-soluble to the crosslinked charge transport layer-coating liquid. It contains a binder resin and, if necessary, further contains the other ingredients such as the above-listed antioxidants.

The binder resin contained in the intermediate layer is not particularly limited and may be appropriately selected depending on the intended purpose. Examples thereof include polyamide, alcohol-soluble nylon, water-soluble polyvinyl butyral, polyvinyl butyral and polyvinyl alcohol.

The forming method for the intermediate layer is not particularly limited and may be appropriately selected depending on the intended purpose. Examples thereof include a method using the appropriate solvent and the coating method used for the above-described formation of the photoconductive layer The thickness of the intermediate layer is not particularly limited and may be appropriately selected depending on the intended purpose, but is preferably 0.05 μm to 2 μm.

Next will be described embodiments of the electrophotographic photoconductor of the present invention.

First Embodiment

The layer structure of an electrophotographic photoconductor according to a first embodiment will be described with reference to FIG. 1.

FIG. 1 is a cross-sectional view of one exemplary layer structure of the most basic multi-layer photoconductor, where a charge generation layer 2 and a charge transport layer 3 are laminated on an electrically conductive substrate 1 in this order. When the photoconductor is negatively charged in use, the charge transport layer contains a hole transportable charge transporting compound. When the photoconductor is positively charged in use, the charge transport layer contains an electron transportable charge transporting compound. In this case, the uppermost surface layer is the charge transport layer 3.

Second Embodiment

The layer structure of an electrophotographic photoconductor according to a second embodiment will be described with reference to FIG. 2.

Figure 2:
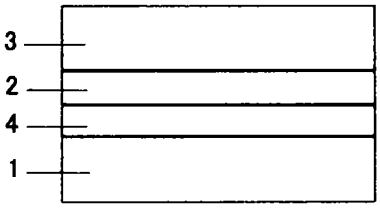
FIG. 2 is a schematic view of a layer structure of an electrophotographic photoconductor according to a second embodiment of the present invention.

FIG. 2 is a cross-sectional view of the layer structure of the most practical photoconductor, which is the same as the most basic multi-layer photoconductor (first embodiment) except that an under layer 4 is additionally formed. Also in this case, the uppermost surface layer is the charge transport layer 3.

Third Embodiment

The layer structure of an electrophotographic photoconductor according to a third embodiment will be described with reference to FIG. 3.

Figure 3:
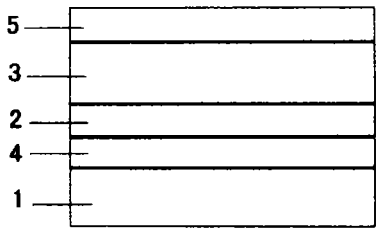
FIG. 3 is a schematic view of a layer structure of an electrophotographic photoconductor according to a third embodiment of the present invention.

FIG. 3 is a cross-sectional view of the layer structure of an electrophotographic photoconductor which is the same as the most practical photoconductor according to a second embodiment except that a crosslinked charge transport layer 5 is further provided on the uppermost surface as a protective layer. In this case, the uppermost surface layer is the crosslinked charge transport layer 5.

Here, the under layer 4 is not essential but plays an important role in prevention of leakage of charges, and thus is used generally. In the photoconductor according to a third embodiment, two separate layers: the charge transport layer 3 and the crosslinked charge transport layer 5 are responsible for charge transfer from the charge generation layer to the photoconductor surface, making it possible for different layers to have main different functions. For example, combinational use of a charge transport layer excellent in charge transporting property and a crosslinked charge transport layer excellent in mechanical durability can provide an electrophotographic photoconductor excellent in both charge transporting property and mechanical durability.

Fourth Embodiment

The layer structure of an electrophotographic photoconductor according to a fourth embodiment will be described with reference to FIG. 4.

Figure 4:
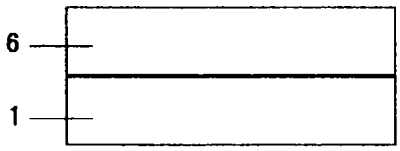
FIG. 4 is a schematic view of a layer structure of an electrophotographic photoconductor according to a fourth embodiment of the present invention.

FIG. 4 is a cross-sectional view of the layer structure of an electrophotographic photoconductor where an electrically conductive substrate 1 is provided thereon with a photoconductive layer 6 mainly containing a charge generating compound and a charge transporting compound. In this case, the uppermost surface layer is the photoconductive layer 6.

In this case, it is necessary to incorporate the charge generating compound into the uppermost surface layer, which is produced as follows. Specifically, an uppermost surface layer-coating liquid containing the charge generating compound mixed and dispersed therein is prepared and coated, followed by heating and drying for performing polymerization reaction, to thereby form the uppermost surface layer.

Fifth Embodiment

The layer structure of an electrophotographic photoconductor according to a fifth embodiment will be described with reference to FIG. 5.

Figure 5:
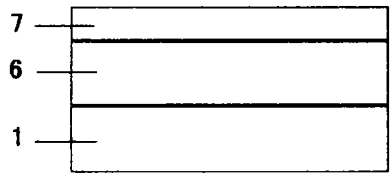
FIG. 5 is a schematic view of a layer structure of an electrophotographic photoconductor according to a fifth embodiment of the present invention.

FIG. 5 is a cross-sectional view of the layer structure of an electrophotographic photoconductor where a protective layer 7 is formed on a single-layer photoconductive layer 6. In this case, the uppermost surface layer is the protective layer 7.

(Image Forming Method and Image Forming Apparatus)

An image forming method used in the present invention includes at least a charging step, an exposing step, a developing step and a transfer step; and, if necessary, further includes other steps. An electrophotographic photoconductor used in the image forming method is the above-described electrophotographic photoconductor of the present invention. Notably, the charging step and the exposing step may collectively be referred to as a latent electrostatic image forming step.

An image forming apparatus of the present invention includes at least an electrophotographic photoconductor, a charging unit, an exposing unit, a developing unit and a transfer unit; and, if necessary, further includes other units. An electrophotographic photoconductor used in the image forming apparatus is the above-described electrophotographic photoconductor of the present invention. Notably, the charging unit and the exposing unit may collectively be referred to as a latent electrostatic image forming unit.

<Charging Step and Charging Unit>

The charging step can be performed by the charging unit and is a step of charging a surface of the electrophotographic photoconductor.

The charging unit is not particularly limited and may be appropriately selected depending on the intended purpose. Examples thereof include contact-type charging devices known per se having, for example, an electrically conductive or semiconductive roller, brush, film and rubber blade; and non-contact-type charging devices utilizing colona discharge such as corotron and scorotron (including non-contact-type charging devices that charge the electrophotographic photoconductor surface proximately thereto with a gap of 100 μm or less therebetween).

<Exposing Step and Exposing Unit>

The exposing step can be performed by the exposing unit and is a step of exposing the charged surface of the electrophotographic photoconductor to light to thereby form a latent electrostatic image.

The exposing unit is not particularly limited and may be appropriately selected depending on the intended purpose, so long as it can expose the charged surface of the electrophotographic photoconductor to light correspondingly to an image to be formed. Examples thereof include various exposing devices such as a copy optical exposing device, a rod lens array exposing device, a laser optical exposing device, a liquid crystal shutter exposing device, and an LED optical exposing device. Examples of light sources of the exposing devices include those capable of securing high luminance, such as light-emitting diodes (LEDs), laser diodes (LDs) and electroluminescence (EL). In the present invention, light may be imagewise applied from the side facing the support of the electrophotographic photoconductor.

<Developing Step and Developing Unit>

The developing step can be performed by the developing unit and is a step of developing the latent electrostatic image with a toner to form a visible image.

The developing unit is not particularly limited and may be appropriately selected depending on the intended purpose, so long as it can perform development using the toner or developer. For example, the developing unit is preferably one containing at least a developing device which contains the developer therein and can apply the developer to the latent electrostatic image in a contact or non-contact manner. The developing device may employ a dry or wet developing process, and may be a single-color or multi-color developing device. For example, the developing device is preferably one having a rotatable magnetic roller and a stirrer for charging the developer with friction generated during stirring. In the developing device, toner particles and carrier particles are stirred and mixed so that the toner particles are charged by friction generated therebetween. The charged toner particles are retained in the chain-like form on the surface of the rotating magnetic roller to form magnetic brushes. The magnetic roller is disposed proximately to the electrophotographic photoconductor and thus, some of the toner particles forming the magnetic brushes on the magnet roller are transferred onto the surface of the electrophotographic photoconductor by the action of electrically attractive force. As a result, the latent electrostatic image is developed with the toner particles to form a visual image on the surface of the electrophotographic photoconductor.

<Transfer Step and Transfer Unit>

The transfer step can be performed by the transfer unit and is a step of transferring the visible image onto a recording medium.

The transfer unit is a unit configured to transfer the visible image onto a recording medium. The transfer of the visible image onto the recording medium is performed by a method where the visible image is directly transferred from the electrophotographic photoconductor surface to the recording medium or by a method where the visible image is primarily transferred to an intermediate transfer member and then secondarily transferred to the recording medium. Both of these methods can favorably used; however, when the transfer adversely affects high-quality image formation to a large extent, preferred is the former method where the number of transfer is smaller (direct transfer). The transfer can be performed with the transfer unit by, for example, charging the visible image on the electrophotographic photoconductor using a transfer charger.

<Fixing Step and Fixing Unit>

The fixing step can be performed by the fixing unit and a step of fixing the image transferred on the recording medium.

The fixing unit is not particularly limited and may be appropriately selected depending on the intended purpose, but is preferably a known heating-pressing device. Examples of the heating-pressing device include: a combination of a heating roller and a pressing roller; and a combination of a heating roller, a pressing roller and an endless belt. The heating temperature in the heating-pressing device is generally 80° C. to 200° C. The fixing may be performed every after a toner image of each color is transferred onto the recording medium; or the fixing may be performed at one time after toner images of all colors are superposed on top of one another on the recording medium.

<Other Steps and Other Units>

The other steps and the other units are not particularly limited and may be appropriately selected depending on the intended purpose. Examples thereof include: a charge-eliminating step and a charge-eliminating unit; a cleaning step and a cleaning unit; a recycling step and a recycling unit; and a controlling step and a controlling unit.

—Charge-Eliminating Step and Charge-Eliminating Unit—

The charge-eliminating step can be performed by the charge-eliminating unit and is a step of applying charge-eliminating bias to the electrophotographic photoconductor to charge-eliminate the electrophotographic photoconductor.

The charge-eliminating unit is not particularly limited and may be appropriately selected from known charge-eliminating devices, so long as it can apply charge-eliminating bias to the electrophotographic photoconductor. Examples of the charge-eliminating devices include charge-eliminating lamps.

—Cleaning Step and Cleaning Unit—

The cleaning step can be performed by the cleaning unit and is a step of removing the toner remaining on the electrophotographic photoconductor.

The cleaning unit is not particularly limited and may be appropriately selected from known cleaners, so long as it can remove the toner remaining on the electrophotographic photoconductor. Examples of the cleaners include magnetic blush cleaners, electrostatic brush cleaners, magnetic roller cleaners, blade cleaners, brush cleaners and web cleaners.

—Recycling Step and Recycling Unit—

The recycling step can be performed by the recycling unit and is a step of recycling the toner removed in the cleaning step to the developing unit.

The recycling unit is not particularly limited and is, for example, known conveyance units.

—Controlling Step and Controlling Unit—

The controlling step can be performed by the controlling unit and is a step of controlling each of the above steps.

The controlling unit is not particularly limited and may be appropriately selected depending on the purpose, so long as it can control the operation of each of the above units. Examples thereof include devices such as a sequencer and a computer.

Next will be described embodiments of the image forming apparatus of the present invention.

Figure 6:
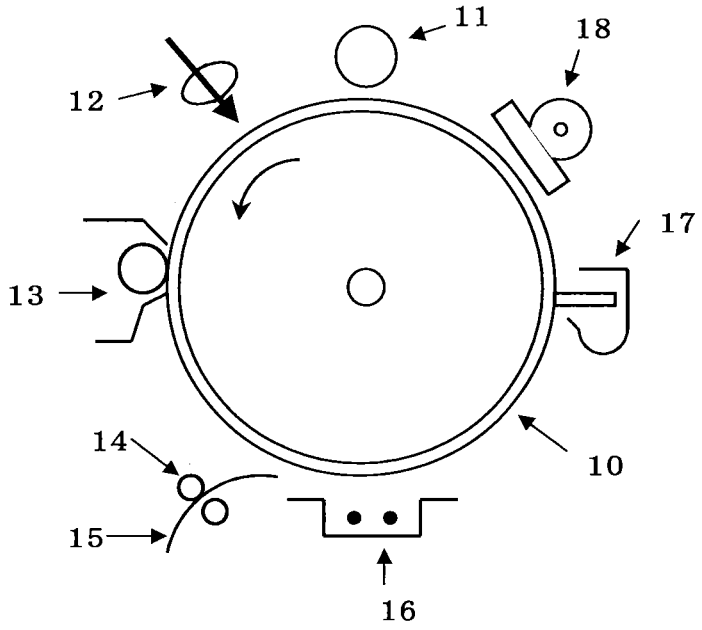
FIG. 6 is an explanatory, schematic view of an image forming apparatus and an electrophotographic process of the present invention.

FIG. 6 is an explanatory, schematic view of an electrophotographic process and image forming apparatus of the present invention. The present invention encompasses the following embodiment.

An electrophotographic photoconductor 10 is rotated in the arrow direction in FIG. 6. Around the electrophotographic photoconductor 10 are provided a charging unit 11, an exposing unit 12, a developing unit 13, a transfer unit 16, a cleaning unit 17 and a charge-eliminating unit 18. The cleaning unit 17 and/or the charge-eliminating unit 18 may be omitted.

As illustrated in FIG. 6, the basic operation of the image forming apparatus is as follows. First, the charging unit 11 charges almost uniformly the surface of the electrophotographic photoconductor 10. Subsequently, the exposing unit 12 writes an image correspondingly to input signals, to thereby form a latent electrostatic image. Next, the developing unit 13 develops the latent electrostatic image to form a toner image on the electrophotographic photoconductor surface. The formed toner image is transferred with the transfer unit 16 onto an image receiving paper sheet 15 (serving as a recording medium) which has been conveyed to a transfer position with conveyance rollers 14. This toner image is fixed on the image receiving paper sheet 15 with the fixing unit. Some toner particles remaining after transfer onto the image receiving paper sheet 15 are cleaned with the cleaning unit 17. Next, the charges remaining on the electrophotographic photoconductor 10 are eliminated with the charge-eliminating unit 18, and then the next cycle starts.

As illustrated in FIG. 6, the electrophotographic photoconductor 10 has a shape of drum. Alternatively, the electrophotographic photoconductor 10 may have a shape of sheet or endless belt. The charging unit 11 or the transfer unit 16 may use any of known chargers such as a corotron, a scorotron, a solid state charger, a charging unit having a roller shape, and a charging unit of a brush shape.

The light source used in, for example, the exposing unit 12 and the charge-eliminating unit 18 may be a commonly-used light-emitting device such as a fluorescent lamp, a tungsten lamp, a halogen lamp, a mercury lamp, a sodium lamp, a light-emitting diode (LED), a laser diode (LD) or an electroluminescence (EL) lamp. Among them, a laser diode (LD) or a light-emitting diode (LED) is used in many cases. Also, a filter may be used for applying light having desired wavelengths. The filter may be, for example, various filters such as a sharp-cut filter, a band-pass filter, an infrared cut filter, a dichroic filter, an interference filter and a color conversion filter.

The light source applies light to the electrophotographic photoconductor 10 in the transfer step, charge-eliminating step, cleaning step or pre-exposing step. Here, the exposure of the electrophotographic photoconductor 10 to light in the charge-eliminating step gives severe damage to the electrophotographic photoconductor 10, potentially causing a decrease in chargeability and an increase in residual potential. Thus, instead of the light exposure, the charge elimination may be performed through application of opposite bias in the charging step and the cleaning step. This may be advantageous in terms of high durability of the electrophotographic photoconductor.

When the electophotographic photoconductor 10 is positively (negatively) charged and then imagewise exposed to light, a positive (negative) latent electrostatic image is formed on the electophotographic photoconductor surface. When the positive (negative) latent electrostatic image is developed using negatively- (positively-) charged toner particles (charge-detecting microparticles), a positive image is obtained, whereas when the positive (negative) latent electrostatic image is developed using positively- (negatively-) charged toner particles, a negative image is obtained. As described above, the developing unit and the charge-eliminating unit may employ a known method.

Among the contaminants adhering to the electophotographic photoconductor surface, discharged substances generated through discharging or external additives contained in the toner are susceptible to humidity, causing formation of abnormal images. Such substances that cause formation of abnormal images include paper dust, which adheres to the electophotographic photoconductor to increase the frequency of abnormal image formation, to decrease the abrasion resistance and to cause uneven abrasion. For the above reason, more preferred is a configuration where the electophotographic photoconductor is not in direct contact with paper, from the viewpoint of achieving high image quality.

Not all of the toner particles supplied from the developing unit 13 on the electophotographic photoconductor 10 are transferred onto the image receiving paper sheet 15, and some toner particles remain on the electophotographic photoconductor 10. Such toner particles are removed from the electophotographic photoconductor 10 with the cleaning unit 17.

This cleaning unit 17 may be a known unit such as a cleaning blade or a cleaning brush. The cleaning blade and the cleaning brush may also be used in combination.

Since the electophotographic photoconductor of the present invention realizes high photoconductivity and high stability, it can be formed into an electophotographic photoconductor having a small diameter. Thus, the electophotographic photoconductor is very effectively used in a so-called tandem image forming apparatus or image forming process where a plurality of electophotographic photoconductors are provided correspondingly to developing portions for color toners for performing image formation in parallel. The tandem image forming apparatus includes: at least four color toners necessary for full-color printing; i.e., yellow (C), magenta (M), cyan (C) and black (K); developing portions retaining the color toners; and at least four electophotographic photoconductors corresponding to the color toners. This configuration makes it possible to perform full-color printing much faster than in conventional full-color image forming apparatus.

Figure 7:
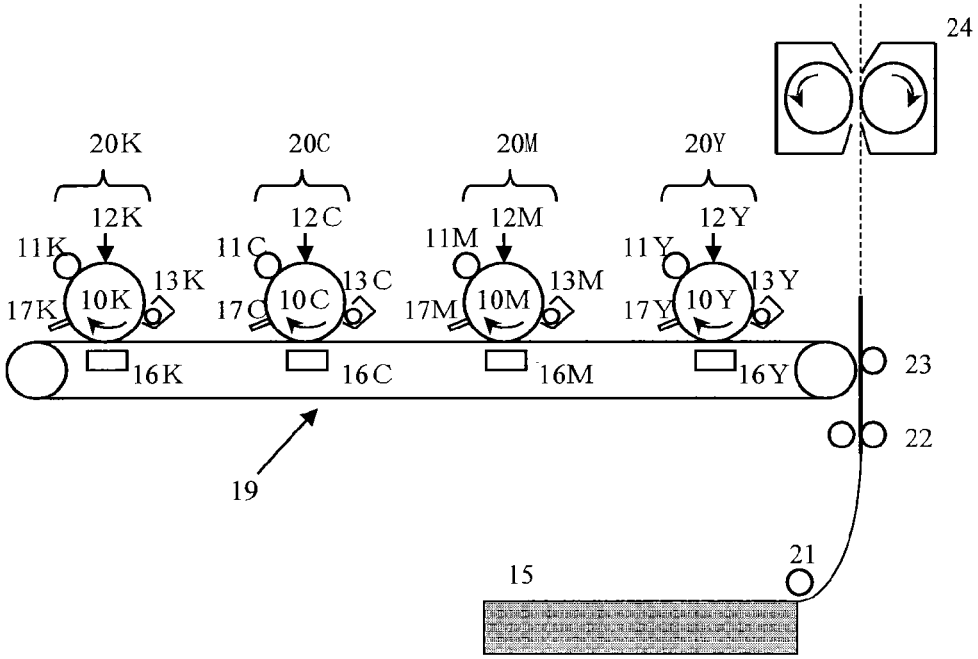
FIG. 7 is an explanatory, schematic view of a tandem full-color image forming apparatus of the present invention.

FIG. 7 is an explanatory, schematic view of a tandem full-color electrophotographic apparatus of the present invention. The present invention encompasses the following modification embodiment.

In FIG. 7, each electrophotographic photoconductor (10C (cyan)), (10M (magenta)), (10Y (yellow)), (10K (black)) has a drum-shaped electrophotographic photoconductor 10. These electrophotographic photoconductors (10C, 10M, 10Y, 10K) are rotated in the arrow direction in FIG. 7. At least a charging unit (11C, 11M, 11Y, 11K), a developing unit (13C, 13M, 13Y, 13K) and a cleaning unit (17C, 17M, 17Y, 17K) are arranged around each of the electrophotographic photoconductors in the rotational direction thereof. This tandem full-color electrophotographic apparatus is configured such that the electrophotographic photoconductors (10C, 10M, 10Y, 10K) are irradiated with laser lights (12C, 12M, 12Y, 12K) emitted from exposing units provided outside of the electrophotographic photoconductors 10 between the charging units (11C, 11M, 11Y, 11K) and the developing units (13C, 13M, 13Y, 13K) so as to form latent electrostatic images on the electrophotographic photoconductors (10C, 10M, 10Y, 10K).

In FIG. 7, four image forming components (20C, 20M, 20Y, 20K) respectively containing the electrophotographic photoconductors (10C, 10M, 10Y, 10K), each serving as a central member, are arranged in parallel along an image receiving material conveyance belt (transfer belt) 19 serving as an image receiving material conveyance unit. The image receiving material conveyance belt 19 is in contact with the electrophotographic photoconductors (10C, 10M, 10Y, 10K) between the developing units (13C, 13M, 13Y, 13K) and the cleaning units (17C, 17M, 17Y, 17K) in the image forming units (20C, 20M, 20Y, 20K). Transfer units (16C, 16M, 16Y, 16K) for applying transfer bias are disposed in the image receiving material conveyance belt 19 on the opposite surface to the electrophotographic photoconductors 10. The image forming components (20C, 20M, 20Y, 20K) have the same configuration except that the color of the toner contained in the developing device is different from one another.

The color electrophotographic apparatus having the configuration as illustrated in FIG. 7 performs image formation as follows. First, in the image forming components (20C, 20M, 20Y, 20K), the electrophotographic photoconductors (10C, 10M, 10Y, 10K) are charged with the charging units (11C, 11M, 11Y, 11K) rotated in the opposite direction to that of the electrophotographic photoconductors 10. Next, in exposing portions provided outside the electrophotographic photoconductors 10, latent electrostatic images for respective color images are formed with laser lights (12C, 12M, 12Y, 12K).

Next, the developing units (13C, 13M, 13Y, 13K) develop the latent images to form toner images. The developing units (13C, 13M, 13Y, 13K) perform development using toners of C (cyan), M (magenta), Y (yellow) and K (black). The color toner images formed on the four electrophotographic photoconductors (10C, 10M, 10Y and 10K) are superposed on top of one another on the transfer belt 19.

The image receiving paper sheet 15 is fed from a tray with a paper feeding roller 21 and is stopped with a pair of registration rollers 22. In synchronization with image formation of the electrophotographic photoconductor, the image receiving paper sheet 15 is fed to the transfer unit (secondary transfer unit) 23. The toner image retained on the transfer belt 19 is transferred onto an image receiving paper sheet 15 by the action of the electrical field formed due to the difference in potential between the transfer belt 19 and the transfer bias applied to the transfer unit (secondary transfer unit) 23. After the image receiving paper sheet having the transferred toner image has been conveyed, the toner image is fixed on the image receiving paper sheet with the fixing unit 24 and then discharged to a paper discharge section. The residual toner particles remaining after transfer on each electrophotographic photoconductor (10C, 10M, 10Y, 10K) are collected with each cleaning unit (17C, 17M, 17Y, 17K) provided in each unit.

The intermediate transfer process as illustrated in FIG. 7 is particularly effective in an image forming apparatus able to perform full-color printing. By transferring a plurality of toner images onto an intermediate transfer member and transferring the toner images onto a paper sheet at one time, incomplete superposition of color images can easily prevented as well as high quality image formation can effectively performed.

The intermediate transfer member in the present invention may be any of the conventionally known intermediate transfer members, although there are intermediate transfer members of various materials or shapes, such as a drum-shaped intermediate transfer member and a belt-shaped intermediate transfer member. Use of the intermediate transfer member is effective in allowing the electrophotographic photoconductor to have high durability or perform high quality image formation.

Notably, in the embodiment of FIG. 7, the image forming components are arranged in the sequence of Y (yellow), M (magenta), C (cyan) and K (black) from upstream to downstream in the direction in which the image receiving paper is conveyed. The sequence of the image forming components is not limited thereto but is desirably set. It is particularly effective in the present invention to provide a mechanism with which the operations of the image forming components (20C, 20M, 20Y) are stopped when preparing documents of only black.

The image forming units as described above may be mounted to a copier, facsimile or printer in the fixed state. Alternatively, they may be mounted thereto in the form of a process cartridge.

(Process Cartridge)

A process cartridge of the present invention includes: an electrophotographic photoconductor; and at least one unit selected from the group consisting of a charging unit, an exposing unit, a developing unit, a transfer unit, a cleaning unit and a charge-eliminating unit, wherein the process cartridge is detachably mounted to a main body of an image forming apparatus and wherein the electrophotographic photoconductor is the electrophotographic photoconductor of the present invention. Use of the electrophotographic photoconductor of the present invention can provide a process cartridge which can highly stably form images during repetitive use, which can maintain high image quality with less image defects for a long period of time, and which is excellent in environmental stability and stability to gas.

A process cartridge of the present invention will be described with reference to FIG. 8.

Figure 8:
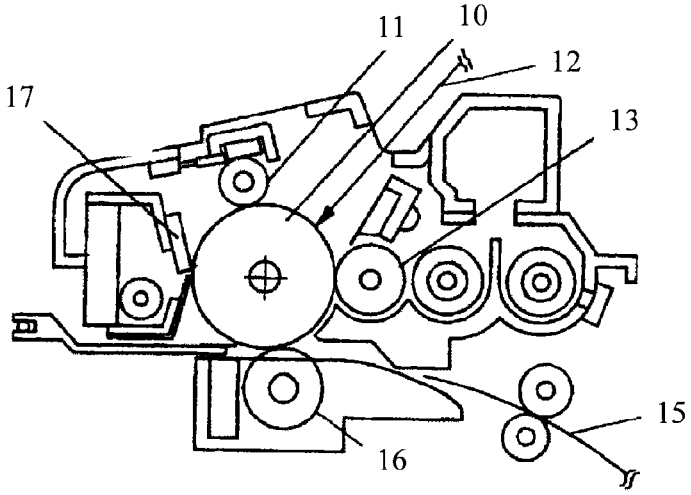
FIG. 8 is an explanatory, schematic view of one exemplary process cartridge of the present invention.

As illustrated in FIG. 8, the process cartridge is a single device (part) including a photoconductor 10, a charging unit 11, an exposing unit 12, a developing unit 13, a transfer unit 16, a cleaning unit 17 and a charge-eliminating unit. Notably, reference numeral 15 denotes an image receiving paper sheet.

EXAMPLES

The present invention will next be described in detail by way of Examples and Comparative Examples. However the present invention should not be construed as being limited to the Examples.

Notably, the unit "part(s)" used in Examples is "part(s) by mass." Also, p-Tol$SO_3$H is paratoluenesulfonic acid, t-$Bu_3$P is tritertiary butylphosphine, t-BuONa is tertiary butoxysodium, Pd$(OAc)_2$ is palladium acetate, and Pd$[(t\text{-}Bu)_3P]_2$ is bis(tri-t-butoxyphosphine)palladium.

Synthesis Example 1

Synthesis of Halogen Intermediate

4-[(Tetrahydro-2H-pyran-2-yl)oxy]methylbromobenzene, which is a halogen intermediate of a material for the three-dimensionally crosslinked polymer, was synthesized according to the following procedure.

Figure 9:
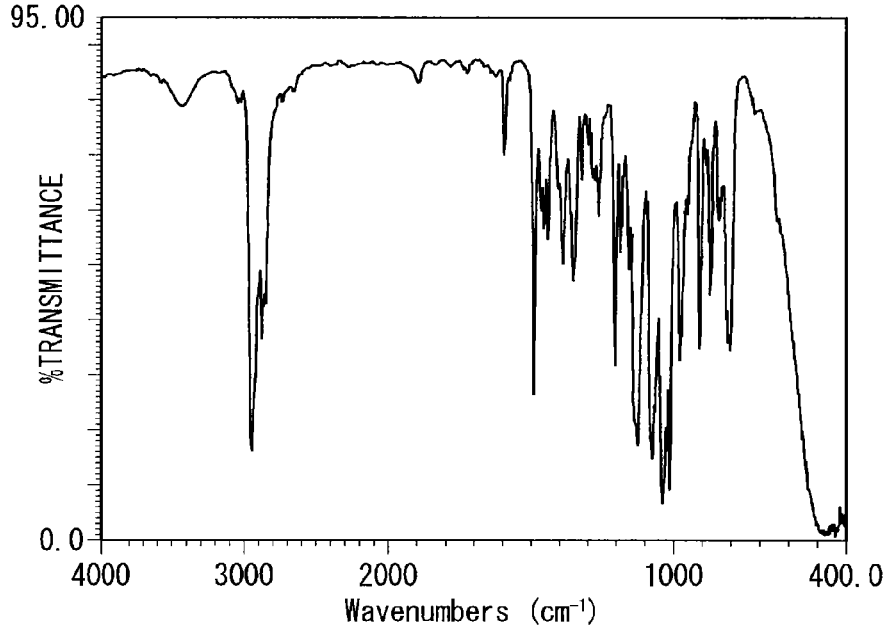
FIG. 9 is an infrared absorption spectrum (KBr tablet method) of the compound obtained in Synthesis Example 1, where the horizontal axis indicates wavenumbers ($cm^{-1}$) and the vertical axis indicates transmittance (%).

First, a four-neck flask was charged with 4-bromobenzyl alcohol (50.43 g), 3,4-dihydro-2H-pyran (45.35 g) and tetrahydrofuran (150 mL). The mixture was stirred at 5° C., and p-toluenesulfonic acid (0.512 g) was added to the four-neck flask. Next, the resultant solution was stirred at room temperature for 2 hours, and then extracted with ethyl acetate, dehydrated with magnesium sulfate, and adsorbed onto active clay and silica gel. The mixture was filtrated, washed and concentrated to obtain a compound of interest (yield: 72.50 g, a colorless oily product). The reaction formula of Synthesis Example 1 is given below. FIG. 9 shows an infrared absorption spectrum (KBr tablet method) of the compound obtained in Synthesis Example 1.

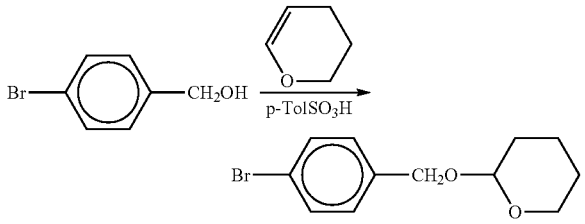

Synthesis Example 2

Synthesis of Halogen Intermediate

4-[(Tetrahydro-2H-pyran-2-yl)oxy]ethylbromobenzene, which is a halogen intermediate of a material for the three-dimensionally crosslinked polymer, was synthesized according to the following procedure.

Figure 10:
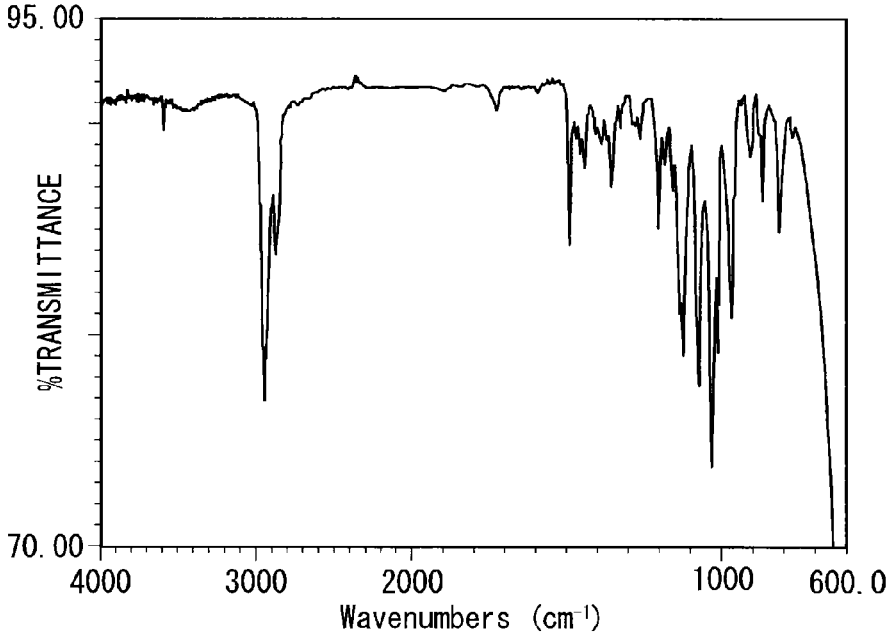
FIG. 10 is an infrared absorption spectrum (KBr tablet method) of the compound obtained in Synthesis Example 2, where the horizontal axis indicates wavenumbers ($cm^{-1}$) and the vertical axis indicates transmittance (%).

First, a four-neck flask was charged with 2-(4-bromobenzyl)ethylalcohol (25.05 g), 3,4-dihydro-2H-pyran (20.95 g) and tetrahydrofuran (50 mL). The mixture was stirred at 5° C., and p-toluenesulfonic acid (0.215 g) was added to the four-neck flask. Next, the resultant solution was stirred at room temperature for 3 hours, and then extracted with ethyl acetate, dehydrated with magnesium sulfate, and adsorbed onto active clay and silica gel. The mixture was filtrated, washed and concentrated to obtain a compound of interest (yield: 35.40 g, a colorless oily product). The reaction formula of Synthesis Example 2 is given below. FIG. 10 shows an infrared absorption spectrum (KBr tablet method) of the compound obtained in Synthesis Example 2.

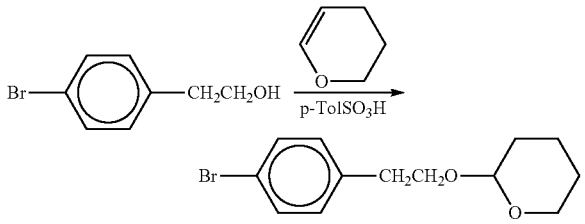

Synthesis Example 3

Synthesis of Halogen Intermediate

4-[(Tetrahydro-2H-pyran-2-yl)oxy]bromobenzene, which is a halogen intermediate of a material for the three-dimensionally crosslinked polymer, was synthesized according to the following procedure.

Figure 11:
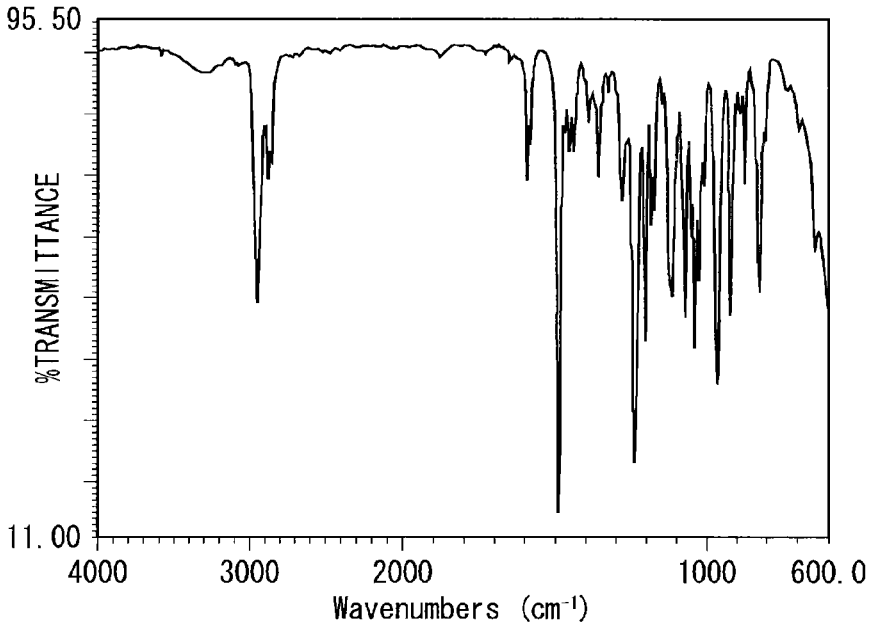
FIG. 11 is an infrared absorption spectrum (KBr tablet method) of the compound obtained in Synthesis Example 3, where the horizontal axis indicates wavenumbers ($cm^{-1}$) and the vertical axis indicates transmittance (%).

First, a four-neck flask was charged with 4-bromophenol (17.3 g), 3,4-dihydro-2H-pyran (16.83 g) and tetrahydrofuran (100 mL). The mixture was stirred at 5° C., and p-toluenesulfonic acid (0.172 g) was added to the four-neck flask. Next, the resultant solution was stirred at room temperature for 2 hours, and then extracted with ethyl acetate, dehydrated with magnesium sulfate, and adsorbed onto active clay and silica gel. The mixture was filtrated, washed and concentrated to obtain a compound of interest (yield: 27.30 g, a colorless oily product). The reaction formula of Synthesis Example 3 is given below. FIG. 11 shows an infrared absorption spectrum (KBr tablet method) of the compound obtained in Synthesis Example 3.

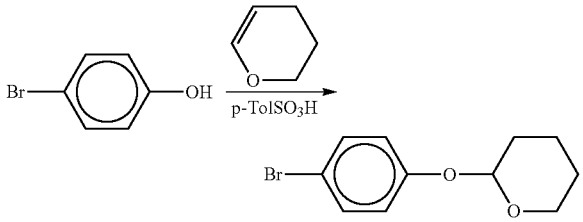

Synthesis Example 4

Synthesis of a Material for the Three-Dimensionally Crosslinked Polymer

A compound containing three or more [(tetrahydro-2H-pyran-2-yl)oxy]methyl groups: i.e., a compound expressed by the following Structural Formula (1-1), which is a material for the three-dimensionally crosslinked polymer, was synthesized according to the following procedure.

Figure 12:
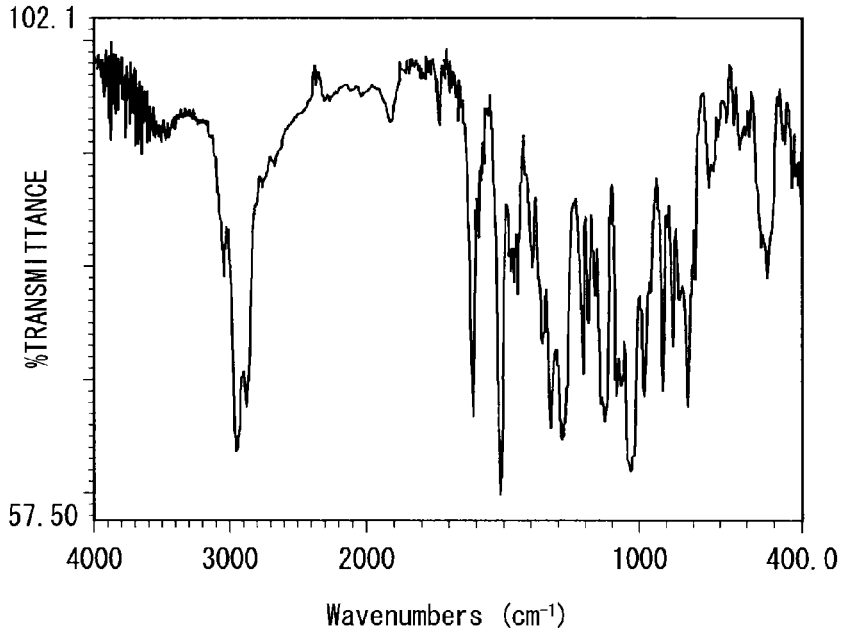
FIG. 12 is an infrared absorption spectrum (KBr tablet method) of the compound obtained in Synthesis Example 4, where the horizontal axis indicates wavenumbers ($cm^{-1}$) and the vertical axis indicates transmittance (%).

First, a four-neck flask was charged with 4,4'-diaminodiphenylmethane (2.99 g), the compound obtained in Synthesis Example 1 (17.896 g), palladium acetate (0.336 g), tertiary butoxysodium (13.83 g) and o-xylene (100 mL). The mixture was stirred at room temperature in an argon atmosphere. Tritertiarybutylphosphine (1.214 g) was added dropwise to the four-neck flask. The resultant solution was stirred at 80° C. for 1 hour and then stirred under reflux for 1 hour. The mixture was diluted with toluene, dehydrated with magnesium sulfate, and adsorbed onto active clay and silica gel. The resultant mixture was filtrated, washed and concentrated to obtain a yellow oily product. The thus-obtained yellow oily product was purified with a silica gel column (toluene/ethyl acetate=20/1 (by volume)) to thereby isolate a compound of interest (yield: 5.7 g, a pale yellow amorphous product). The reaction formula of Synthesis Example 4 is given below. FIG. 12 shows an infrared absorption spectrum (KBr tablet method) of the compound obtained in Synthesis Example 4.

Structural Formula (1-1)

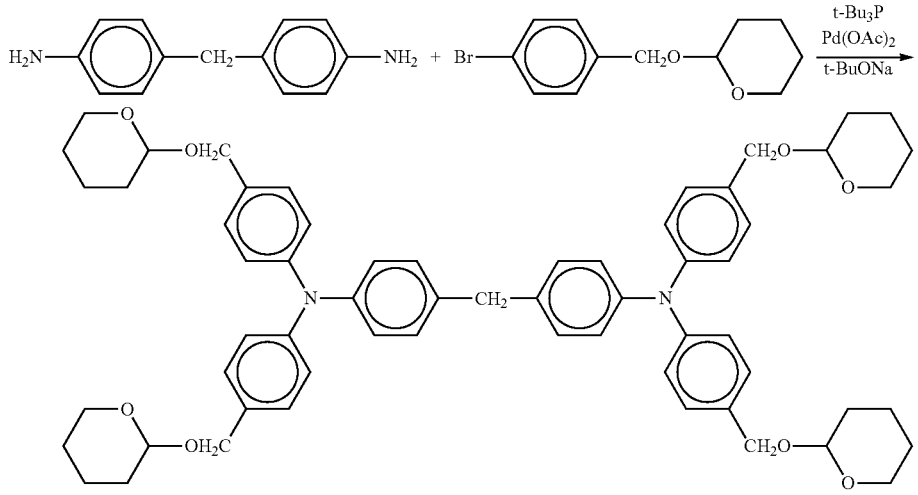

Synthesis Example 5

Synthesis of a Material for the Three-Dimensionally Crosslinked Polymer

A compound containing three or more [(tetrahydro-2H-pyran-2-yl)oxy]methyl groups: i.e., a compound expressed by the following Structural Formula (1-8), which is a material for the three-dimensionally crosslinked polymer, was synthesized according to the following procedure.

Figure 13:
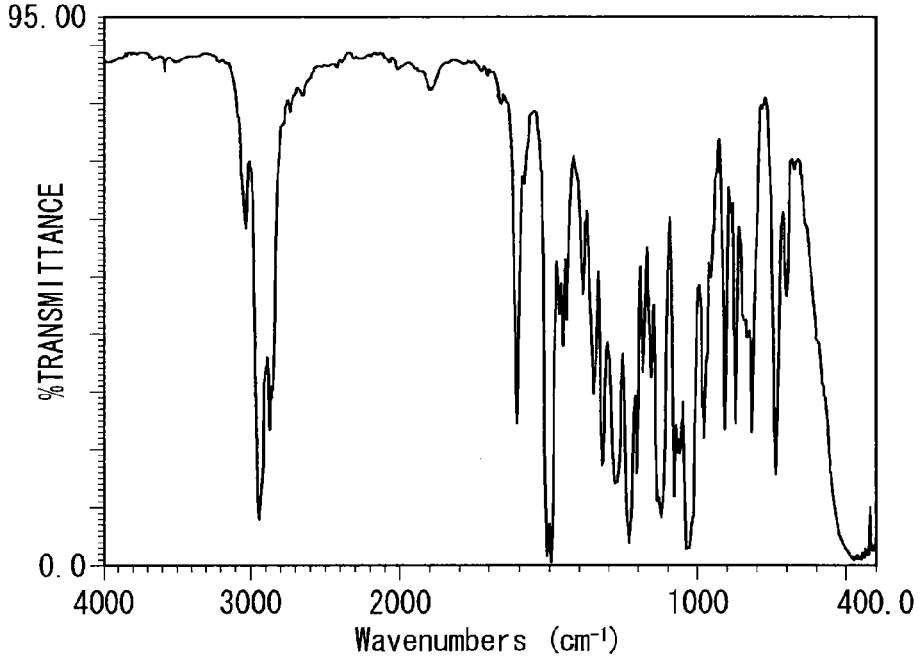
FIG. 13 is an infrared absorption spectrum (KBr tablet method) of the compound obtained in Synthesis Example 5, where the horizontal axis indicates wavenumbers ($cm^{-1}$) and the vertical axis indicates transmittance (%).

First, a four-neck flask was charged with 4,4'-diaminodiphenyl ether (3.0 g), the compound obtained in Synthesis Example 1 (17.896 g), palladium acetate (0.336 g), tertiary butoxysodium (13.83 g) and o-xylene (100 mL). The mixture was stirred at room temperature in an argon atmosphere. Tritertiarybutylphosphine (1.214 g) was added dropwise to the four-neck flask. The resultant solution was stirred at 80° C. for 1 hour and then stirred under reflux for 1 hour. The mixture was diluted with toluene, dehydrated with magnesium sulfate, and adsorbed onto active clay and silica gel. The resultant mixture was filtrated, washed and concentrated to obtain a yellow oily product. The thus-obtained yellow oily product was purified with a silica gel column (toluene/ethyl acetate=10/1 (by volume)) to thereby isolate a compound of interest (yield: 5.7 g, a pale yellow oily product). The reaction formula of Synthesis Example 5 is given below. FIG. 13 shows an infrared absorption spectrum (KBr tablet method) of the compound obtained in Synthesis Example 5.

Structural Formula (1-8)

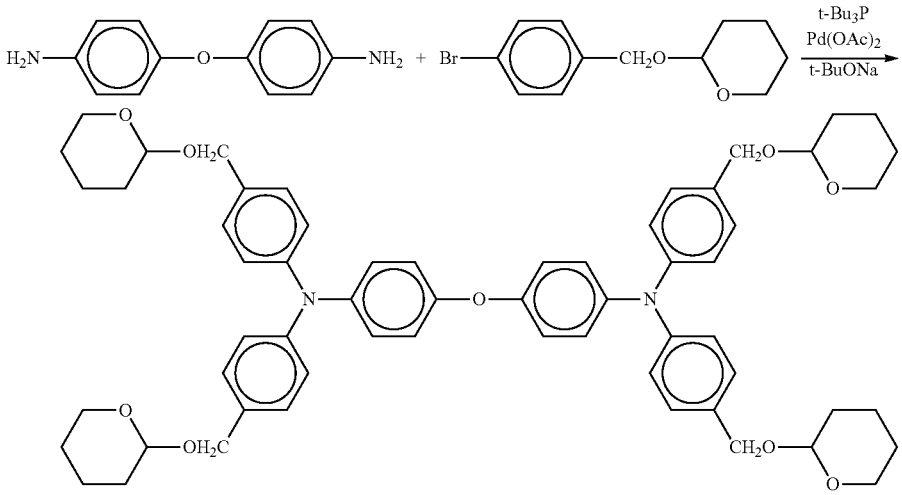

Synthesis Example 6

Synthesis of a Material for the Three-Dimensionally Crosslinked Polymer

A compound containing three or more [(tetrahydro-2H-pyran-2-yl)oxy]methyl groups: i.e., a compound expressed by the following Structural Formula (1-12), which is a material for the three-dimensionally crosslinked polymer, was synthesized according to the following procedure.

Structural Formula (1-12)

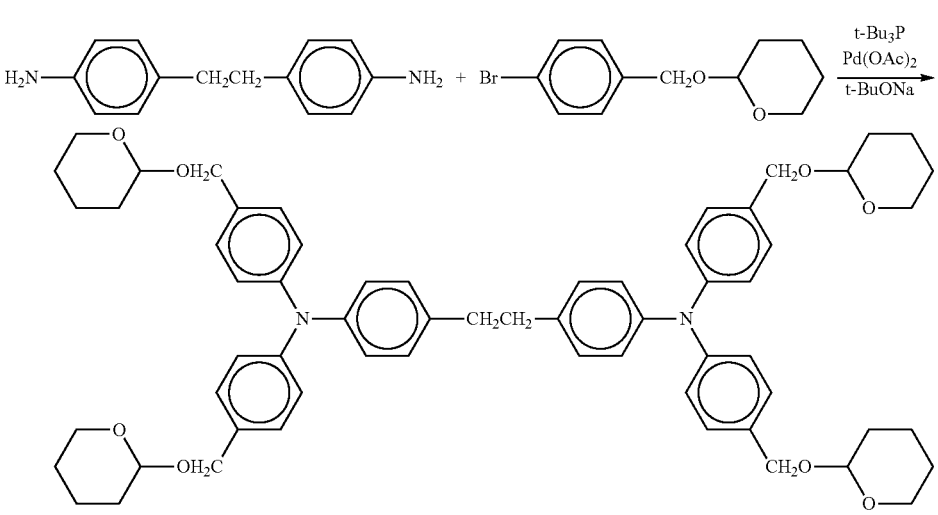

Figure 14:
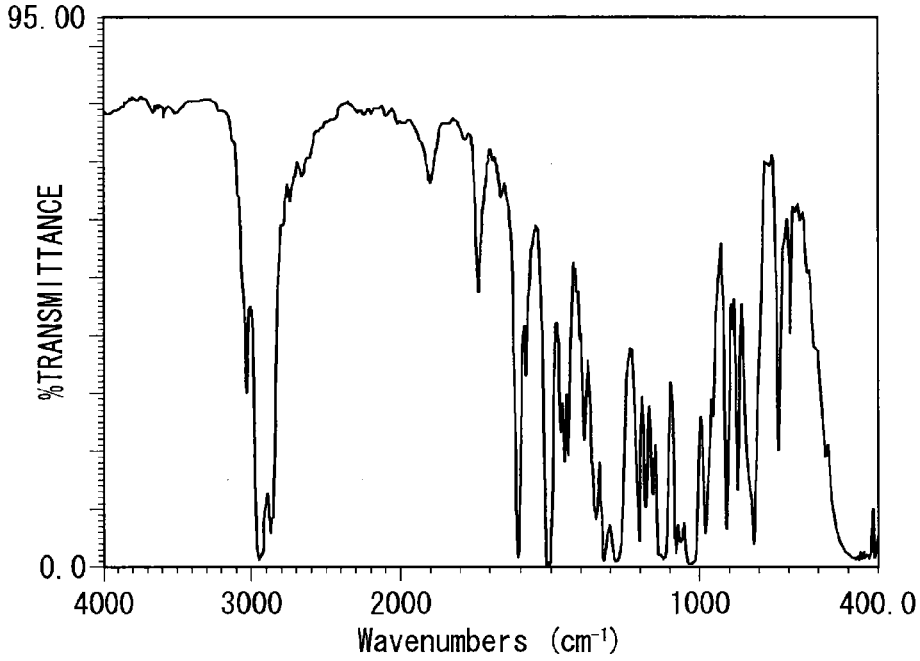
FIG. 14 is an infrared absorption spectrum (KBr tablet method) of the compound obtained in Synthesis Example 6, where the horizontal axis indicates wavenumbers ($cm^{-1}$) and the vertical axis indicates transmittance (%).

First, a four-neck flask was charged with 4,4'-ethylenendianiline (3.18 g), the compound obtained in Synthesis Example 1 (17.896 g), palladium acetate (0.336 g), tertiary butoxysodium (13.83 g) and o-xylene (100 mL). The mixture was stirred at room temperature in an argon atmosphere. Tritertiarybutylphosphine (1.214 g) was added dropwise to the four-neck flask. The resultant solution was stirred at 80° C. for 1 hour and then stirred under reflux for 1 hour. The mixture was diluted with toluene, dehydrated with magnesium sulfate, and adsorbed onto active clay and silica gel. The resultant mixture was filtrated, washed and concentrated to obtain a yellow oily product. The thus-obtained yellow oily product was purified with a silica gel column (toluene/ethyl acetate=20/1 (by volume)) to thereby isolate a compound of interest (yield: 5.7 g, a pale yellow oily product). The reaction formula of Synthesis Example 6 is given below. FIG. 14 shows an infrared absorption spectrum (KBr tablet method) of the compound obtained in Synthesis Example 6.

Synthesis Example 7

Synthesis of a Material for the Three-Dimensionally Crosslinked Polymer

A compound containing three or more [(tetrahydro-2H-pyran-2-yl)oxy]methyl groups: i.e., a compound expressed by the following Structural Formula (1-16), which is a material for the three-dimensionally crosslinked polymer, was synthesized according to the following procedure.

Figure 15:
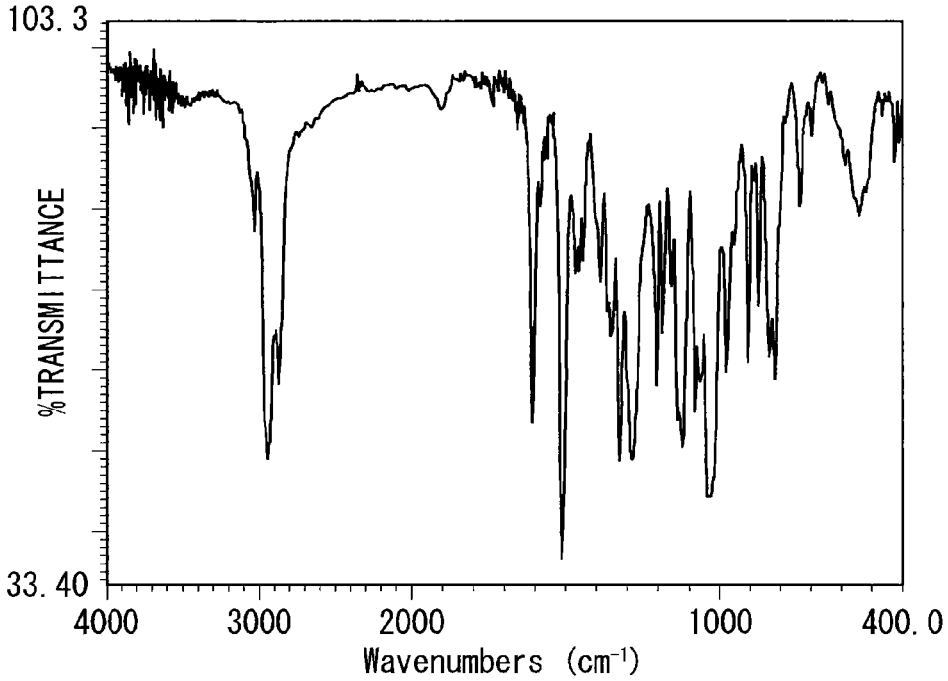
FIG. 15 is an infrared absorption spectrum (KBr tablet method) of the compound obtained in Synthesis Example 7, where the horizontal axis indicates wavenumbers ($cm^{-1}$) and the vertical axis indicates transmittance (%).

First, a four-neck flask was charged with α,α'-bis(4-aminophenyl)-1,4-diisopropylbenzene (10.335 g), the compound obtained in Synthesis Example 1 (39.05 g), palladium acetate (0.673 g), tertiary butoxysodium (27.677 g) and o-xylene (200 mL). The mixture was stirred at room temperature in an argon atmosphere. Tritertiarybutylphosphine (2.43 g) was added dropwise to the four-neck flask. The resultant solution was stirred at 80° C. for 1 hour and then stirred under reflux for 2 hours. The mixture was diluted with toluene, dehydrated with magnesium sulfate, and adsorbed onto active clay and silica gel. The resultant mixture was filtrated, washed and concentrated to obtain a yellow oily product. The thus-obtained yellow oily product was purified with a silica gel column (toluene/ethyl acetate=10/1 (by volume)) to thereby isolate a compound of interest (yield: 23.5 g, a pale yellow amorphous product). The reaction formula of Synthesis Example 7 is given below. FIG. 15 shows an infrared absorption spectrum (KBr tablet method) of the compound obtained in Synthesis Example 7.

Structural Formula (1-16)

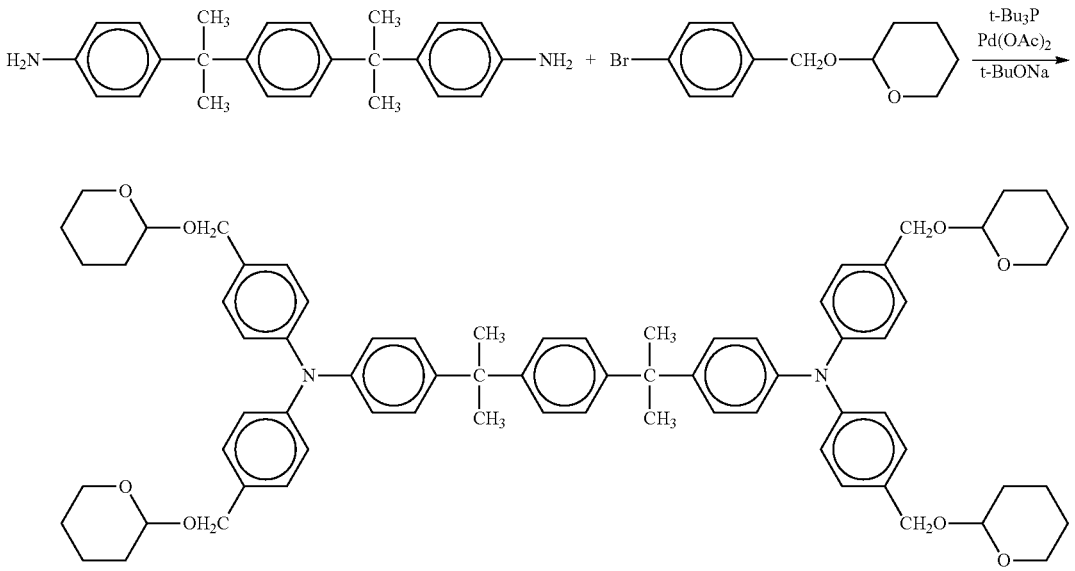

Synthesis Example 8

Synthesis of a Material for the Three-Dimensionally Crosslinked Polymer

A compound containing three or more [(tetrahydro-2H-pyran-2-yl)oxy]methyl groups: i.e., a compound expressed by the following Structural Formula (1-19), which is a material for the three-dimensionally crosslinked polymer, was synthesized according to the following procedure.

Figure 16:
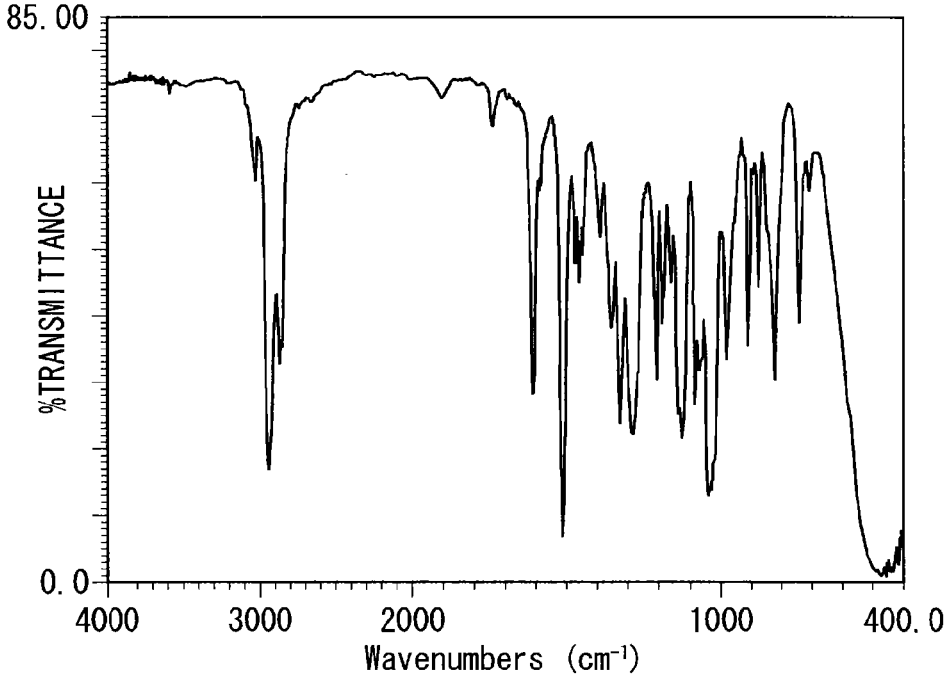
FIG. 16 is an infrared absorption spectrum (KBr tablet method) of the compound obtained in Synthesis Example 8, where the horizontal axis indicates wavenumbers ($cm^{-1}$) and the vertical axis indicates transmittance (%).

First, a four-neck flask was charged with 1,1-bis(4-aminophenyl)cyclohexene (9.323 g), the compound obtained in Synthesis Example 1 (45.55 g), palladium acetate (0.785 g), tertiary butoxysodium (32.289 g) and o-xylene (300 mL). The mixture was stirred at room temperature in an argon atmosphere. Tritertiarybutylphosphine (2.43 g) was added dropwise to the four-neck flask. Next, the resultant solution was stirred at 80° C. for 1 hour and then stirred under reflux for 2 hours. The mixture was diluted with toluene, dehydrated with magnesium sulfate, and adsorbed onto active clay and silica gel. The resultant mixture was filtrated, washed and concentrated to obtain a yellow oily product. The thus-obtained yellow oily product was purified with a silica gel column (toluene/ethyl acetate=10/1) to thereby isolate a compound of interest (yield: 11.42 g, a yellow amorphous product). The reaction formula of Synthesis Example 8 is given below. FIG. 16 shows an infrared absorption spectrum (KBr tablet method) of the compound obtained in Synthesis Example 8.

Structural Formula (1-19)

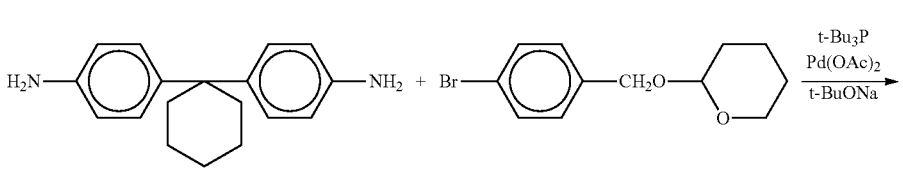

-continued

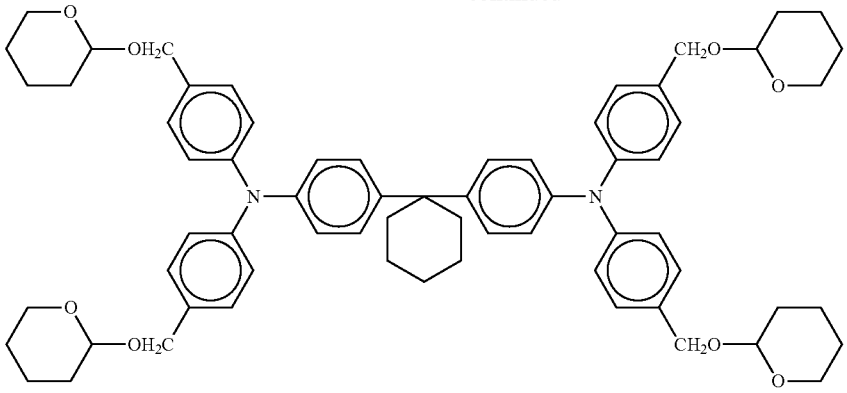

Synthesis Example 9

Synthesis of Intermediate Methylol Compound

An intermediate methylol compound used as a material for producing the compound containing three or more [(tetrahydro-2H-pyran-2-yl)oxy]methyl groups, which is a material for the three-dimensionally crosslinked polymer, was synthesized according to the following procedure.

First, a four-neck flask was charged with tris(4-formylphenyl)amine (6.65 g) and ethanol (150 mL), followed by stirring at room temperature. Sodium borohydride (3.63 g) was added dropwise thereto. The resultant solution was stirred for 4 hours, and extracted with ethyl acetate, dehydrated with magnesium sulfate, and adsorbed onto active clay and silica gel. The resultant mixture was filtrated, washed and concentrated to obtain an amorphous product. This amorphous product was dispersed in n-hexane, followed by filtrating, washing and drying, to thereby obtain a compound of interest (yield: 6.0 g, a pale yellow amorphous product). The reaction formula of Synthesis Example 9 is given below.

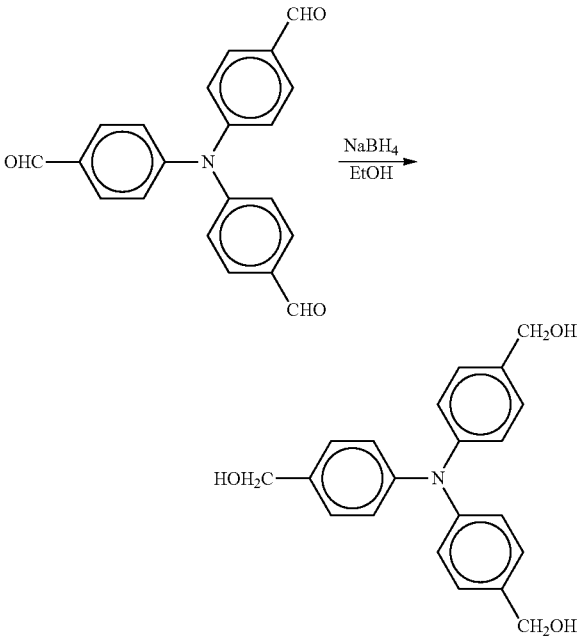

Synthesis Example 10

Synthesis of a Material for the Three-Dimensionally Crosslinked Polymer

A compound containing three or more [(tetrahydro-2H-pyran-2-yl)oxy]methyl groups: i.e., a compound expressed by the following Structural Formula (A-1), which is a material for the three-dimensionally crosslinked polymer, was synthesized according to the following procedure.

Figure 17:
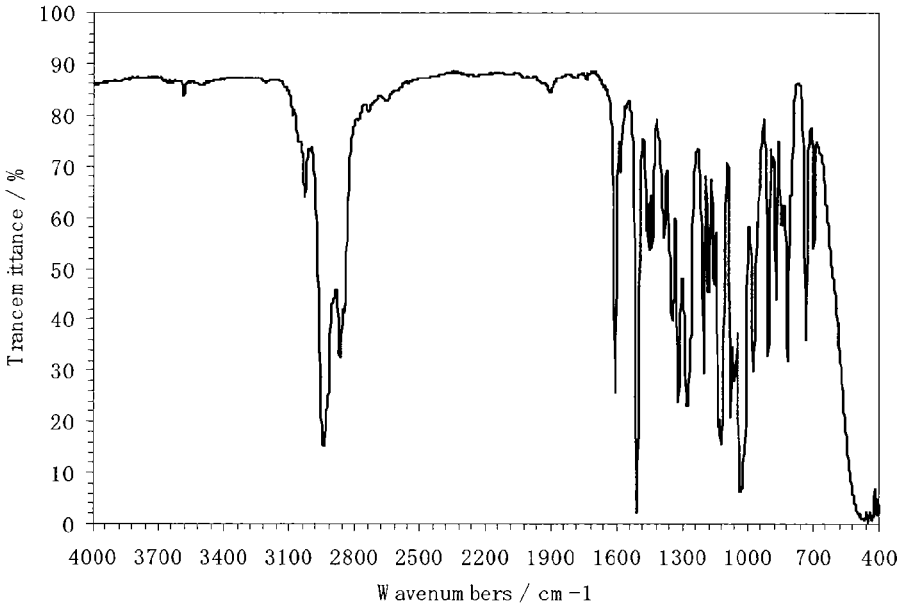
FIG. 17 is an infrared absorption spectrum (KBr tablet method) of the compound obtained in Synthesis Example 10, where the horizontal axis indicates wavenumbers ($cm^{-1}$) and the vertical axis indicates transmittance (%).

First, a four-neck flask was charged with the intermediate methylol compound (3.4 g) obtained in Synthesis Example 9, 3,4-dihydro-2H-pyran (4.65 g) and tetrahydrofuran (100 mL). The mixture was stirred at 5° C., and p-toluenesulfonic acid (58 mg) was added to the four-neck flask. The resultant solution was stirred at room temperature for 5 hours, and then extracted with ethyl acetate, dehydrated with magnesium sulfate, and adsorbed onto active clay and silica gel. The mixture was filtrated, washed and concentrated to obtain a yellow oily product. The thus-obtained yellow oily product was purified with a silica gel column (toluene/ethyl acetate=5/1 (by volume)) to thereby isolate a compound of interest (yield: 2.7 g, a pale yellow oily product). The reaction formula of Synthesis Example 10 is given below. FIG. 17 shows an infrared absorption spectrum (liquid membrane method) of the tetrahydropyranyl compound obtained in Synthesis Example 10.

Structural Formula (A-1)

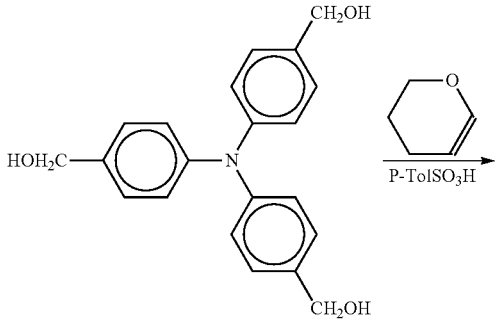

-continued

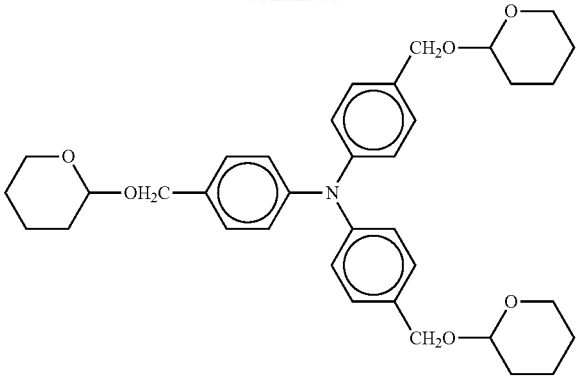

Synthesis Example 11

Synthesis of a Material for the Three-Dimensionally Crosslinked Polymer

A compound containing three or more [(tetrahydro-2H-pyran-2-yl)oxy]methyl groups: i.e., a compound expressed by the following Structural Formula (A-2), which is a material for the three-dimensionally crosslinked polymer, was synthesized according to the following procedure.

Figure 18:
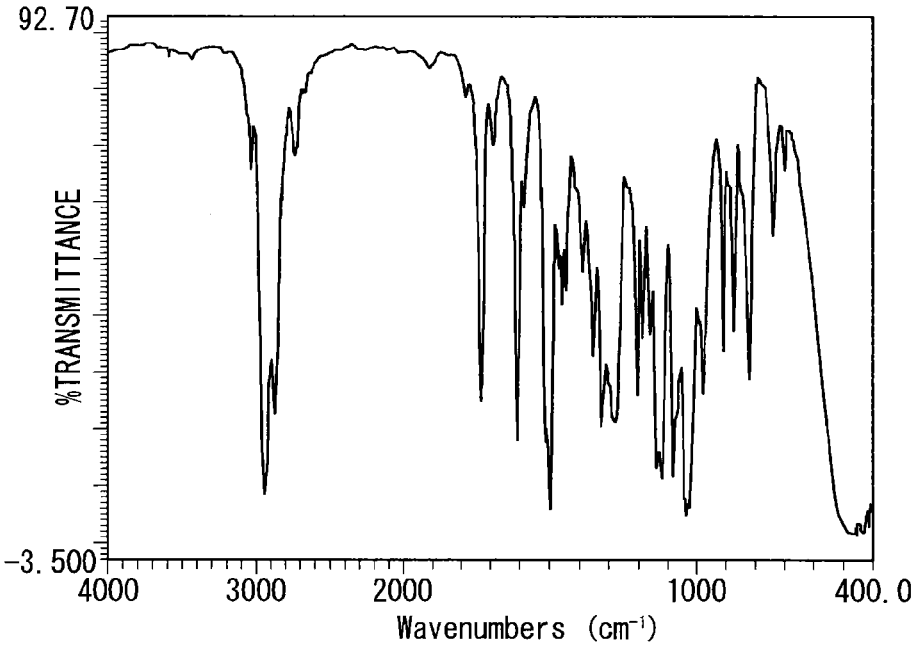
FIG. 18 is an infrared absorption spectrum (KBr tablet method) of the compound obtained in Synthesis Example 11, where the horizontal axis indicates wavenumbers ($cm^{-1}$) and the vertical axis indicates transmittance (%).

First, a four-neck flask was charged with the intermediate methylol compound (1.274 g), 3,4-dihydro-2H-pyran (1.346 g) and tetrahydrofuran (20 mL). The mixture was stirred at 5° C., and p-toluenesulfonic acid (14 mg) was added to the four-neck flask. Next, the resultant solution was stirred at room temperature for 4 hours, and then extracted with ethyl acetate, dehydrated with magnesium sulfate, and adsorbed onto active clay and silica gel. The mixture was filtrated, washed and concentrated to obtain a yellow oily product. The thus-obtained yellow oily product was purified with a silica gel column (toluene/ethyl acetate=20/1 (by volume)) to thereby isolate a compound of interest (yield: 1.48 g, a yellow oily product). The reaction formula of Synthesis Example 11 is given below. FIG. 18 shows an infrared absorption spectrum (liquid membrane method) of the tetrahydropyranyl compound obtained in Synthesis Example 11.

Structural Formula (A-2)

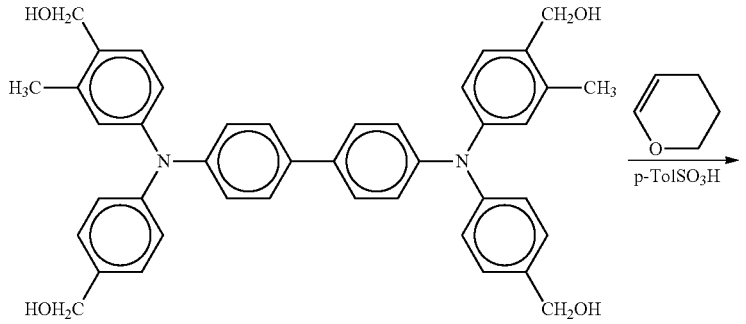

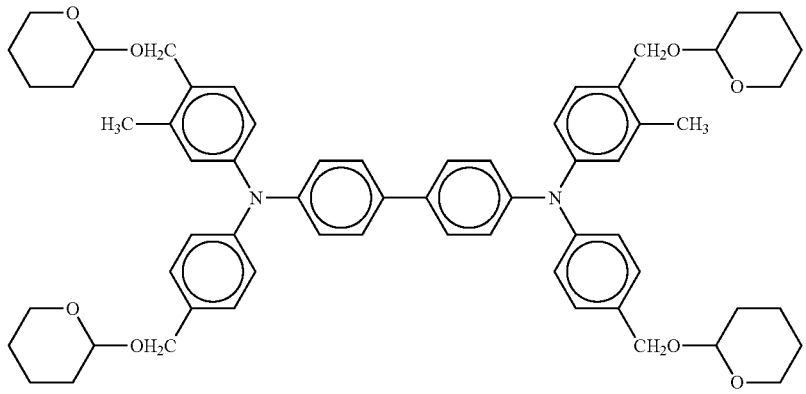

Synthesis Example 12

Synthesis of Comparative Material

A compound used in Comparative Examples: i.e., a compound expressed by Structural Formula (C-1) was synthesized according to the following procedure.

Figure 19:
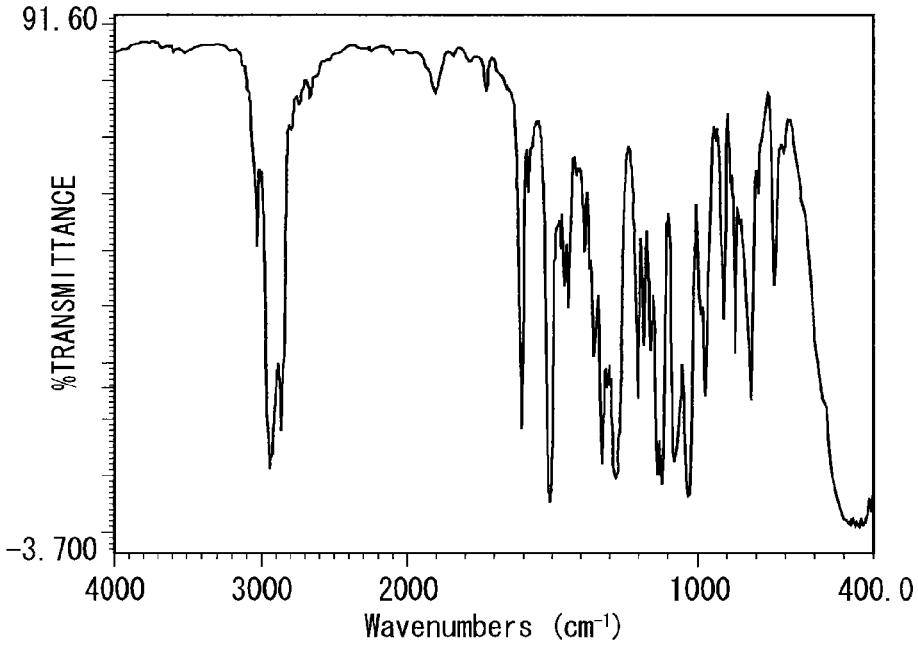
FIG. 19 is an infrared absorption spectrum (KBr tablet method) of the compound obtained in Synthesis Example 12, where the horizontal axis indicates wavenumbers ($cm^{-1}$) and the vertical axis indicates transmittance (%).

First, a four-neck flask was charged with 4,4'-diaminodiphenylmethane (0.991 g), the compound obtained in Synthesis Example 2 (7.41 g), tertiary butoxysodium (3.844 g), bis(tri-t-butoxyphosphine)palladium (52 mg) and o-xylene (20 mL). The mixture was stirred at room temperature in an argon atmosphere. The resultant was stirred under reflux for 1 hour. The mixture was diluted with toluene, dehydrated with magnesium sulfate, adsorbed onto active clay and silica gel. The resultant mixture was filtrated, washed and concentrated to obtain a yellow oily product. The thus-obtained yellow oily product was purified with a silica gel column (toluene/ethyl acetate=10/1 (by volume)) to thereby isolate a compound of interest (yield: 4.12 g, a pale yellow amorphous product). The reaction formula of Synthesis Example 12 is given below. FIG. 19 shows an infrared absorption spectrum (KBr tablet method) of the compound obtained in Synthesis Example 12.

Figure 20:
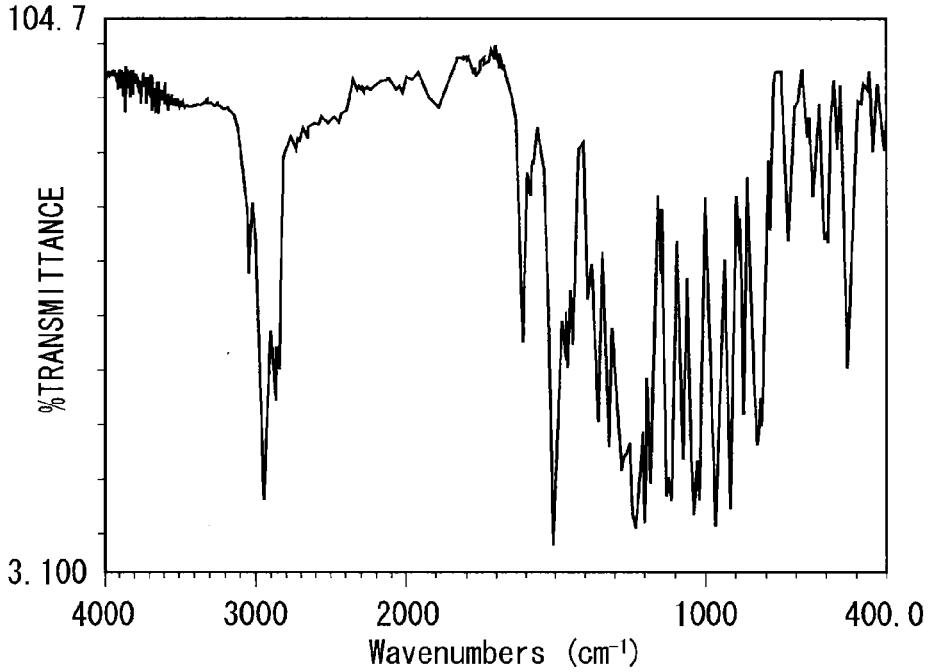
FIG. 20 is an infrared absorption spectrum (KBr tablet method) of the compound obtained in Synthesis Example 13, where the horizontal axis indicates wavenumbers ($cm^{-1}$) and the vertical axis indicates transmittance (%).

First, a four-neck flask was charged with 4,4'-diaminodiphenylmethane (0.991 g), the compound obtained in Synthesis Example 3 (6.603 g), tertiary butoxysodium (3.844 g), bis(tri-t-butoxyphosphine)palladium (52 mg) and o-xylene (20 mL). The mixture was stirred at room temperature in an argon atmosphere. The resultant solution was stirred under reflux for 1 hour, and then diluted with toluene, dehydrated with magnesium sulfate, and adsorbed onto active clay and silica gel. The resultant mixture was filtrated, washed and concentrated to obtain a yellow oily product. The thus-obtained yellow oily product was purified with a silica gel column (toluene/ethyl acetate=20/1 (by volume) to thereby isolate a compound of interest (yield: 3.52 g, pale yellow powder). The reaction formula of Synthesis Example 13 is given below. FIG. 20 shows an infrared absorption spectrum (KBr tablet method) of the compound obtained in Synthesis Example 13.

Structural Formula (C-1)

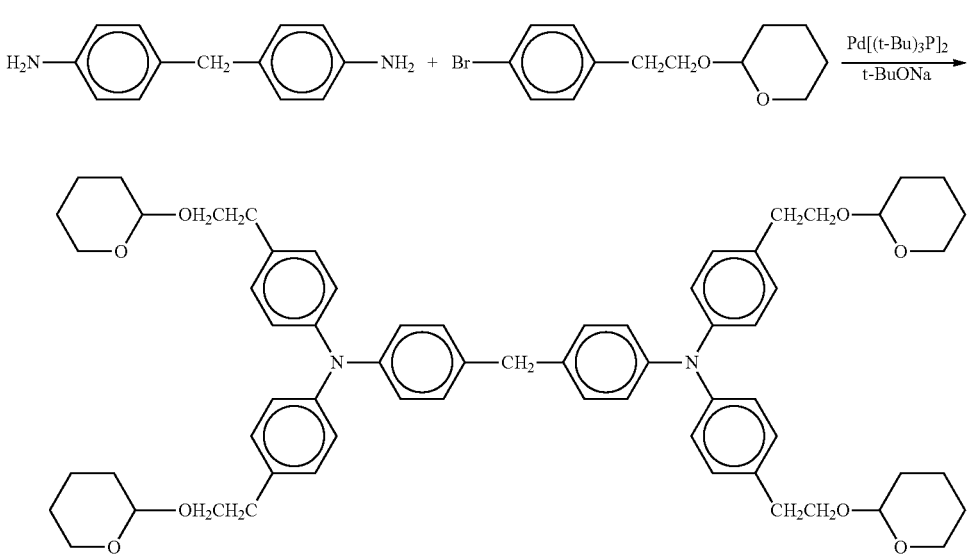

Synthesis Example 13

Synthesis of Comparative Material

A compound used in Comparative Examples: i.e., a compound expressed by Structural Formula (C-2) was synthesized according to the following procedure.

Structural Formula (C-2)

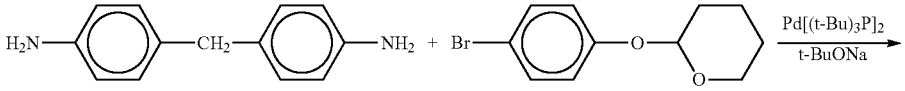

-continued

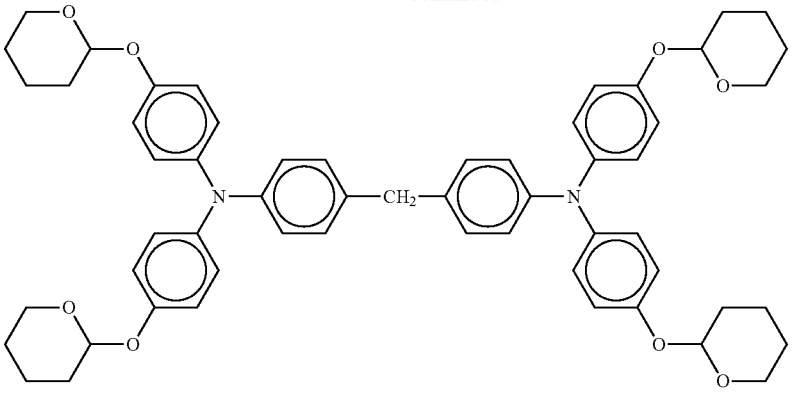

Synthesis Example 14

Synthesis of Intermediate Aldehyde Compound (for Comparative Material)

An intermediate aldehyde compound used for synthesizing a compound used in Comparative Examples; i.e., a compound expressed by Structural Formula (C-3), was synthesized according to the following procedure.

Figure 21:
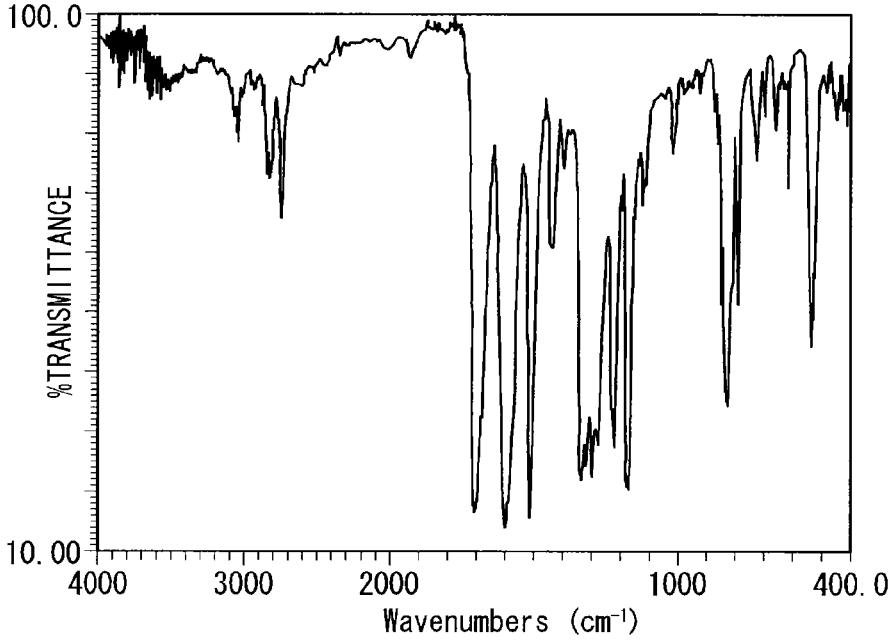
FIG. 21 is an infrared absorption spectrum (KBr tablet method) of the compound obtained in Synthesis Example 14, where the horizontal axis indicates wavenumbers ($cm^{-1}$) and the vertical axis indicates transmittance (%).

A four-neck flask was charged with 4,4'-methylenebis(N, N-diphenylaniline) (30.16 g), N-methylformanilide (MFA) (71.36 g) and o-dichlorobenzene (400 mL). The mixture was stirred at room temperature in an argon atmosphere. Phosphorus oxychloride (82.01 g) was added dropwise to the resultant solution and the mixture was stirred at 80° C. Then, zinc chloride (32.71 g) was added dropwise thereto, and the resultant mixture was stirred at 80° C. for about hours and then at 120° C. for about 3 hours. An aqueous potassium hydroxide solution was added to the mixture to perform hydrolysis reaction. The mixture was extracted with dichloromethane, dehydrated with magnesium sulfate, and adsorbed onto active clay. The resultant mixture was filtrated, washed and concentrated to obtain crystals. The thus-obtained crystals were isolated through purification using a silica gel column (toluene/ethyl acetate=8/2 (by volume). The obtained crystals were recrystallized with methanol/ethyl acetate to thereby obtain a compound of interest (yield: 27.80 g, yellow powder). The reaction formula of Synthesis Example 14 is given below. FIG. 21 shows an infrared absorption spectrum (KBr tablet method) of the compound obtained in Synthesis Example 14.

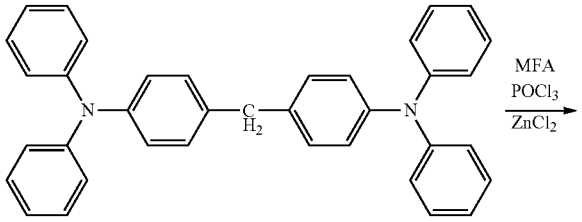

-continued

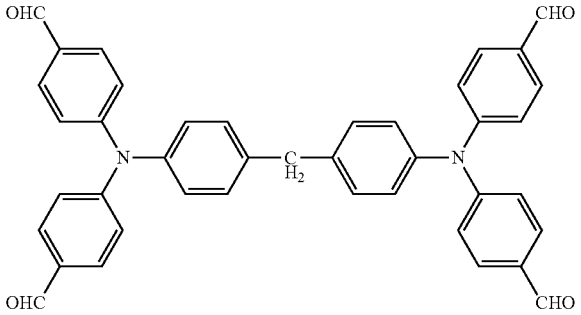

Synthesis Example 15

Synthesis of Comparative Material

A compound used in Comparative Examples; i.e., a compound expressed by Structural Formula (C-3), was synthesized according to the following procedure.

First, a four-neck flask was charged with the intermediate aldehyde compound (12.30 g) obtained in Synthesis Example 14 and ethanol (150 mL), followed by stirring at room temperature. Sodium borohydride (3.63 g) was added dropwise thereto, followed by stirring for 4 hours. The resultant solution was extracted with ethyl acetate, dehydrated with magnesium sulfate, and adsorbed onto active clay and silica gel. The resultant mixture was filtrated, washed and concentrated to obtain an amorphous product. This amorphous product was dispersed in n-hexane, followed by filtrating, washing and drying, to thereby obtain a compound of interest (yield: 12.0 g, a pale yellow amorphous product).

Figure 22:
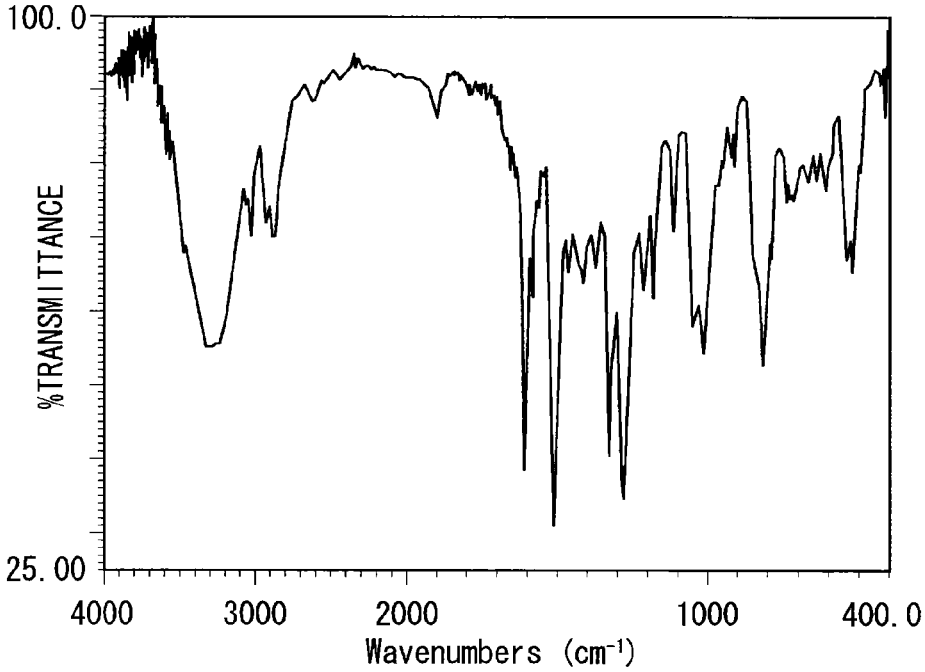
FIG. 22 is an infrared absorption spectrum (KBr tablet method) of the compound obtained in Synthesis Example 15, where the horizontal axis indicates wavenumbers ($cm^{-1}$) and the vertical axis indicates transmittance (%).

FIG. 22 shows an infrared absorption spectrum (KBr tablet method) of the compound obtained in Synthesis Example 15.

Structural Formula (C-3)

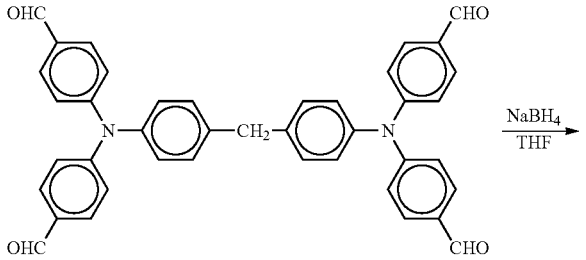

-continued

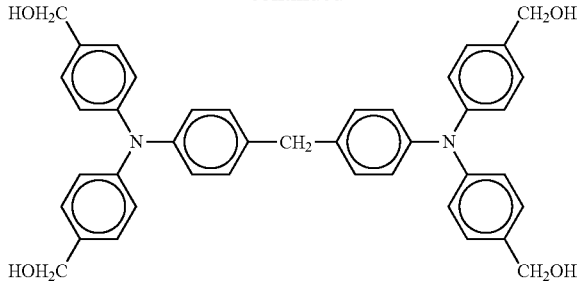

Structural Formula (C-5)

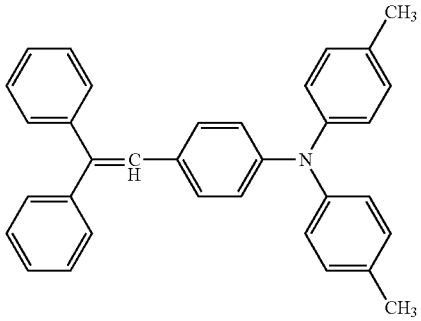

Example 1

An aluminum cylinder having a diameter of 30 mm was coated sequentially with the following under layer-coating liquid, the following charge generation layer-coating liquid and the following charge transport layer-coating liquid, followed by drying, to thereby form an under layer having a thickness of 3.5 μm, a charge generation layer having a thickness of 0.2 μm and a charge transport layer having a thickness of 25 μm, respectively.

[Composition of Under Layer-Coating Liquid]

Alkyd resin (BECKOSOL 1307-60-EL, product of DIC Corporation): 6 parts

Melamine resin (SUPER BECKAMINE G-821-60, product of DIC Corporation): 4 parts

Fine pigment particles (titanium oxide)

(CREL, product of ISHIHARA SANGYO KAISHA, LTD.): 40 parts

Organic solvent (methyl ethyl ketone): 50 parts

[Composition of Charge Generation Layer-Coating Liquid]

Binder resin (polyvinyl butyral resin (XYHL, product of UCC)): 0.5 parts

Organic material (a bisazo pigment expressed by the following structural formula): 2.4 parts Organic solvent (cyclohexanone): 200 parts Organic solvent (methyl ethyl ketone): 80 parts Subsequently, the following inorganic filler, acidic disperser and organic solvent were dispersed for 24 hours with a ball mill using alumina balls. To the resultant dispersion was added a solution which had been prepared by dissolving in an organic solvent the following material for the three-dimensionally crosslinked polymer and the following acid catalyst. The resultant mixture was mixed and dispersed to prepare [crosslinked charge transport layer-coating liquid] having the following composition. The above-formed charge transport layer was spray-coated with the [crosslinked charge transport layer-coating liquid] having the following composition, followed by drying at 135° C. for 30 min, to thereby form a crosslinked charge transport layer having a thickness of 5.0 μm. Through the above procedure, an electrophotographic photoconductor of Example 1 was produced.

[Composition of Crosslinked Charge Transport Layer-Coating Liquid]

Material for three-dimensionally crosslinked polymer: 10 parts (the compound expressed by the above Structural Formula (1-1))

Inorganic filler (α-alumina): 1 part (particle diameter: about 0.3 μm, specific resistance: $10^{10}$ Ω·cm or higher) (pH 8 to 9, trade name "SUMIKORANDOM AA-03," product of Sumitomo Kagaku Kogyo Co., Ltd.)

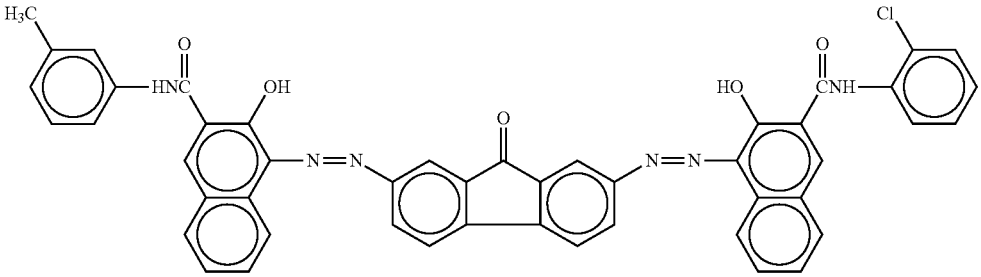

[Composition of Charge Transport Layer-Coating Liquid]

Binder resin (bisphenol Z polycarbonate resin) (PANLITE TS-2050, product of TEIJIN CHEMICALS LTD.): 10 parts Organic solvent (tetrahydrofuran): 100 parts Silicone oil (1% by mass tetrahydrofuran solution of silicone oil) (KF50-100CS, product of Shin-Etsu Chemical Co., Ltd.): 0.2 parts Charge transporting compound (a compound expressed by the following Structural Formula (C-5)): 5 parts Acidic disperser (polycarboxylic acid compound): 0.05 parts (acid value: about 180 mgKOH/g, solid content: 50%)

(trade name "BYK-P104," product of BYK-Chemie GmbH)

Acid catalyst (paratoluenesulfonic acid monohydrate): 0.02 parts

Organic solvent (tetrahydrofuran): 70 parts

Organic solvent (cyclohexanone): 5 parts

Examples 2 to 12

Electrophotographic photoconductors of Examples 2 to 12 each were produced in the same manner as in Example 1 except that at least one of the [material for three-dimensionally crosslinked polymer], the [acidic disperser] and the [inorganic filler] in the [crosslinked charge transport layer-coating liquid] was changed as described in Table 1-1. Table 2 describes the trade names and manufacturers of the materials used.

Comparative Example 1

An electrophotographic photoconductor was produced in the same manner as in Example 1 except that the acidic disperser was not used in the [crosslinked charge transport layer-coating liquid].

Comparative Example 2

An electrophotographic photoconductor was produced in the same manner as in Example 1 except that the compound expressed by the above Structural Formula (1-1) serving as the material for three-dimensionally crosslinked polymer was changed to the compound expressed by the above Structural Formula (C-1) serving as the comparative material.

Comparative Example 3

An electrophotographic photoconductor was produced in the same manner as in Example 1 except that the compound expressed by the above Structural Formula (1-1) serving as the material for three-dimensionally crosslinked polymer was changed to the compound expressed by the above Structural Formula (C-2) serving as the comparative material.

Comparative Example 4

An electrophotographic photoconductor was produced in the same manner as in Example 1 except that the compound expressed by the above Structural Formula (1-1) serving as the material for three-dimensionally crosslinked polymer was changed to the compound expressed by the above Structural Formula (C-3) serving as the comparative material.

Comparative Example 5

An electrophotographic photoconductor was produced in the same manner as in Example 1 except that the compound expressed by the above Structural Formula (1-1) serving as the material for three-dimensionally crosslinked polymer was changed to the compound expressed by the following Structural Formula (C-4) serving as the comparative material.

Structural Formula (C-4)

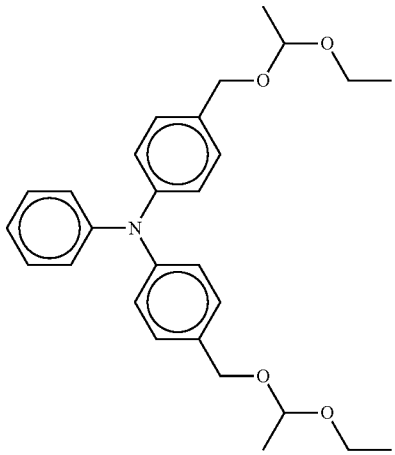

Comparative Example 6

An electrophotographic photoconductor was produced in the same manner as in Example 1 except that the composition of the [crosslinked charge transport layer-coating liquid] was changed as described below.

[Composition of Crosslinked Charge Transport Layer-Coating Liquid]

Material for three-dimensionally crosslinked polymer: 5.5 parts (the compound expressed by the above Structural Formula (C-4))

Resol-type phenol resin (PL-2211, product of Gunei Chemical Industry Co., Ltd.): 7 parts Inorganic filler (α-alumina): 1.3 parts (particle diameter: about 0.3 μm, specific resistance: $10^{10}$ Ω·cm or higher) (pH 8 to 9, trade name "SUMIKORANDOM AA-03," product of Sumitomo Kagaku Kogyo Co., Ltd.)

Acidic disperser (polycarboxylic acid compound): 0.07 parts (acid value: about 180 mgKOH/g, solid content: 50%)

(trade name "BYK-P104," product of BYK-Chemie GmbH)

Acid catalyst (NACURE2500, product of KUSUMOTO CHEMICALS, Ltd.): 0.2 parts

Organic solvent (isopropanol): 100 parts

Organic solvent (methyl ethyl ketone): 40 parts

Comparative Example 7

An electrophotographic photoconductor was produced in the same manner as in Example 1 except that the composition of the [crosslinked charge transport layer-coating liquid] was changed as described below.

[Composition of Crosslinked Charge Transport Layer-Coating Liquid]

Material for three-dimensionally crosslinked polymer: 10 parts (the compound expressed by the above Structural Formula (1-1))

Acid catalyst (paratoluenesulfonic acid monohydrate): 0.02 parts

Organic solvent (tetrahydrofuran): 90 parts

Comparative Example 8

An electrophotographic photoconductor was produced in the same manner as in Example 1 except that the composition of the [crosslinked charge transport layer-coating liquid] was changed as described below.

[Composition of Crosslinked Charge Transport Layer-Coating Liquid]

Polycarbonate resin (Z-POLYCA, product of TEIJIN CHEMICALS LTD.): 10 parts

Charge transporting compound expressed by the following Structural Formula (C-5): 8 parts Structural Formula (C-5)

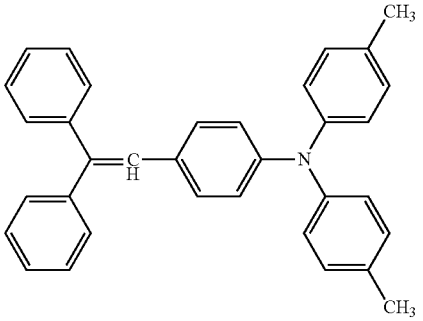

Inorganic filler (α-alumina): 2.0 parts (particle diameter: about 0.3 μm, specific resistance: $10^{10}$ Ω·cm or higher)

(pH 8 to 9, trade name "SUMIKORANDOM AA-03," product of Sumitomo Kagaku Kogyo Co., Ltd.

)

Acidic disperser (polycarboxylic acid compound): 0.1 parts (acid value: about 180 mgKOH/g, solid content: 50%)

(trade name "BYK-P104," product of BYK-Chemie GmbH)

Organic solvent (tetrahydrofuran): 370 parts

Organic solvent (cyclohexanone): 110 parts

Antioxidant (a compound expressed by the following structural formula): 0.2 parts

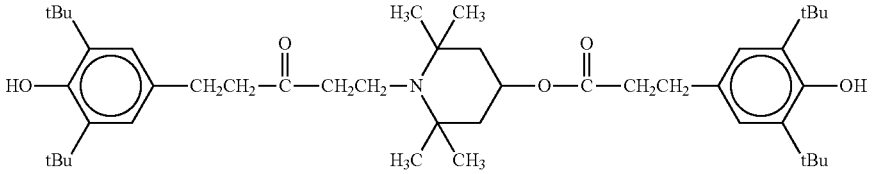

In this structural formula, tBu is a t-butyl group.

Comparative Example 9

An electrophotographic photoconductor was produced in the same manner as in Comparative Example 8 except that the amount of the [acidic disperser] used was changed to 0.4 parts.

Comparative Example 10

An electrophotographic photoconductor was produced in the same manner as in Example 1 except that the [crosslinked charge transport layer] was not formed.

TABLE 1-1

| | Production of electrophotographic photoconductor (crosslinked charge transport layer) | | | | | | | |
|---|---|---|---|---|---|---|---|---|
| | Material for three-dimensionally crosslinked polymer or comparative material Structural Formula | Acidic disperser | | | Inorganic filler | | Binder resin Compound name | Other ingredients Compound name |
| | | Compound name | Acid value (mgKOH/g) | Amount in coating liquid | Compound name | Amount in coating liquid | | |
| Ex. 1 | (1-1) | Polycarboxylic acid compound | About 180 | 0.05 | Alumina | 1 | — | — |
| Ex. 2 | (1-8) | Polycarboxylic acid compound | About 180 | 0.05 | Alumina | 1 | — | — |
| Ex. 3 | (1-12) | Polycarboxylic acid compound | About 180 | 0.05 | Alumina | 1 | — | — |
| Ex. 4 | (1-16) | Polycarboxylic acid compound | About 180 | 0.05 | Alumina | 1 | — | — |

TABLE 1-1-continued

| | Production of electrophotographic photoconductor (crosslinked charge transport layer) | | | | | | | |
|---|---|---|---|---|---|---|---|---|
| | Material for three-dimensionally crosslinked polymer or comparative material Structural Formula | Acidic disperser | | | Inorganic filler | | Binder resin Compound name | Other ingredients Compound name |
| | | Compound name | Acid value (mgKOH/g) | Amount in coating liquid | Compound name | Amount in coating liquid | | |
| Ex. 5 | (1-19) | Polycarboxylic acid compound | About 180 | 0.05 | Alumina | 1 | — | — |
| Ex. 6 | (1-1) | Polycarboxylic acid compound | About 365 | 0.05 | Alumina | 1 | — | — |
| Ex. 7 | (1-1) | Polycarboxylic acid compound | About 180 | 0.2 | Alumina | 1 | — | — |
| Ex. 8 | (1-1) | Polycarboxylic acid compound | About 180 | 0.05 | Titanium oxide | 1 | — | — |
| Ex. 9 | (1-1) | Styrene-acryl resin | About 200 | 0.05 | Alumina | 1 | — | — |
| Ex. 10 | (1-1) | Polycarboxylic acid compound | About 180 | 0.05 | Silica | 0.6 | — | — |
| Ex. 11 | (A-1) | Polycarboxylic acid compound | About 180 | 0.05 | Alumina | 1 | — | — |
| Ex. 12 | (A-2) | Polycarboxylic acid compound | About 180 | 0.05 | Alumina | 1 | — | — |

TABLE 1-2

| | Production of electrophotographic photoconductor (crosslinked charge transport layer) | | | | | | | |
|---|---|---|---|---|---|---|---|---|
| | Material for three-dimensionally crosslinked polymer or comparative material Structural Formula | Acidic disperser | | | Inorganic filler | | Binder resin Compound name | Other ingredients Compound name |
| | | Compound name | Acid value (mgKOH/g) | Amount in coating liquid | Compound name | Amount in coating liquid | | |
| Comp. Ex. 1 | (1-1) | — | — | — | Alumina | 1 | — | — |
| Comp. Ex. 2 | (C-1) | Polycarboxylic acid compound | About 180 | 0.05 | Alumina | 1 | — | — |
| Comp. Ex. 3 | (C-2) | Polycarboxylic acid compound | About 180 | 0.05 | Alumina | 1 | — | — |
| Comp. Ex. 4 | (C-3) | Polycarboxylic acid compound | About 180 | 0.05 | Alumina | 1 | — | — |
| Comp. Ex. 5 | (C-4) | Polycarboxylic acid compound | About 180 | 0.05 | Alumina | 1 | — | — |
| Comp. Ex. 6 | (C-4) | Polycarboxylic acid compound | About 180 | 0.07 | Alumina | 1.3 | — | Phenol resin |
| Comp. Ex. 7 | (1-1) | — | — | — | — | — | — | — |
| Comp. Ex. 8 | — | Polycarboxylic acid compound | About 180 | 0.1 | Alumina | 2 | Thermoplastic resin (polycarbonate) | Antioxidant of Structural Formula (C-5) |
| Comp. Ex. 9 | — | Polycarboxylic acid compound | About 180 | 0.4 | Alumina | 2 | Thermoplastic resin (polycarbonate) | Antioxidant of Structural Formula (C-5) |
| Comp. Ex. 10 | — | — | — | — | — | — | — | — |

TABLE 2

| | Materials | Trade name | Manufactureres |
|---|---|---|---|
| Acidic disperser | Polycarboxylic acid compound (about 180 mgKOH/g) | BYK-P104 | BYK-Chemie GmbH |
| | Polycarboxylic acid compound (about 365 mgKOH/g) | BYK-P105 | BYK-Chemie GmbH |
| | Styrene-acryl resin (about 200 mgKOH/g) | FB-1522 | MITSUBISHI RAYON CO., LTD. |

TABLE 2-continued

| | Materials | Trade name | Manufactureres |
|---|---|---|---|
| Inorganic filler | Alumina (particle diameter: about 0.3 μm) (specific resistance: $10^{10}$ Ω · cm or higher, pH 8 to 9) | SUMIKORANDOM AA-03 | Sumitomo Kagaku Kogyo Co., Ltd. |
| | Titanium oxide (particle diameter: about 0.3 μm) (specific resistance: $10^{10}$ Ω · cm or higher, pH 6 to 7) | CR-97 | ISHIHARA SANGYO KAISHA, LTD. |
| | Silica (particle diameter: about 0.1 μm) (specific resistance: $10^{10}$ Ω · cm or higher, pH 2 to 3) | KMPX100 | Shin-Etsu Silicone Co., Ltd. |

(Evaluation)

The electrophotographic photoconductors produced in Examples and Comparative Examples were evaluated in the following manner.

<Whether or not the [(tetrahydro-2H-pyran-2-yl)oxy]methyl Groups Remained>

Whether or not some of the [(tetrahydro-2H-pyran-2-yl)oxy]methyl groups had been eliminated in the three-dimensionally crosslinked polymer of the present invention was confirmed through infrared absroption spectrum measurement and thermogravimetric analysis.

<<Infrared Absroption Spectrum Measurement>>

In order to confirm whether or not some of the [(tetrahydro-2H-pyran-2-yl)oxy]methyl groups were eliminated, an infrared absorption spectrum was measured to compare the intensities of the aliphatic C—H stretching vibration peak (2,940±10 $cm^{-1}$) before and after reaction with each other, since the [(tetrahydro-2H-pyran-2-yl)oxy]methyl groups highly absorb light at this peak. Here, the intensity of the infrared absorption spectrum changes depending on the film thickness or concentration, making it difficult to compare intensities in an absolute manner. Thus, the intensities of the aliphatic C—H stretching vibration peak (2,940±10 $cm^{-1}$) before and after reaction were compared with each other on the basis of the intensities of the aromatic C—H stretching vibration peak (3,028±10 $cm^{-1}$) which remains unchanged before and after reaction. This infrared absroption spectrum measurement was performed using a Fourier transform infrared spectrophotometer (HORIBA FT720, product of HORIBA, Ltd.).

The infrared absorption spectrum measurement (before reaction) (1) was preformed as follows. Specifically, a compound expressed by the above Structural Formula (1-1) serving as a material of the three-dimensionally crosslinked polymer was dissolved in a highly volatile appropriate nonaqueous solvent (methylene chloride). Then, the resultant solution was coated on a KBr plate through which light of the infrared region can pass, followed by drying. The thus-formed thin film (several micrometers in thickness) on the plate was used for the measurement.

The infrared absorption spectrum measurement (after reaction) (2) was performed as follows. Specifically, the following crosslinked charge transport layer-coating liquid was directly spray-coated on an aluminum cylinder, followed by heating at 135° C. for 30 min, to thereby form a three-dimensionally crosslinked film. The formed three-dimensionally crosslinked film was peeled off with a cutter knife so as to have an appropriate size. The thus-cut film was sandwiched between KBr plates (for each plate, 35 mm×35 mm, thickness: 5 mm, product of JASCO Corporation).

[Composition of Crosslinked Charge Transport Layer-Coating Liquid for Infrared Absorption Spectrum Measurement]

Material for three-dimensionally crosslinked polymer: 10 parts (compound expressed by Structural Formula (1-1))

Acid catalyst (paratoluenesulfonic acid monohydrate): 0.02 parts

Tetrahydrofuran (anhydrous): 90 parts

Figure 23:
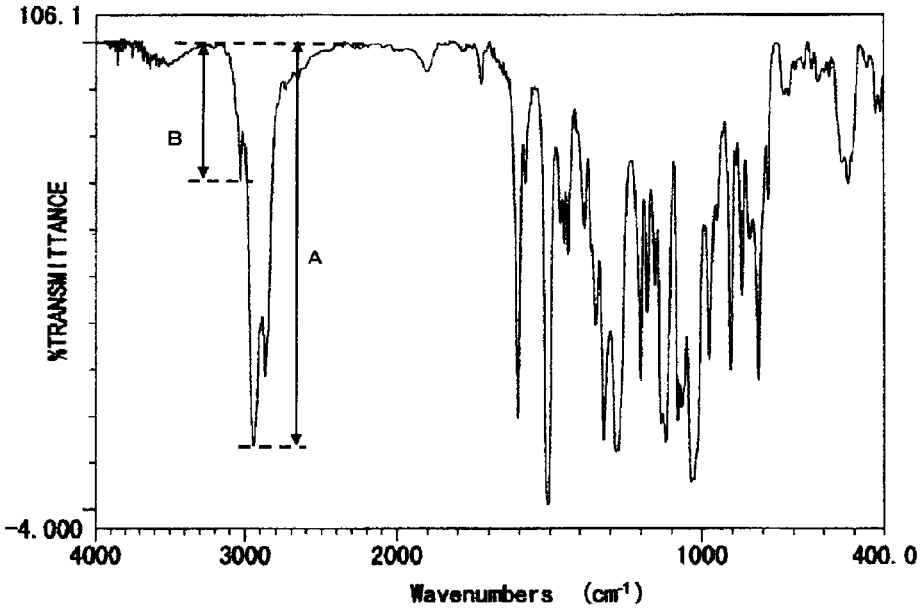
FIG. 23 is an infrared absorption spectrum of the compound expressed by Structural Formula (1-1) used in Examples before reaction.

FIG. 23 is an infrared absorption spectrum of the compound expressed by Structural Formula (1-1) used in Examples before reaction. In FIG. 23, the ratio A/B was 2.95 where A is an infrared absorption spectrum intensity of the charge transporting compound before reaction at the aliphatic C—H stretching vibration peak (2,940±10 $cm^{-1}$) and B is an infrared absorption spectrum intensity of the charge transporting compound before reaction at the aromatic C—H stretching vibration peak (3,028±10 $cm^{-1}$).

Figure 24:
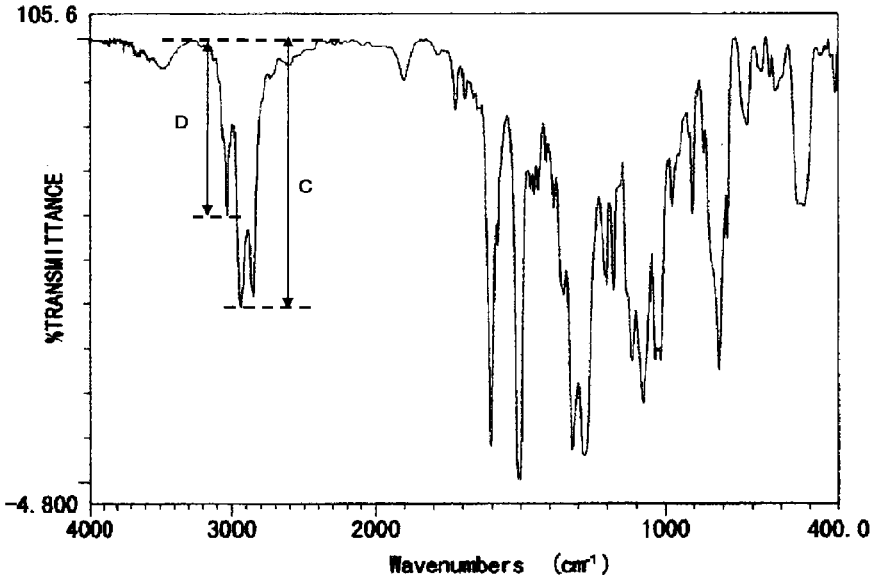
FIG. 24 is an infrared absorption spectrum of the crosslinked charge transport layer (three-dimensionally crosslinked film) formed from the compound expressed by Structural Formula (1-1) used in Examples.

FIG. 24 is an infrared absorption spectrum of the three-dimensionally crosslinked film formed on the aluminum cylinder using the above crosslinked charge transport layer-coating liquid. When the surface of the formed film was rubbed with a swab soaked in tetrahydrofuran in order to confirm whether or not the three-dimensionally crosslinked polymer was formed, there was no trace after rubbing. In FIG. 24, the ratio C/D was 1.52 where C is an infrared absorption spectrum intensity of the charge transporting compound after reaction at the aliphatic C—H stretching vibration peak (2,940±10 $cm^{-1}$) and D is an infrared absorption spectrum intensity of the charge transporting compound after reaction at the aromatic C—H stretching vibration peak (3,028±10 $cm^{-1}$).

As a result, the value (C/D)/(A/B) is calculated as 0.52 which is smaller than 1, indicating that the [(tetrahydro-2H-pyran-2-yl)oxy]methyl groups were eliminated.

Figure 25:
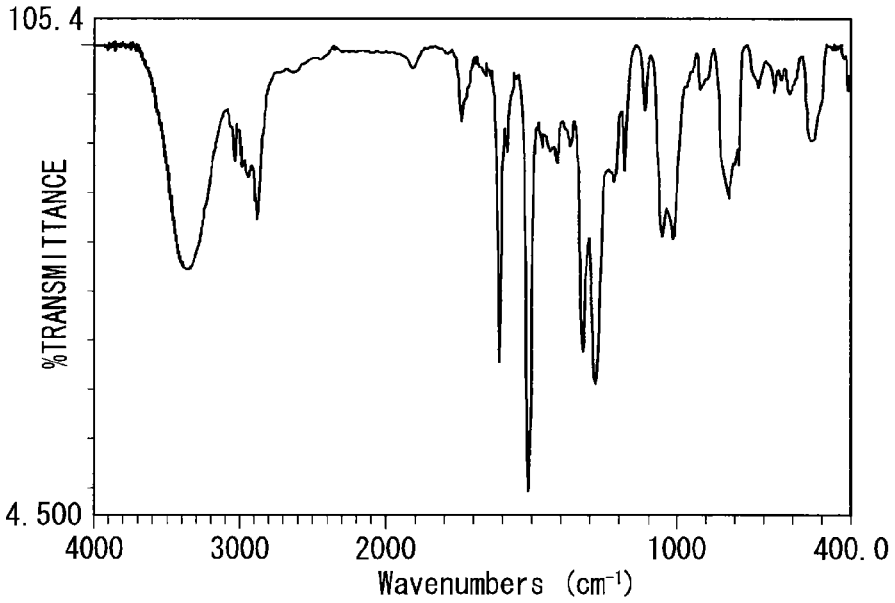
FIG. 25 is an infrared absorption spectrum of the methylol compound expressed by Structural Formula (C-3) and obtained in Synthesis Example 15.

FIG. 25 is an infrared absorption spectrum of the compound expressed by Structural Formula (C-3) and obtained in Synthesis Example 15. The compound expressed by Structural Formula (C-3) is a methylol compound having the same charge transportable structure as in the compound expressed by Structural Formula (1-1) but containing no [(tetrahydro-2H-pyran-2-yl)oxy]methyl group. The infrared absorption spectrum of the compound expressed by Structural Formula (C-3) was measured in the same manner as in the above-described infrared absorption spectrum measurement (before reaction) (1).

Comparison between the infrared absorption spectra of FIGS. 23 to 25 indicates that the aliphatic C—H stretching vibration peak (2,940 $cm^{-1}$) is mostly attributed to the [(tetrahydro-2H-pyran-2-yl)oxy]methyl groups and that the [(tetrahydro-2H-pyran-2-yl)oxy]methyl groups remain even in the three-dimensionally crosslinked film.

<<Thermogravimetric Analysis>>

Next, there was measured the mass of a polymer formed by polymerizing, with an acid catalyst, compounds each containing a charge transporting compound and three or more [(tetrahydro-2H-pyran-2-yl)oxy]methyl groups bound to one or more aromatic rings thereof. If some of the [(tetrahydro-2H-pyran-2-yl)oxy]methyl groups partially eliminated, considerable mass reduction is thought to occur when the three-dimensionally crosslinked film is formed. The mass thereof was measured with a thermo-gravimetric/differential thermal analyzer (TG/DTA6200, product of Seiko Instruments Inc.).

The crosslinked charge transport layer-coating liquid used for the above infrared absorption spectrum measurement was dropped on an aluminum open sample pan (P/N SSC000E030), followed by drying and measuring. The measurement was performed under the following conditions: the initial temperature was set to 30° C.; the temperature was increased to 150° C. at 20° C./min with nitrogen gas flowing at a flow rate of 200 mL/min; and the temperature was kept at 150° C. for 60 min.

Figure 26:
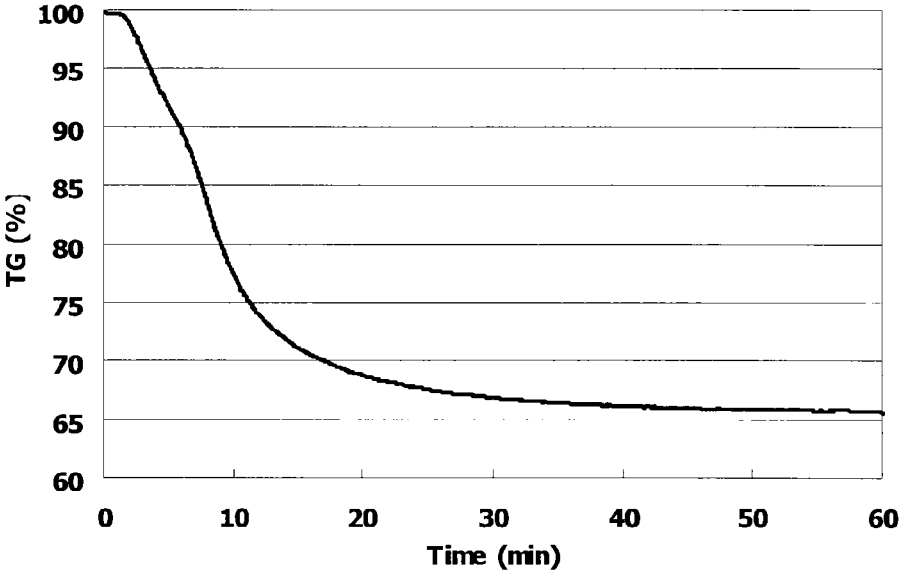
FIG. 26 is a graph of results of thermogravimetric analysis of the compound expressed by Structural Formula (1-1) and used in Examples, where the vertical axis indicates a rate of reduction in mass (%) and the horizontal axis indicates a measurement time (min).

FIG. 26 is a graph of results of thermogravimetric analysis of the compound expressed by Structural Formula (1-1) (i.e., a compound containing a charge transporting compound and three or more [(tetrahydro-2H-pyran-2-yl)oxy]methyl groups bound to one or more aromatic rings thereof) which is the material of the three-dimensionally crosslinked polymer. Under the experiment conditions, the mass reduction of about 10% is estimated as that of the solvent. Thus, the mass reduction of about 25% resulted from the polymerization reaction, suggesting that the [(tetrahydro-2H-pyran-2-yl)oxy]methyl groups were eliminated.

It is unclear what parts of the [(tetrahydro-2H-pyran-2-yl)oxy]methyl groups are eliminated. In the following Reaction mode 1, the tetrahydro-2H-pyran-2-yl group of one [(tetrahydro-2H-pyran-2-yl)oxy]methyl group is cleaved and eliminated; and then, while the (tetrahydro-2H-pyran-2-yl)oxy group of the other [(tetrahydro-2H-pyran-2-yl)oxy]methyl group is being cleaved and eliminated, a dimethylene ether bond is formed therebetween. Assuming that all the [(tetrahydro-2H-pyran-2-yl)oxy]methyl groups are reacted according to the Reaction mode 1, it has been found that the mass reduction of 39% is observed. However, the mass reduction is actually 25%, suggesting that the [(tetrahydro-2H-pyran-2-yl)oxy]methyl groups remained even in the three-dimensionally crosslinked film.

Reaction mode 1

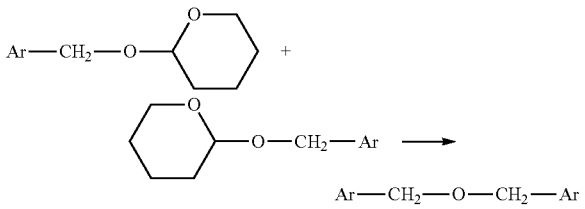

In this reaction formula, Ar is an aromatic ring of a charge transporting compound used in the present invention.

As described above, it is found that the three-dimensionally crosslinked polymer of the present invention was obtained after some of the [(tetrahydro-2H-pyran-2-yl)oxy]methyl groups of the compounds each containing a charge transporting compound and three or more [(tetrahydro-2H-pyran-2-yl)oxy]methyl groups bound to one or more aromatic rings thereof had been eliminated with an acid catalyst. Notably, this three-dimensionally crosslinked polymer is insoluble to a solvent.

<Dissolution Test (Whether or not the Three-Dimensionally Crosslinked Polymer was Formed)>

In order to confirm that the three-dimensionally crosslinked polymer was formed in the crosslinked charge transport layer of the electrophotographic photoconductor, tetrahydrofuran was used to perform a dissolution test. In the dissolution test, the surface of the electrophotographic photoconductor was rubbed with a swab soaked in tetrahydrofuran, and then whether or not the film was deformed was visually observed and evaluated according to the following evaluation criteria. The results are shown in Tables 3-1 and 3-2.

[Evaluation Criteria]

A: Undissolved (there was no trace formed by rubbing)

B: Partially dissolved (the film remained but traces were left)

C: Dissolved (the film was dissolved)

<Image Output Test>

Each of the electrophotographic photoconductors produced in Examples and Comparative Examples was subjected to an image output test. Specifically, each electrophotographic photoconductor was mounted to the process cartridge of a digital full-color complex machine (IMAGIONEO455, product of Ricoh Company Ltd.). The complex machine was caused to form an image (resolution: 600 dpi×600 dpi (which is about 236 dots per cm×about 236 dots per cm) on RICOH MYRECYCLE PAPER GP (A4 size) after the unexposed-area potential of the complex machine had been set to 700 (−V). Also, it was caused to continuously form a test pattern of a halftone band pattern of each of yellow, magenta, cyan and black on 500 sheets at a printing speed of 60 sheets per minute, so that 200,000 sheets were printed in total.

In the dissolution test, it is clear that the electrophotographic photoconductors evaluated as "C: Dissolved" or "B: Partially dissolved" did not form a firm three-dimensionally crosslinked polymer. Such electrophotographic photoconductors were difficult to satisfy excellent mechanical durability, electrical characteristics, photoconductive stability and stability to gas for a long period of time, and thus the electrophotographic photoconductors of some Comparative Examples were not evaluated for these items. In Comparative Example 1, no acidic disperser was used, and thus the inorganic filler aggregated to a great extent and sedimented immediately after the preparation of the coating liquid, so that the crosslinked charge transport layer-coating liquid could not be coated. Thus, the electrophotographic photoconductor of Comparative Example 1 was not subjected to the dissolution test. The electrophotographic photoconductors of Comparative Examples 8 and 9, using the thermoplastic resin, were obviously dissolved in tetrahydrofuran, and thus they were not subjected to the dissolution test. The electrophotographic photoconductor of Comparative Example 10 did not contain the crosslinked charge transport layer and thus was not subjected to the dissolution test. The electrophotographic photoconductor of Comparative Example 10 caused background smear in the course of the image output test and thus was not evaluated for mechanical durability, electrical characteristics, photoconductive stability and stability to gas. The results are shown in Table 3-2.

<Evaluation of Image Quality>

The evaluation of the image quality was performed as follows.

Specifically, the image density of the haltone band pattern (2 by 2 dot black portion) was measured with an image densitometer (X-RITE 939, product of SDG Co.) and evaluated according to the following evaluation criteria. The results are shown in Tables 3-1 and 3-2.

[Evaluation Criteria]

A: 0.3<image density

B: 0.2≤image density≤0.3

C: 0.1≤image density<0.2

D: 0≤image density<0.1

<Evalution of Mechanical Durability>

The mechanical durability was evaluated as an abrasion amount (μm) by measuring the film thicknesses before printing, after 100,000-sheets printing and after 200,000-sheets printing. The results are shown in Tables 3-1 and 3-2.

<Evaluation of Electrical Characteristics>

The electrical characteristics were evaluated by measuring the exposed-area potential (−V) at a light dose of about 0.4 $\mu J/cm^2$ by a light source for image exposure before printing, after 100,000-sheets printing and after 200,000-sheets printing. The results are shown in Tables 3-1 and 3-2.

<Evaluation of Environmental Stability>

The environmental stability was evaluated as follows. Specifically, the above image forming apparatus was placed in a high-temperature, high-humidity room which had been set to 30° C. and 90 RH %, and was caused to continuously form an image on 50 sheets. The image density of the haltone band pattern (2 by 2 dot black portion) of the $50^{th}$ sheet was measured with an image densitometer (X-RITE939, product of SDG Co.) and evaluated according to the following evaluation criteria. The results are shown in Tables 3-1 and 3-2.

[Evaluation criteria]

A: 0.3<image density

B: 0.2≤image density≤0.3

C: 0.1≤image density<0.2

D: 0≤image density<0.1

<Stability to Gas>

The stability to gas was evaluated as follows. Specifically, using a NOx gas exposing device, each electrophotographic photoconductor was exposed for 4 days to an atmosphere of NO gas: 5 ppm/$NO_2$ gas: 20 ppm. Then, the image quality of images produced thereby after the NOx exposure was evaluated and the stability to gas was evaluated according to the following criteria. The results are shown in Tables 3-1 and 3-2.

[Evaluation Criteria]

A: Good (almost no degradation of the image was observed)

B: Resolution was somewhat decreased (the image quality was somewhat degraded but was non-problematic)

C: Resolution was decreased (the image quality was clearly degraded)

D: Image blur occurred (the image was difficult to identify)

TABLE 3-1

| | Evaluation | | | | | | | | | | |
|---|---|---|---|---|---|---|---|---|---|---|---|
| | | Image quality | | | Mechanical durability (μm) | | Electrical characteristics (−V) | | | | |
| | Dissolution test | Initial | 100,000 sheets | 200,000 sheets | 100,000 sheets | 200,000 sheets | Initial | 100,000 sheets | 200,000 sheets | Environmental stability | Stability to gas |
| Ex. 1 | A | A | A | A | 0.17 | 0.36 | 44 | 46 | 49 | A | A |
| Ex. 2 | A | A | A | A | 0.21 | 0.41 | 47 | 49 | 52 | A | A |
| Ex. 3 | A | A | A | A | 0.20 | 0.38 | 53 | 56 | 59 | A | A |
| Ex. 4 | A | A | A | A | 0.18 | 0.39 | 48 | 50 | 52 | A | A |
| Ex. 5 | A | A | A | A | 0.17 | 0.37 | 46 | 48 | 49 | A | A |
| Ex. 6 | A | A | A | A | 0.18 | 0.38 | 44 | 45 | 47 | A | A |
| Ex. 7 | A | A | A | A | 0.21 | 0.41 | 44 | 46 | 49 | A | A |
| Ex. 8 | A | A | A | A | 0.26 | 0.48 | 45 | 47 | 50 | A | A |
| Ex. 9 | A | A | B | C | 0.28 | 0.51 | 72 | 83 | 89 | B | B |
| Ex. 10 | A | A | B | C | 0.25 | 0.50 | 51 | 54 | 59 | C | C |
| Ex. 11 | A | A | A | A | 0.33 | 0.64 | 60 | 64 | 71 | A | A |
| Ex. 12 | A | B | C | C | 0.20 | 0.38 | 44 | 47 | 49 | C | C |

TABLE 3-2

| | Evaluation | | | | | | | | | | |
|---|---|---|---|---|---|---|---|---|---|---|---|
| | | Image quality | | | Mechanical durability (μm) | | Electrical characteristics (−V) | | | | |
| | Dissolution test | Initial | 100,000 sheets | 200,000 sheets | 100,000 sheets | 200,000 sheets | Initial | 100,000 sheets | 200,000 sheets | Environmental stability | Stability to gas |
| Comp. Ex. 1 | — | — | — | — | — | — | — | — | — | — | — |
| Comp. Ex. 2 | C | — | — | — | — | — | — | — | — | — | — |
| Comp. Ex. 3 | B | — | — | — | — | — | — | — | — | — | — |
| Comp. Ex. 4 | A | B | C | C | 0.33 | 0.78 | 50 | 72 | 89 | D | C |
| Comp. Ex. 5 | C | — | — | — | — | — | — | — | — | — | — |
| Comp. Ex. 6 | A | A | B | C | 1.54 | 3.82 | 115 | 139 | 152 | D | C |
| Comp. Ex. 7 | A | A | A | A | 0.32 | 0.80 | 46 | 51 | 53 | A | C |

TABLE 3-2-continued

| | Evaluation | | | | | | | | | | |
|---|---|---|---|---|---|---|---|---|---|---|---|
| | | Image quality | | | Mechanical durability (μm) | | Electrical characteristics (−V) | | | | |
| | Dissolution test | Initial | 100,000 sheets | 200,000 sheets | 100,000 sheets | 200,000 sheets | Initial | 100,000 sheets | 200,000 sheets | Environmental stability | Stability to gas |
| Comp. Ex. 8 | — | A | A | A | 2.01 | 3.98 | 73 | 75 | 81 | B | B |
| Comp. Ex. 9 | — | A | A | B | 2.13 | 3.75 | 67 | 71 | 79 | C | D |
| Comp. Ex. 10 | — | A | Background smear | — | 11.30 | — | 36 | 29 | — | — | — |

<Results of Dissolution Test (Whether or not the Three-Dimensionally crosslinked polymer was formed)>

Examples 1 to 12 each used the compound containing a charge transporting compound and three or more [(tetrahydro-2H-pyran-2-yl)oxy]methyl groups bound to one or more aromatic rings thereof, and thus could obtain good reactivity and form the three-dimensionally crosslinked polymer.

In Comparative Example 2, the formed film was dissolved, indicating that the compound containing a charge transporting compound and four [(tetrahydro-2H-pyran-2-yl)oxy]methyl groups bound to the aromatic rings thereof has no reactivity and does not form a three-dimensionally crosslinked polymer.

In Comparative Example 3, the formed film was partially undissolved, indicating that the compound containing a charge transporting compound and four [(tetrahydro-2H-pyran-2-yl)oxy]methyl groups bound to the aromatic rings thereof has reactivity but does not form a three-dimensionally crosslinked polymer having a high crosslinking density.

In Comparative Example 4, the compound containing a charge transporting compound and four methylol groups bound to the aromatic rings thereof has good reactivity and could form a three-dimensionally crosslinked polymer.

In Comparative Example 5, a three-dimensionally crosslinked polymer could not be formed similar to Comparative Example 2.

In Comparative Example 6, the reactive phenol resin was added to the coating liquid used in Comparative Example 5 and thus a three-dimensionally crosslinked polymer could be formed.

Similar to Example 1, Comparative Example 7 used the compound containing a charge transporting compound and three or more [(tetrahydro-2H-pyran-2-yl)oxy]methyl groups bound to one or more aromatic rings thereof and thus could form a three-dimensionally crosslinked polymer.

<Results of Mechanical Durability, Electrical Characteristics, Environmental Stability and Stability to Gas>

The evaluations of the electrophotographic photoconductors of Examples 1 to 12 will be described. The electrophotographic photoconductors of Examples 1 to 8 were found to be excellent in mechanical durability since they had high abrasion resistance and to be excellent in electrical characteristics since they were not increased in exposed-area potential very much. This can be confirmed by the fact that the electrophotographic photoconductors of Examples 1 to 8 were higher in abrasion resistance and superior in mechanical durability than that of Comparative Example 10 containing no crosslinked charge transport layer and that of Comparative Example 7 containing neither inorganic filler nor disperser agent.

The electrophotographic photoconductor of Example 9 was found to be increased in exposed-area potential since the acidic disperser used was not a polycarboxylic acid compound.

The electrophotographic photoconductor of Example 10 was found to be decreased in resolution since the inorganic filler used was acidic silica.

The electrophotographic photoconductor of Example 11 was not particularly problematic in terms of the evaluation of image quality. However, it was found to be somewhat inferior in mechanical durability (abrasion resistance) to those of Examples since the exposed-area potential thereof was somewhat higher than that of the electrophotographic photoconductors formed by using the compound represented by General Formula (1).

The compound expressed by Structural Formula (A-1) used in Example 11 has more [(tetrahydro-2H-pyran-2-yl)oxy]methyl groups than the compound represented by General Formula (1) per the molecular weight thereof, making it easier to form a polymer having higher crosslinking density. However, this leads to reduction in molecular mobility and hence reduction in electrical characteristics. Also, the compound expressed by Structural Formula (A-1) does not have a linking group as in the compound represented by General Formula (1). Thus, presumably, it is difficult for the strain of the molecular structure to relax, so that abrasion resistance decreased.

The electrophotographic photoconductor of Example 12 was formed using, as a material of the three-dimensionally crosslinked polymer, the compound containing a charge transporting compound and four [(tetrahydro-2H-pyran-2-yl)oxy]methyl groups bound to the aromatic groups thereof where the two triphenylamine structures are linked together via a conjugate bond. Thus, this electrophotographic photoconductor was found to be excellent in mechanical durability since it had high abrasion resistance and to be excellent in electrical characteristics since the exposed-area potential thereof was low. However, this charge transporting compound where the two triphenylamine structures are linked together via a conjugate bond has a low oxidation potential and thus the electrophotographic photoconductor of Example 12 was found to be somewhat poor in environmental stability and stability to gas.

The evaluations of the electrophotographic photoconductors of Comparative Examples 4 and 6 to 9 will be described. The electrophotographic photoconductor of Comparative Example 4 was formed by using the methylol compound as the material of the three-dimensionally crosslinked polymer and thus was found to be very bad in environmental properties due to the presence of unreacted hydroxyl groups.

For the electrophotographic photoconductor of Comparative Example 6, the phenol resin was added to the crosslinked charge transport layer-coating liquid. The three-dimensionally crosslinked polymer was formed in the crosslinked charge transport layer, the curing reaction proceeded ununiformly but the crosslinked charge transport layer was degraded in ability to retain the filler. As a result, the electrophotographic photoconductor was found to be poor in mechanical durability (abrasion resistance). Due to the presence of hydroxyl groups of the phenol resin, the electrophotographic photoconductor was found to be degraded in environmental stability.

The electrophotographic photoconductor of Comparative Example 7 contains neither inorganic filler nor disperser and thus was found to be degraded in resolution in the evaluation for stability to gas. Presumably, this is due to the acid catalyst remaining the crosslinked charge transport layer. In the present invention, presumably, the basic inorganic filler adsorbed and effectively neutralized the acid catalyst, making it possible to prevent reduction of the image density.

In the electrophotographic photoconductors of Comparative Examples 8 and 9, the increased amount of the acidic disperser caused image blur. Also, the electrophotographic photoconductor containing the inorganic filler but containing the thermoplastic resin (polycarbonate resin) as a binder resin was found to be poor in mechanical durability (abrasion resistance).

As described above, the present invention can provide: an electrophotographic photoconductor excellent in mechanical durability, electrical characteristics, environmental stability and stability to gas and able to continue to stably form high-quality images even in an environment involving changes in environmental factors; and an image forming apparatus and a process cartridge each using the electrophotographic photoconductor.

Embodiments of the present invention are as follows.

<1> An electrophotographic photoconductor including:

an electrically conductive substrate; and at least a photoconductive layer on the electrically conductive substrate, wherein the electrophotographic photoconductor includes an uppermost surface layer, and the uppermost surface layer includes an inorganic filler, an acidic disperser and a three-dimensionally crosslinked polymer, wherein the three-dimensionally crosslinked polymer is formed through polymerization among compounds each containing a charge transporting compound and three or more [(tetrahydro-2H-pyran-2-yl)oxy]methyl groups where the charge transporting compound has one or more aromatic rings and the [(tetrahydro-2H-pyran-2-yl)oxy]methyl groups are bound to the aromatic rings of the charge transporting compound, and wherein the polymerization proceeds after some of the [(tetrahydro-2H-pyran-2-yl)oxy]methyl groups have been partially cleaved and eliminated with an acid catalyst.

<2> The electrophotographic photoconductor of <1>, wherein the acidic disperser is a polycarboxylic acid.

<3> The electrophotographic photoconductor of <1> or <2>, wherein the inorganic filler is a metal oxide.

<4> The electrophotographic photoconductor of <3>, where the metal oxide is titanium oxide or alumina or both thereof.

<5> The electrophotographic photoconductor of any one of <1> to <4>, wherein the compound containing a charge transporting compound and three or more [(tetrahydro-2H-pyran-2-yl)oxy]methyl groups where the charge transporting compound has one or more aromatic rings and the [(tetrahydro-2H-pyran-2-yl)oxy]methyl groups are bound to the aromatic rings of the charge transporting compound is a compound represented by the following General Formula (1):

General Formula (1)

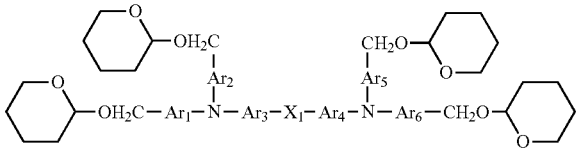

where $X_1$ is a C1-C4 alkylene group, a C2-C6 alkylidene group, a divalent group formed of two C2-C6 alkylidene groups bonded together via a phenylene group, or an oxygen atom, and $Ar_1$, $Ar_2$, $Ar_3$, $Ar_4$, $Ar_5$ and $Ar_6$ each are a C6-C18 divalent aromatic hydrocarbon group which may have an alkyl group as a substituent.

<6> The electrophotographic photoconductor of <5>, wherein the compound represented by the General Formula (1) is a compound represented by the following General Formula (1-1):

General Formula (1-1)

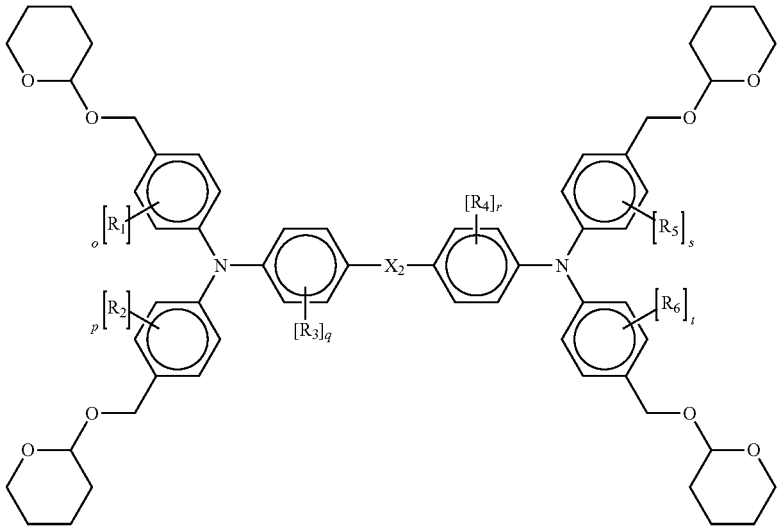

where $X_2$ is —$CH_2$—, —$CH_2CH_2$—, —$C(CH_3)_2$-Ph-$C(CH_3)_2$—, —$C(CH_2)_5$—or —O—, where Ph is a phenylene group; $R_1$, $R_2$, $R_3$, $R_4$, $R_5$ and $R_6$, which may be the same or different, each are a hydrogen atom, a methyl group or an ethyl group; and o, p, q, r, s and t each are an integer of 1 to 4.

<7> The electrophotographic photoconductor of any one of <1> to <6>, wherein the photoconductive layer comprises a charge generation layer, a charge transport layer and a crosslinked charge transport layer disposed in this order on the electrically conductive substrate, and the crosslinked charge transport layer is the uppermost surface layer.

<8> An image forming method including:

charging a surface of an electrophotographic photoconductor;

exposing the charged surface of the electrophotographic photoconductor to light to form a latent electrostatic image;

developing the latent electrostatic image with a toner to form a visible image;

transferring the visible image onto a recording medium; and fixing the transferred visible image on the recording medium, wherein the electrophotographic photoconductor is the electrophotographic photoconductor of any one of <1> to <7>.

<9> An image forming apparatus including:

an electrophotographic photoconductor;

a charging unit configured to charge a surface of the electrophotographic photoconductor;

an exposing unit configured to expose the charged surface of the electrophotographic photoconductor to light to form a latent electrostatic image;

a developing unit configured to develop the latent electrostatic image with a toner to form a visible image;

a transfer unit configured to transfer the visible image onto a recording medium; and a fixing unit configured to fix the transferred visible image on the recording medium, wherein the electrophotographic photoconductor is the electrophotographic photoconductor of any one of <1> to <7>.

<10> A process cartridge including:

an electrophotographic photoconductor; and at least one unit selected from the group consisting of a charging unit, an exposing unit, a developing unit, a transfer unit, a cleaning unit and a charge-eliminating unit, wherein the process cartridge is detachably mounted to a main body of an image forming apparatus, and wherein the electrophotographic photoconductor is the electrophotographic photoconductor of any one of <1> to <7>.

This application claims priority to Japanese application No. 2011-249879, filed on Nov. 15, 2011, and incorporated herein by reference.

What is claimed is:

1. An electrophotographic photoconductor comprising:

an electrically conductive substrate; and at least a photoconductive layer on the electrically conductive substrate, wherein the electrophotographic photoconductor comprises an uppermost surface layer, and the uppermost surface layer comprises an inorganic filler, an acidic disperser and a three-dimensionally crosslinked polymer, wherein the three-dimensionally crosslinked polymer is formed through polymerization among compounds each containing a charge transporting compound and three or more [(tetrahydro-2H-pyran-2-yl)oxy]methyl groups where the charge transporting compound has one or more aromatic rings and the [(tetrahydro-2H-pyran-2-yl)oxy]methyl groups are bound to the aromatic rings of the charge transporting compound, and wherein the polymerization proceeds after some of the [(tetrahydro-2H-pyran-2-yl)oxy]methyl groups have been partially cleaved and eliminated with an acid catalyst.

2. The electrophotographic photoconductor of claim 1, wherein the acidic disperser is a polycarboxylic acid.

3. The electrophotographic photoconductor of claim 1, wherein the inorganic filler is a metal oxide.

4. The electrophotographic photoconductor of claim 3, where the metal oxide is titanium oxide or alumina or both thereof.

5. The electrophotographic photoconductor of claim 1, wherein the compound containing a charge transporting compound and three or more [(tetrahydro-2H-pyran-2-yl)oxy]methyl groups where the charge transporting compound has one or more aromatic rings and the [(tetrahydro-2H-pyran-2-yl)oxy]methyl groups are bound to the aromatic rings of the charge transporting compound is a compound represented by the following General Formula (1):

General Formula (1)

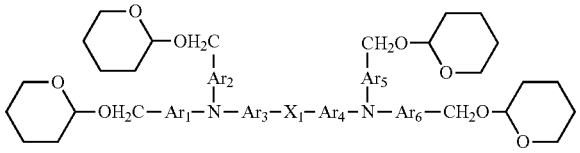

where $X_1$ is a C1-C4 alkylene group, a C2-C6 alkylidene group, a divalent group formed of two C2-C6 alkylidene groups bonded together via a phenylene group, or an oxygen atom, and $Ar_1$, $Ar_2$, $Ar_3$, $Ar_4$, $Ar_5$ and $Ar_6$ each are a C6-C18 divalent aromatic hydrocarbon group which may have an alkyl group as a substituent.

6. The electrophotographic photoconductor of claim 5, wherein the compound represented by the General Formula (1) is a compound represented by the following General Formula (1-1):

General Formula (1-1)

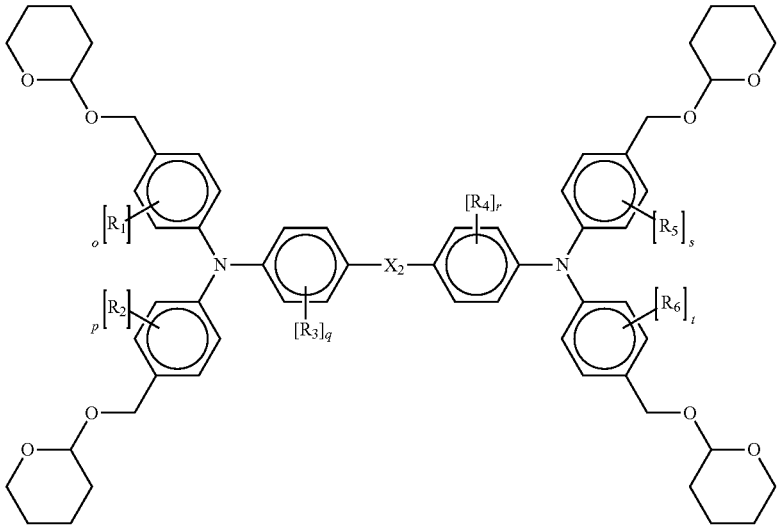

where $X_2$ is —$CH_2$—, —$CH_2CH_2$—, —$C(CH_3)_2$-Ph-$C(CH_3)_2$—, —$C(CH_2)_5$— or —O—, where Ph is a phenylene group; $R_1$, $R_2$, $R_3$, $R_4$, $R_5$ and $R_6$, which may be the same or different, each are a hydrogen atom, a methyl group or an ethyl group; and o, p, q, r, s and t each are an integer of 1 to 4.

7. The electrophotographic photoconductor of claim 1, wherein the photoconductive layer comprises a charge generation layer, a charge transport layer and a crosslinked charge transport layer disposed in this order on the electrically conductive substrate, and the crosslinked charge transport layer is the uppermost surface layer.

8. An image forming apparatus comprising:

an electrophotographic photoconductor;

a charging unit configured to charge a surface of the electrophotographic photoconductor;

an exposing unit configured to expose the charged surface of the electrophotographic photoconductor to light to form a latent electrostatic image;

a developing unit configured to develop the latent electrostatic image with a toner to form a visible image;

a transfer unit configured to transfer the visible image onto a recording medium; and a fixing unit configured to fix the transferred visible image on the recording medium, wherein the electrophotographic photoconductor comprises:

an electrically conductive substrate; and at least a photoconductive layer on the electrically conductive substrate, wherein the electrophotographic photoconductor comprises an uppermost surface layer, and the uppermost surface layer comprises an inorganic filler, an acidic disperser and a three-dimensionally crosslinked polymer, wherein the three-dimensionally crosslinked polymer is formed through polymerization among compounds each containing a charge transporting compound and three or more [(tetrahydro-2H-pyran-2-yl)oxy]methyl groups where the charge transporting compound has one or more aromatic rings and the [(tetrahydro-2H-pyran-2-yl)oxy]methyl groups are bound to the aromatic rings of the charge transporting compound, and wherein the polymerization proceeds after some of the [(tetrahydro-2H-pyran-2-yl)oxy]methyl groups have been partially cleaved and eliminated with an acid catalyst.

9. A process cartridge comprising:

an electrophotographic photoconductor; and at least one unit selected from the group consisting of a charging unit, an exposing unit, a developing unit, a transfer unit, a cleaning unit and a charge-eliminating unit, wherein the process cartridge is detachably mounted to a main body of an image forming apparatus, and wherein the electrophotographic photoconductor comprises:

an electrically conductive substrate; and at least a photoconductive layer on the electrically conductive substrate, wherein the electrophotographic photoconductor comprises an uppermost surface layer, and the uppermost surface layer comprises an inorganic filler, an acidic disperser and a three-dimensionally crosslinked polymer, wherein the three-dimensionally crosslinked polymer is formed through polymerization among compounds each containing a charge transporting compound and three or more [(tetrahydro-2H-pyran-2-yl)oxy]methyl groups where the charge transporting compound has one or more aromatic rings and the [(tetrahydro-2H-pyran-2-yl)oxy]methyl groups are bound to the aromatic rings of the charge transporting compound, and wherein the polymerization proceeds after some of the [(tetrahydro-2H-pyran-2-yl)oxy]methyl groups have been partially cleaved and eliminated with an acid catalyst.

* * * * *